US012618196B2

(12) United States Patent
Larsson et al.

(10) Patent No.: US 12,618,196 B2
(45) Date of Patent: May 5, 2026

(54) METHOD FOR PRODUCING A CELLULOSE PRODUCT AND A CELLULOSE PRODUCT

(71) Applicant: PULPAC AB, Västra Frölunda (SE)

(72) Inventors: Ove Larsson, Västra Frölunda (SE); Martin Ljungberg, Gothenburg (SE); Edward Guidotti, Gothenburg (SE); Björn Arlerot, Gothenburg (SE); Olle Högblom, Gothenburg (SE); Patrik Larsson, Kärna (SE)

(73) Assignee: PULPAC AB, Västra Frölunda (SE)

( * ) Notice: Subject to any disclaimer, the term of this patent is extended or adjusted under 35 U.S.C. 154(b) by 61 days.

(21) Appl. No.: 18/722,947

(22) PCT Filed: Dec. 15, 2022

(86) PCT No.: PCT/EP2022/086132
§ 371 (c)(1),
(2) Date: Jun. 21, 2024

(87) PCT Pub. No.: WO2023/117682
PCT Pub. Date: Jun. 29, 2023

(65) Prior Publication Data

US 2025/0052005 A1 Feb. 13, 2025

(30) Foreign Application Priority Data

Dec. 23, 2021 (SE) ..... 2151618-2

(51) Int. Cl.
*D21F 9/00* (2006.01)
*D21B 1/06* (2006.01)

(52) U.S. Cl.
CPC ..... *D21F 9/00* (2013.01); *D21B 1/063* (2013.01)

(58) Field of Classification Search
CPC ..... D21B 1/063; D21B 1/066; B65B 43/08; B31D 1/005; D21J 3/12
See application file for complete search history.

(56) References Cited

U.S. PATENT DOCUMENTS

| | | | | |
|---|---|---|---|---|
| 12,420,517 | B2 * | 9/2025 | Högblom | B31B 50/592 |
| 2019/0070819 | A1 * | 3/2019 | Larsson | B29C 49/22 |
| 2020/0206970 | A1 * | 7/2020 | Ueno | B27N 3/04 |
| 2021/0301107 | A1 * | 9/2021 | Tanaka | B27N 3/002 |

FOREIGN PATENT DOCUMENTS

| | | | | |
|---|---|---|---|---|
| EP | 1840043 | A1 | 10/2007 | |
| GB | 675652 | A | 7/1952 | |
| SE | 1750313 | A1 | 9/2018 | |
| SE | 1950299 | A1 | 9/2020 | |
| WO | WO-2017160218 | A1 * | 9/2017 | B30B 5/02 |
| WO | 2022218531 | A1 | 10/2022 | |
| WO | 2022218872 | A1 | 10/2022 | |

OTHER PUBLICATIONS

International Search Report and Written Opinion mailed Apr. 11, 2023 for International Application No. PCT/EP2022/086132, 15 pages.

* cited by examiner

*Primary Examiner* — Yung-Sheng M Tsui
(74) *Attorney, Agent, or Firm* — Sage Patent Group

(57) ABSTRACT

A method for producing a cellulose product from an air-formed cellulose blank structure includes the steps of providing a cellulose-based material to a mill, milling the cellulose-based material, and providing an air-formed cellulose blank structure, wherein the cellulose blank structure is air-formed from cellulose fibres.

11 Claims, 53 Drawing Sheets

* Shipping in one piece.

* NOTE: Whenever the fiber product requires barrier properties to protect from water and/or grease, special pre-coated tissue must be used.

4:3
MS11
4:4
4:5

P:3
MA1
4:1
4:2
SA3
$F_c$

MS11
4:6
t
1:2
P:3
MS12
4

METHOD FOR PRODUCING A CELLULOSE PRODUCT AND A CELLULOSE PRODUCT

CROSS-REFERENCE TO RELATED APPLICATIONS

This application is a 35 U.S.C. § 371 national stage application for International Application No. PCT/EP2022/086132, entitled "A METHOD FOR PRODUCING A CELLULOSE PRODUCT AND A CELLULOSE PRODUCT", filed on Dec. 15, 2022, which claims priority to Swedish Patent Application No. 2151618-2, filed on Dec. 23, 2021, the disclosures and contents of which are hereby incorporated by reference in their entireties.

TECHNICAL FIELD

The present disclosure relates to a method and an apparatus for forming an air-formed cellulose blank structure for producing a cellulose product, wherein the method comprises the steps of providing a flow of cellulose-based material to a mill, defibrating the cellulose-based material in the mill into cellulose fibres, providing an air-formed cellulose blank structure, wherein the cellulose blank structure is air-formed from the cellulose fibres.

BACKGROUND

Cellulose fibres are often used as raw material for producing or manufacturing products. Products formed of cellulose fibres can be used in many different situations where there is a need for having sustainable products. A wide range of products can be produced from cellulose fibres and a few examples are disposable plates and cups, blank structures and packaging materials.

Forming moulds are commonly used when manufacturing cellulose products from raw materials including cellulose fibres, and traditionally the cellulose products have been produced with wet-forming technologies. A material commonly used for cellulose fibre products is wet moulded pulp. Wet moulded pulp has the advantage of being considered as a sustainable packaging material, since it is produced from biomaterials and can be recycled after use. Consequently, wet moulded pulp has been quickly increasing in popularity for different applications. Wet moulded pulp articles are generally formed by immersing a suction forming mould into a liquid or semi liquid pulp suspension or slurry comprising cellulose fibres, and when suction is applied, a body of pulp is formed with the shape of the desired product by fibre deposition onto the forming mould. With all wet-forming technologies, there is a need for drying of the wet moulded product, where the drying is a time and energy consuming part of the production. The demands on aesthetical, chemical and mechanical properties of cellulose products are increasing, and due to the properties of wet-formed cellulose products, the mechanical strength, flexibility, and chemical properties are limited. It is also difficult in wet-forming processes to control the mechanical properties of the cellulose products with high precision. One development in the field of producing cellulose products is the forming of cellulose fibres without using wet-forming technologies, and instead the cellulose products are produced in a dry-forming process. In the dry-forming process, an air-formed cellulose blank structure is used. The air-formed cellulose blank structure is inserted into a forming mould and during the forming of the cellulose products the cellulose blank structure is subjected to a high forming pressure and a high forming temperature.

When using cellulose products made according to the dry-forming process, the cellulose products may be exposed to liquids, food or other substances that may affect the stiffness and rigidity of the cellulose products due to the tendency of the formed cellulose products to absorb for example water, moisture, or other substances. Plastic films that are laminated to the cellulose products may be used for preventing liquid from affecting the cellulose products. However, with the demand for more environmentally friendly products there is a desire to produce the cellulose products without plastic materials.

There is thus a need for an improved method for producing cellulose products from an air-formed cellulose blank structure, where the cellulose products can be produced to resist contact with liquids, food and other substances for longer time periods without affecting the mechanical properties of the cellulose products. There is further a demand for certain types of products to hold liquids or food, where no harmful substances are added to the cellulose products.

SUMMARY

An object of the present disclosure is to provide an improved method and apparatus for producing a cellulose blank structure and a method for producing a cellulose product where the previously mentioned problems are avoided.

This object is at least partly achieved by the features of the independent claims. The dependent claims contain further developments of the method for producing a cellulose product and the cellulose product.

The description below will refer to Scala as a collective name for a machine for producing a cellulose product according to the invention, where the machine will comprise a variety of parts that will be explained below and in connection to the drawings.

The invention relates to a method for forming an air-formed cellulose blank structure for producing a cellulose product, wherein the method comprises the steps;

- providing a flow of cellulose-based material to a mill,
- defibrating the cellulose-based material in the mill into cellulose fibres, providing an air-formed cellulose blank structure,
- wherein the cellulose blank structure is air-formed from the cellulose fibres,
- wherein the step of air-forming comprises the step of feeding the cellulose fibres to a first opening in a forming hood,
- wherein the cellulose fibres are directed onto a first side of a conveyer belt by the forming hood via a second opening in the forming hood,
- wherein a suction box is arranged in connection to a second side of the conveyer belt opposite the second opening of the forming hood, wherein the suction box comprises a fan that is connected to the suction box that creates an under-pressure generating a negative pressure gradient between the first side and the second side of the conveyer belt via through openings in the conveyer belt for forming the cellulose blank structure from the cellulose fibres directed onto the first side of the conveyer belt,
- providing the cellulose blank structure to a forming mould (clamping unit) for forming the cellulose blank structure into a three dimensional cellulose product, intermittently operating the forming mould to apply a forming pressure onto the cellulose blank structure, synchronizing the conveyer belt to intermittently form the cellulose blank structure simultaneously to the intermittent operation of the forming mould or between two intermittent operations of the forming mould.

One advantage with the method is that the synchronization allows for a compact machine with high control of all process steps. In a stationary mode, the conveyor belt is arranged in a standstill state such that the cellulose blank structure is formed on an at least partly non-moving conveyor belt. Here, it should be understood that the cellulose blank structure can be formed onto the conveyer belt only when the conveyer belt is in a standstill, or alternatively is formed when the conveyer belt moves into the standstill and during the standstill, or alternatively is formed during the standstill and when the conveyer belt moves from the standstill, or alternatively is formed when the conveyer belt moves into the standstill and during the standstill and when the conveyer belt moves from the standstill. In yet another example, the cellulose blank structure can be formed onto the conveyer belt only when the conveyer belt is moving, i.e. synchronized with the forming mould to allow forming of the cellulose blank structure between two pressing operations. The duration of the standstill state is synchronized with the duration of the pressing operation such that the standstill state is occurring during the pressing operation. The conveyor belt may be arranged in the standstill state at any time during pressing operation, and the time duration of the standstill state may be only a part of the time duration of the pressing operation, or alternatively the full pressing operation. I.e., the conveyor belt is synchronized to intermittently be in a standstill state during parts of or the whole of the application of a forming pressure onto the cellulose blank structure in the forming mould. The conveyor belt is advantageously an air permeable forming wire configured in a position close to the suction box on one side and the web forming on the opposite side. The suction box creates an under-pressure on the forming wire that creates an airstream in a direction towards the suction box, such that that the fibres are formed into the cellulose blank structure onto the forming wire.

According to one advantageous example, the step of providing the cellulose blank structure to a forming mould comprises the step of feeding the cellulose blank structure essentially vertically.

This has the advantage of a small and compact machine.

According to one advantageous example embodiment, the step of intermittently operating the forming mould to apply a forming pressure onto the cellulose blank structure, comprises the step of operating the forming mould in a horizontal pressing stroke.

This has the advantage of a small and compact machine, especially together with vertically fed cellulose blank structure.

According to one advantageous example embodiment, the method comprises a step of cutting out the cellulose product from the cellulose blank structure in and/or after the forming mould, thereby forming a residual cellulose fibre structure of the remaining cellulose blank structure, and feeding the material of the residual cellulose fibre structure to the mill as a complement to the flow of cellulose-based material.

According to one example embodiment, the method comprises the step of providing a first tissue layer onto one side of the cellulose blank structure, wherein the first tissue layer preferably comprises a barrier chemistry composition, hereinafter called BCC.

According to one example embodiment, the method comprises the step of providing a second tissue layer to one side of the cellulose blank structure, wherein the second tissue layer preferably comprises a barrier chemistry composition, BCC.

According to one example embodiment, the barrier chemistry composition is provided to the first and/or second tissue layer during production and/or the step of providing the barrier chemistry composition to the first and/or second tissue layer by providing the barrier chemistry composition before production.

One advantage with pre-prepared tissue, is that the pre-prepared tissue has a controlled and specific amount of BCC that makes it easy to calculate the amount of BCC in the end product by the controlling the material ratio in the mill and/or in the forming hood. Another advantage is that a pre-prepared tissue removes the need for a BCC spray unit and thus removes cost and the need for maintenance of the spray box.

According to one example, the first tissue can be positioned on one side of the cellulose web structure and the second tissue can be on the opposite side of the cellulose web structure. This has the advantage that the product can be designed with one type of tissue layer on one side, e.g. an inside of a product, and another type of tissue layer on the other side, e.g. the outside, giving the product two sides with different properties. It should however be noted that the same type of tissue can be used as the first and the second tissue, giving similar properties on both sides of the product. Furthermore, the first and second tissue can be applied on the same side and if suitable, a third or more tissue can be applied on the same or the opposing side.

The use of a tissue added to the cellulose web structure has the further advantage that the BCC in the recycled residual cellulose fibre structure is mixed with the defibrated cellulose-based material in the mill giving the cellulose web structure an amount of BCC embedded in the structure, but also a tissue layer forming an outer layer of the product that can have a higher amount of BCC giving a higher degree of barrier properties than the core without exceeding the maximum amount BCC in the end product. The higher amount of BCC in the outer barrier layer gives a first barrier property that hinders a liquid from penetrating the barrier layer, but the BCC in the core of the product, i.e. in the part of the product essentially made from the cellulose web structure, gives further barrier properties also if the liquid penetrates the outer barrier that hinders disintegration of the core of the product.

It should be noted that when adding a first and/or second tissue to the cellulose web structure, then reference to feeding, forming, cutting and curing of the cellulose web structure relates to the entire composition of cellulose web structure and added tissue(s).

It should be noted that the first and/or second tissue layers can be free from BCC.

According to one example embodiment, the step of providing the cellulose blank structure to a forming mould comprise the step of heating the cellulose blank structure to a forming temperature in the range of 100° C. to 300° C. at least in the mould, and forming the cellulose product from the cellulose blank structure in the forming mould, by pressing the heated cellulose blank structure with a forming pressure of at least 1 MPa, preferably 4-20 MPa, and cutting out the cellulose product in and/or after the forming mould from the cellulose blank structure forming a residual cellulose fibre structure of the remaining cellulose blank structure that can be fed back to the mill.

According to one example, the residual cellulose fibre structure is recycled by feeding the material of the residual cellulose fibre structure to the mill as a complement to the cellulose-based material.

According one example embodiment, the step of feeding the material of residual cellulose fibre structure to the mill comprises feeding the residual cellulose fibre structure directly to the mill, i.e. without further defibration, via a transport unit.

One advantage here is that only one mill, i.e. the mill, can be used for the entire operation thereby reducing cost and maintenance. A calendaring apparatus can be used to hard compact the recycled residual fibre structure, which has shown to give a good defibration. It should be noted that a calendaring apparatus in connection to the second opening of the forming hood can be to give an improved transporting ability of the cellulose blank structure.

According to one example embodiment, the method comprises the step of providing a barrier chemistry composition to the cellulose-based material before production and/or in production.

According to one example embodiment, the step of air-forming comprises the step of feeding the conveyer belt vertically such that the fibres are fed to the conveyer belt horizontally.

The invention further relates to a cellulose product machine, also called Scala in the description, for performing the method according to any one of the preceding claims, wherein the machine is configured to form an air-formed cellulose blank structure for producing the cellulose product, wherein the machine comprises a first transport unit, a mill, a forming hood, a conveyer belt, a suction box, a second transport unit and a forming mould, wherein the first transport unit is configured to

- provide a flow of cellulose-based material to the mill, wherein the mill is configured to defibrate the cellulose-based material into cellulose fibres,
- wherein the forming hood comprises a first opening in fluid communication with and in connection to the mill and a second opening in fluid communication with and in connection to a first side of the conveyer belt,
- wherein the suction box is arranged in connection to a second side of the conveyer belt opposite the second opening of the forming hood, wherein the suction box comprises a fan that is connected to the suction box (104*b*) that creates an under-pressure generating a negative pressure gradient between the first side and the second side of the conveyer belt via through openings in the conveyer belt,
- wherein the forming hood is configured to provide an air-formed cellulose blank structure onto the conveyer belt,
- wherein the cellulose blank structure is air-formed from the cellulose fibres by the mill being configured to feed the cellulose fibres to the first opening in the forming hood,
- wherein the forming hood is configured to direct the cellulose fibres onto the first side of the conveyer belt via the second opening in the forming hood, wherein the second transport unit is configured to provide the cellulose blank structure to the forming mould (clamping unit) for forming the cellulose blank structure into a three dimensional cellulose product,
- wherein the forming mould is configured to intermittently operating the forming mould to apply a forming pressure onto the cellulose blank structure,
- wherein the conveyer belt is synchronized with the forming mould to intermittently form the cellulose blank structure simultaneously to the intermittent forming pressure of the forming mould or between two intermittent operations of the forming mould.

The advantage with the cellulose product machine is the same as described for the method above.

According to one example embodiment, the second transport unit is configured to provide the cellulose blank structure to the forming mould vertically.

According to one example embodiment, the forming mould is configured to operate in a horizontal pressing stroke.

According to one example embodiment, the conveyer belt is configured to run vertically such that the fibres are fed to the conveyer belt (111) horizontally.

All vertical operations have the advantage of a small and compact machine.

The overall objective with Scala is to enable rapid global scaling of Dry Moulded Fibre as a replacement for single use plastics by lower manufacturing cost, lowering $CO_2$ emissions, lowering energy and water consumption, reduce footprint, and enable serial production of a stand-alone plug-and-play machines in different sizes and performance.

Injection Moulding Machines (IMM) for moulding thermo plastics is serial produced in a global volume of over 100 000 machines per year. Except for the extruder, an IMM performs and operates similar to the presses used in Dry Moulded Fibre lines. Same range of press (clamping) forces, same range of cycle time, normally including force control, ejector, and heating of tools. Most IMM has horizontal pressing direction that enable lower machines heights compared to previous used horizontal steel presses.

According to one example, the step of providing BCC comprises the step of providing BCC to the cellulose-based material before production and/or in production.

According to one example, the step of providing BCC to the cellulose-based material before production comprises the step of pre-treating the cellulose material partly with BCC forming a sectioned cellulose-based material partly comprising BCC and/or where the step of providing BCC to the cellulose-based material in production comprises the step of providing BCC to selected parts of the cellulose material forming a sectioned base cellulose material partly comprising BCC.

It should be noted that pre-treatment refers to any type of addition of BCC to the cellulose-based material, but it is of utmost importance that the BCC is not dispersed in the cellulose-based material such that most or all of the fibres in the cellulose-based material is contaminated since this would jeopardize the possibility to form hydrogen bonds when forming the product. Hence, the BCC could be added to the cellulose-based material e.g. as an additional layer to the cellulose-based material and/or strands of BCC in the cellulose-based material, just as long as there is a significant portion of fibres not contaminated with BCC. The mill will defibrate all fibres and some of the fibres will have BCC attached, but at least a significant part of the fibres should be void of BCC such that a suitable blend/mix of fibres are air-formed into the cellulose blank. Should the process be arranged such that there will be no recycling of the residual cellulose fibre structure, then the amount of BCC in the cellulose-based material governs the amount of BCC in the end product unless one or more tissues with BCC are added to the cellulose blank structure. In the latter case, the total amount of BCC has to be calculated in order to not exceed the predetermined maximum value of BCC in the end product. For similar reasons, any addition of BCC in the process has to be taken into consideration.

According to one example, the step of providing BCC to the cellulose-based material in production can be realized by adding spray BCC to the cellulose-based material before the mill and/or an extra flow of cellulose-based material comprising BCC. If the process uses two or more flows of cellulose-based materials to the mill, then at least one of the flows can be void of BCC and one or more may comprise a large amount BCC since the mix of the flows in the mill gives an adequate mix of BCC treated fibres and fibres with no BCC attached. Should the process be arranged such that there will be no recycling of the residual cellulose fibre structure, then the amount of BCC in the cellulose-based material or materials governs the amount of BCC in the end product unless one or more tissues with BCC are added to the cellulose blank structure. In the latter case, the total amount of BCC has to be calculated in order to not exceed the predetermined maximum value of BCC in the end product. For similar reasons, any addition of BCC in the process has to be taken into consideration.

According to one example, the cellulose-based material is pre-treated partly with BCC, which has the advantage of removing the need for spray BCC. The BCC in the cellulose-based material will be part of the cellulose blank structure and can be recycled with the residual cellulose fibre structure, either via a second mill or directly to the mill according to the above. The recycled BCC in the recycled residual cellulose fibre structure together with the BCC in the cellulose-based material has to be controlled and the amount of cellulose-based material is controlled dependent on amount of recycled residual cellulose fibre structure, especially during the transient period. According to another example, the cellulosed-based material is treated with spray BCC before the mill, which has the advantage of controlling the BCC dependent on amount of recycled residual cellulose fibre structure, at least in the transient period.

BRIEF DESCRIPTION OF DRAWINGS

The disclosure regarding the machine hereinafter called Scala will be described in detail in the following, with reference to the attached drawings, in which FIG. 1 schematically shows, Scala with covers from Front/Left, FIG. 2 schematically shows, Scala with covers from Back/Right, FIG. 3 schematically shows, Product Plundering Alternatives, FIG. 4*a* schematically shows, Main measurement of a top view, FIG. 4*b* schematically shows, Main measurement of a front view, FIG. 4*c* schematically shows, Main measurement of a side view, FIG. 5 schematically shows, High-Way Product Examples, FIG. 6 schematically shows, Machine Consumables Supply & Load, FIG. 7 schematically shows, Operator's Interfaces in Running Mode, FIG. 8 schematically shows, Lids, doors and tiltable items, FIG. 9 schematically shows, Access openings seen from front, FIG. 10 schematically shows, Access openings seen from back, FIG. 11 schematically shows, Machine Supply Inlets, FIG. 12*a* schematically shows, Main Architecture with Sub-Systems FIG. 12*b* schematically shows, Functional Flow Chart of FIG. 12*a*, FIG. 13 schematically shows, Schematic Functional Overview with Motor Names, FIG. 14 schematically shows, Schematic Diagram Scala Nomenclature (Examples Only), FIG. 15 schematically shows, Physical sub-assemblies of Scala, FIG. 16 schematically shows, Scala Sub-Systems; seen from Front View, FIG. 17 schematically shows, Scala Sub-Systems; seen from Rear-Right View, FIG. 18 schematically shows, Mill-to-Web (1) Sub-Units; Front-Right View, FIG. 19 schematically shows, Mill-to-Web Sub-Units; Back-Right View, FIG. 20*a* schematically shows, Saw Tooth Mill Subunit (1:2)—Main Components Closed, FIG. 20*b* schematically shows, Saw Tooth Mill Subunit (1:2)—Main Components Opened, FIG. 21 schematically shows, Schematic Illustration of Saw Tooth Mill, FIG. 22 schematically shows, Web Forming Subunit-Main Components, FIG. 23 schematically shows, Stop-and-Go Operation of Web Forming and Moulding, FIG. 24 schematically shows, Stop-and-Go Operation of Web Forming and Moulding, FIG. 25 schematically shows, Web Forming Subunit seen from underneath-Main Components, FIG. 26 schematically shows, Web Forming Evenness between 9 samples in a 500×500 mm web, FIG. 27 schematically shows, Web Quality Sampling, FIG. 28 schematically shows, Tissue Sub-System (2)—Sub-Units, seen from Left-Front, FIG. 29 schematically shows, Tissue Sub-System (2)—Sub-Units, seen from Right-Back, FIG. 30 schematically shows, Tissue Feeding Assembly, FIG. 31 schematically shows, Tissue Feeding Assembly—Exploded View, FIG. 32 schematically shows, Manual Tissue Splicing, FIG. 33 schematically shows, The Moulding Sub-System—seen Front/Left, FIG. 34 schematically shows, The Clamping Unit Main Components-seen Back Left, FIG. 35*a* schematically shows, a side view of the Clamping Unit, FIG. 35*b* schematically shows, Force Characteristics (empirical measured) of the Clamping unit in FIG. 35A, FIG. 36 schematically shows, Feeder Sub-Unit—Web Feeder Shown closed, FIG. 37 schematically shows, two Feeder Sub-Units, FIG. 38 schematically shows, Feeder Sub-Unit—Web Feeder Shown closed, FIG. 39 schematically shows, Feeder Roller Assembly (Exploded view), FIG. 40 schematically shows, The Tool Sub-System in perspective with open Tools and Cut Web, FIG. 41 schematically shows, A Typical 9-cavity Tool Sub-System setup.

DESCRIPTION OF EXAMPLE EMBODIMENTS

Figure 1:
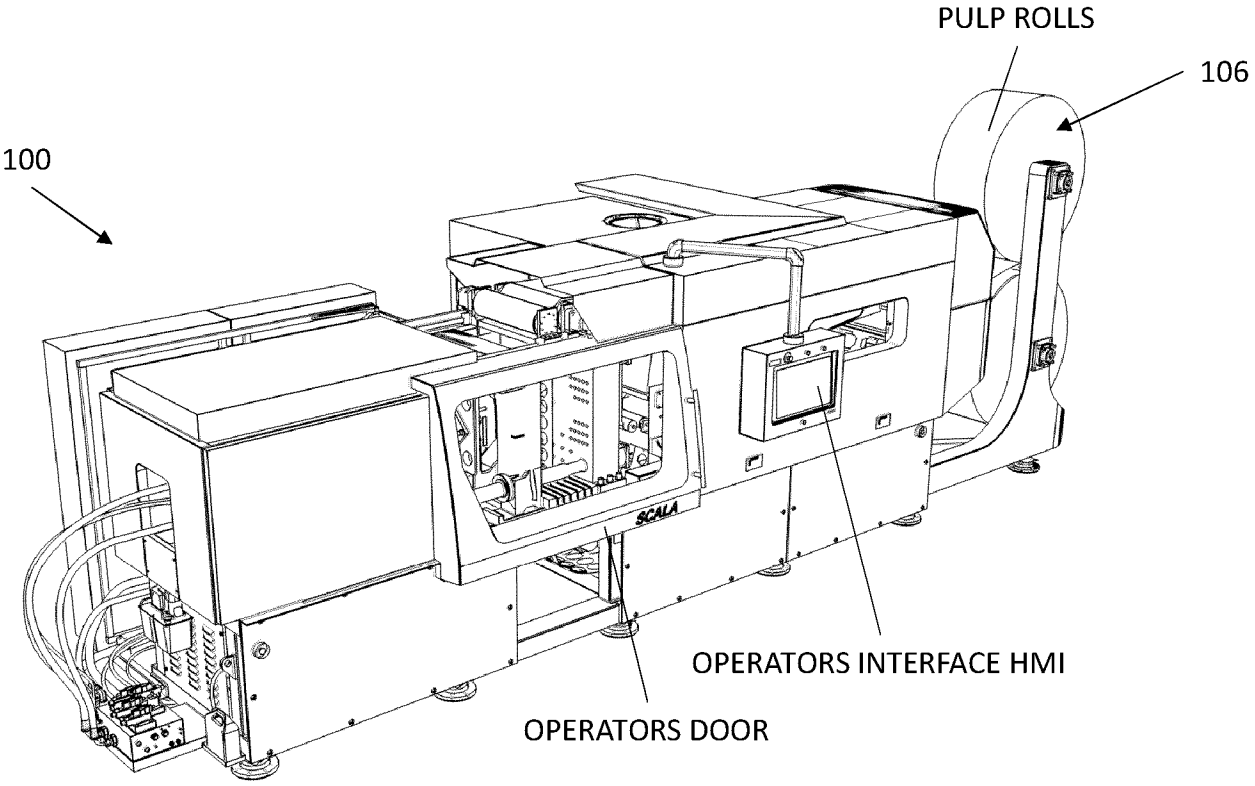

Various aspects of the disclosure will hereinafter be described in conjunction with the appended drawings to illustrate and not to limit the disclosure, wherein like designations in many cases are different for like elements, and variations of the described aspects are not restricted to the specifically shown embodiments, but are applicable on other variations of the disclosure.

The description below will refer to Scala as a collective name for a machine for producing a cellulose product according to the invention, where the machine will comprise a variety of parts that will be explained below and in connection to the drawings.

The invention relates to a method for forming an air-formed cellulose blank structure 102 for producing a cellulose product 101, which is shown in various aspects in FIGS. 1-51, wherein the method comprises the steps;

providing a flow of cellulose-based material 106 to a mill 104, defibrating the cellulose-based material 106 in the mill 104 into cellulose fibres, providing an air-formed cellulose blank structure 102, wherein the cellulose blank structure 102 is air-formed from the cellulose fibres, wherein the step of air-forming comprises the step of feeding the cellulose fibres to a first opening 104*a*1 in a forming hood 104*a*, wherein the cellulose fibres are directed onto a first side 112 of a conveyer belt 111 by the forming hood 104*a* via a second opening 104*a*2 in the forming hood 104*a*, wherein a suction box 104*b* is arranged in connection to a second side 112*b* of the conveyer belt 111 opposite the second opening 104*a*2 of the forming hood 104*a*, wherein the suction box 104*b* comprises a fan 104*b*1 that is connected to the suction box 104*b* that creates an under-pressure generating a negative pressure gradient between the first side 112 and the second side 112*b* of the conveyer belt 111 via through openings in the conveyer belt 111 for forming the cellulose blank structure 102 from the cellulose fibres directed onto the first side 112 of the conveyer belt 111, providing the cellulose blank structure 102 to a forming mould 105 (also called clamping unit) for forming the cellulose blank structure 102 into a three dimensional cellulose product 101, intermittently operating the forming mould 105 to apply a forming pressure onto the cellulose blank structure 102, synchronizing the conveyer belt 111 to intermittently form the cellulose blank structure 102 simultaneously to the intermittent operation of the forming mould 105.

One advantage with the method is that the synchronization allows for a compact machine with high control of all process steps. In a stationary mode, the conveyor belt is arranged in a standstill state such that the cellulose blank structure is formed on an at least partly non-moving conveyor belt. Here, it should be understood that the cellulose blank structure can be formed onto the conveyer belt only when the conveyer belt is in a standstill, or alternatively is formed when the conveyer belt moves into the standstill and during the standstill, or alternatively is formed during the standstill and when the conveyer belt moves from the standstill, or alternatively is formed when the conveyer belt moves into the standstill and during the standstill and when the conveyer belt moves from the standstill. In yet another example, the cellulose blank structure can be formed onto the conveyer belt only when the conveyer belt is moving, i.e. synchronized with the forming mould to allow forming of the cellulose blank structure between two pressing operations. The duration of the standstill state is synchronized with the duration of the pressing operation such that the standstill state is occurring during the pressing operation. The conveyor belt may be arranged in the standstill state at any time during pressing operation, and the time duration of the standstill state may be only a part of the time duration of the pressing operation, or alternatively the full pressing operation. I.e., the conveyor belt is synchronized to intermittently be in a standstill state during parts of or the whole of the application of a forming pressure onto the cellulose blank structure in the forming mould. The conveyor belt is advantageously an air permeable forming wire configured in a position close to the suction box on one side and the web forming on the opposite side. The suction box creates an under-pressure on the forming wire that creates an airstream in a direction towards the suction box, such that that the fibres are formed into the cellulose blank structure onto the forming wire.

According to one advantageous example, the step of providing the cellulose blank structure 102 to a forming mould 105 comprises the step of feeding the cellulose blank structure 102 essentially vertically.

This has the advantage of a small and compact machine.

According to one advantageous example embodiment, the step of intermittently operating the forming mould 105 to apply a forming pressure onto the cellulose blank structure 102, comprises the step of operating the forming mould 105 in a horizontal pressing stroke.

This has the advantage of a small and compact machine, especially together with vertically fed cellulose blank structure.

According to one advantageous example embodiment, the method comprises a step of cutting out the cellulose product 101 from the cellulose blank structure 102 in and/or after the forming mould 105, thereby forming a residual cellulose fibre structure 110 of the remaining cellulose blank structure 102, and feeding the material of the residual cellulose fibre structure 110 to the mill 104 as a complement to the flow of cellulose-based material 106.

According to one example embodiment, the method comprises the step of providing a first tissue layer 106*a* onto one side 102*a* of the cellulose blank structure 102, wherein the first tissue layer 106*a* comprises a barrier chemistry composition.

According to one example embodiment, the method comprises the step of providing a second tissue layer 106*b* to one side 102*b* of the cellulose blank structure 102, wherein the second tissue layer 106*b* comprises a barrier chemistry composition.

According to one example embodiment, the barrier chemistry composition is provided to the first and/or second tissue layer during production and/or the step of providing the barrier chemistry composition to the first and/or second tissue layer by providing the barrier chemistry composition before production.

According to one example embodiment, the method comprises the step of step of providing a barrier chemistry composition to the cellulose-based material 106 before production and/or in production.

According to one example embodiment, the step of air-forming comprises the step of feeding the conveyer belt 111 vertically such that the fibres are fed to the conveyer belt 111 horizontally.

The invention further relates to a cellulose product 101 machine 100, also called Scala in the description, which is shown in various aspects in FIGS. 1-51. The Machine 100 is configured for performing the method according to any one of the preceding claims, wherein the machine 100 is configured to form an air-formed cellulose blank structure 102 for producing the cellulose product 101, wherein the machine comprises a first transport unit 103, a mill 104, a forming hood 104*a*, a conveyer belt 111, a suction box 104*b*, a second transport unit 109 and a forming mould 105, wherein the first transport unit 103 is configured to provide a flow of cellulose-based material 106 to the mill 104*a*, wherein the mill 104*a* is configured to defibrate the cellulose-based material 106 into cellulose fibres, wherein the forming hood 104*a* comprises a first opening 104*a*1 in fluid communication with and in connection to the mill 104*a* and a second opening 104*a*2 in fluid communication with and in connection to a first side 112 of the conveyer belt 111, wherein the suction box 104*b* is arranged in connection to a second side 112*b* of the conveyer belt 111 opposite the second opening 104*a*2 of the forming hood 104*a*, wherein the suction box 104*b* comprises a fan 104*b*1 that is connected to the suction box 104*b* that creates an under-pressure generating a negative pressure gradient between the first side 112 and the second side 112*b* of the conveyer belt 111 via through openings in the conveyer belt 111, wherein the forming hood 104*a* is configured to provide an air-formed cellulose blank structure 102 onto the conveyer belt 111, wherein the cellulose blank structure 102 is air-formed from the cellulose fibres by the mill 104 being configured to feed the cellulose fibres to the first opening 104*a*1 in the forming hood 104*a*, wherein the forming hood 104*a* is configured to direct the cellulose fibres onto the first side 112 of the conveyer belt 111 via the second opening 104*a*2 in the forming hood 104*a*, wherein the second transport unit 109 is configured to provide the cellulose blank structure 102 to the forming mould 105, also called clamping unit, for forming the cellulose blank structure 102 into a three dimensional cellulose product 101, wherein the forming mould 105 is configured to intermittently operating the forming mould to apply a forming pressure onto the cellulose blank structure 102, wherein the conveyer belt 111 is synchronized with the forming mould 105 to intermittently form the cellulose blank structure 102 simultaneously to the intermittent forming pressure of the forming mould 105.

In a stationary mode, the conveyor belt is arranged in a standstill state such that the cellulose blank structure is formed on an at least partly non-moving conveyor belt. Here, it should be understood that the cellulose blank structure can be formed onto the conveyer belt only when the conveyer belt is in a standstill, or alternatively is formed when the conveyer belt moves into the standstill and during the standstill, or alternatively is formed during the standstill and when the conveyer belt moves from the standstill, or alternatively is formed when the conveyer belt moves into the standstill and during the standstill and when the conveyer belt moves from the standstill. In yet another example, the cellulose blank structure can be formed onto the conveyer belt only when the conveyer belt is moving, i.e. synchronized with the forming mould to allow forming of the cellulose blank structure between two pressing operations. The duration of the standstill state is synchronized with the duration of the pressing operation such that the standstill state is occurring during the pressing operation. The conveyor belt may be arranged in the standstill state at any time during pressing operation, and the time duration of the standstill state may be only a part of the time duration of the pressing operation, or alternatively the full pressing operation. I.e., the conveyor belt is synchronized to intermittently be in a standstill state during parts of or the whole of the application of a forming pressure onto the cellulose blank structure in the forming mould. The conveyor belt is advantageously an air permeable forming wire configured in a position close to the suction box on one side and the web forming on the opposite side. The suction box creates an under-pressure on the forming wire that creates an airstream in a direction towards the suction box, such that that the fibres are formed into the cellulose blank structure onto the forming wire.

According to one example embodiment, the second transport unit 109 is configured to provide the cellulose blank structure 102 to the forming mould vertically.

According to one example embodiment, the forming mould 105 is configured to operate in a horizontal pressing stroke.

According to one example embodiment, the conveyer belt 111 is configured to run vertically such that the fibres are fed to the conveyer belt 111 horizontally.

The above will be further described in connection to FIGS. 1-51 with also other designations than above. The designations are shown within brackets, and in tables as positions and items for clear references.

TABLE OF CONTENT 1.0 MACHINE MAIN DESCRIPTION
1.1 Machine Main Data
1.2 Machine Supply Interface
1.3 Human Interface (HMI)
1.4 Maintenance & Service Access
2.0 MACHINE FUNCTIONAL DESCRIPTION
2.1 MILL-TO-WEB SUB-SYSTEM
2.1.1 SAW TOOTH SUB-UNIT
2.1.2 WEB FORMING SUB-UNIT 2.1.3 SUB-SYSTEM FUNCTIONAL REQUIREMENT SPECIFICATION
2.2 TISSUE SUB-SYSTEM
2.2.1 SUB-SYSTEM FUNCTIONAL REQUIREMENT SPECIFICATION
2.3 MOLDING SUB-SYSTEM
2.3.1 CLAMPING SUB-UNIT
2.3.2 FEEDER SUB-UNIT
2.3.3 TOOL SUB-UNIT
2.3.4 SUB-SYSTEM FUNCTIONAL REQUIREMENT SPECIFICATION
2.4 RECYCLING SUB-SYSTEM
2.4.1 SUB-SYSTEM FUNCTIONAL REQUIREMENT SPECIFICATION
2.5 COVER SUB-SYSTEM
3.0 HUMAN INTERFACE (HMI) (to be specified in later issues)
APPENDIX A: DATA SPECIFICATION MOTORS

1.0 Machine Main Description

Figure 2:
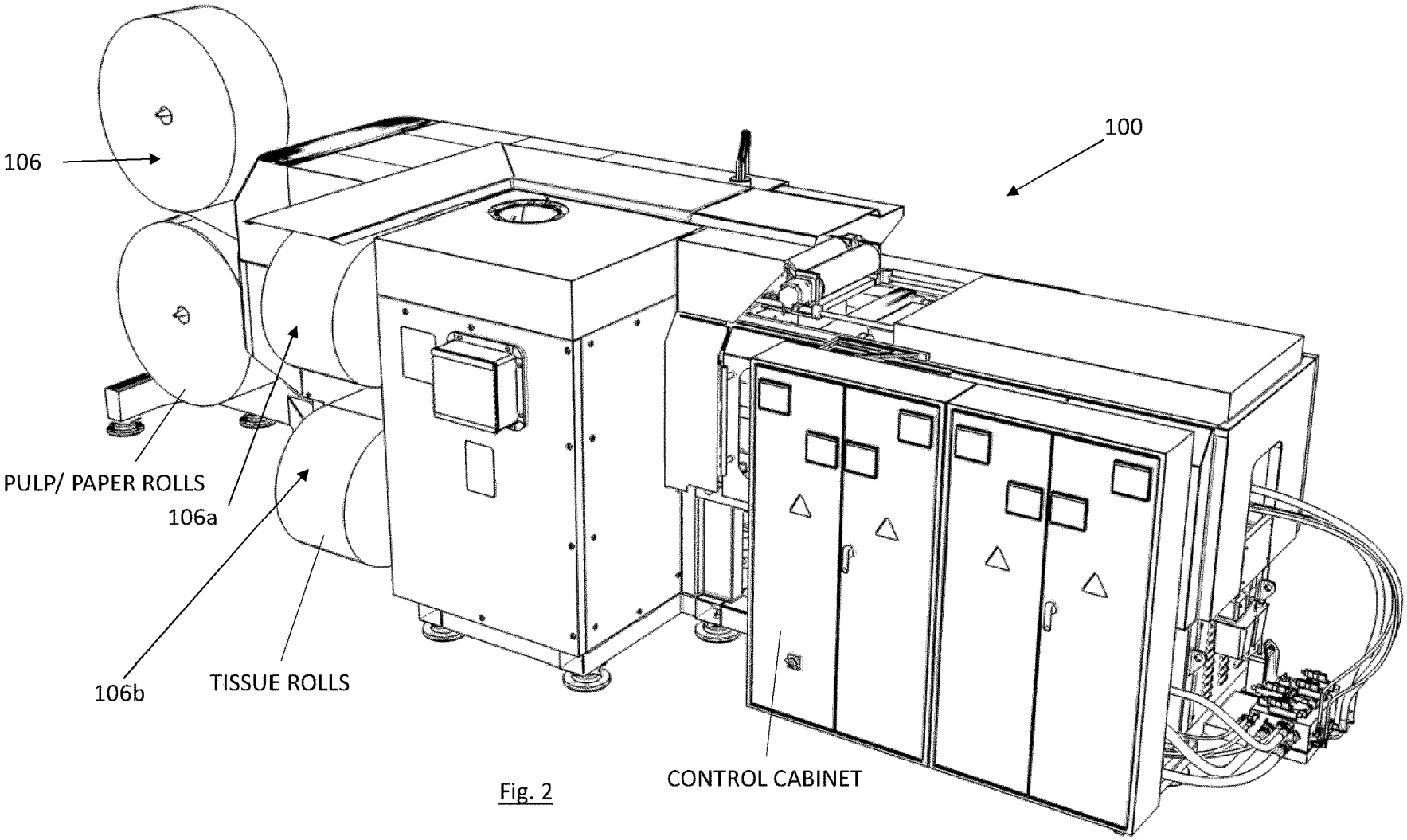

FIG. 1 schematically shows Scala with covers from Front/Left Scala is loaded with pulp and tissue as shown in FIGS. 1 & 2. Pulp Roll width 500 mm dia. 1.2m. Splicing is manually done by the rolls.

FIG. 2 schematically shows Scala with covers from Back/Right

Figure 3:
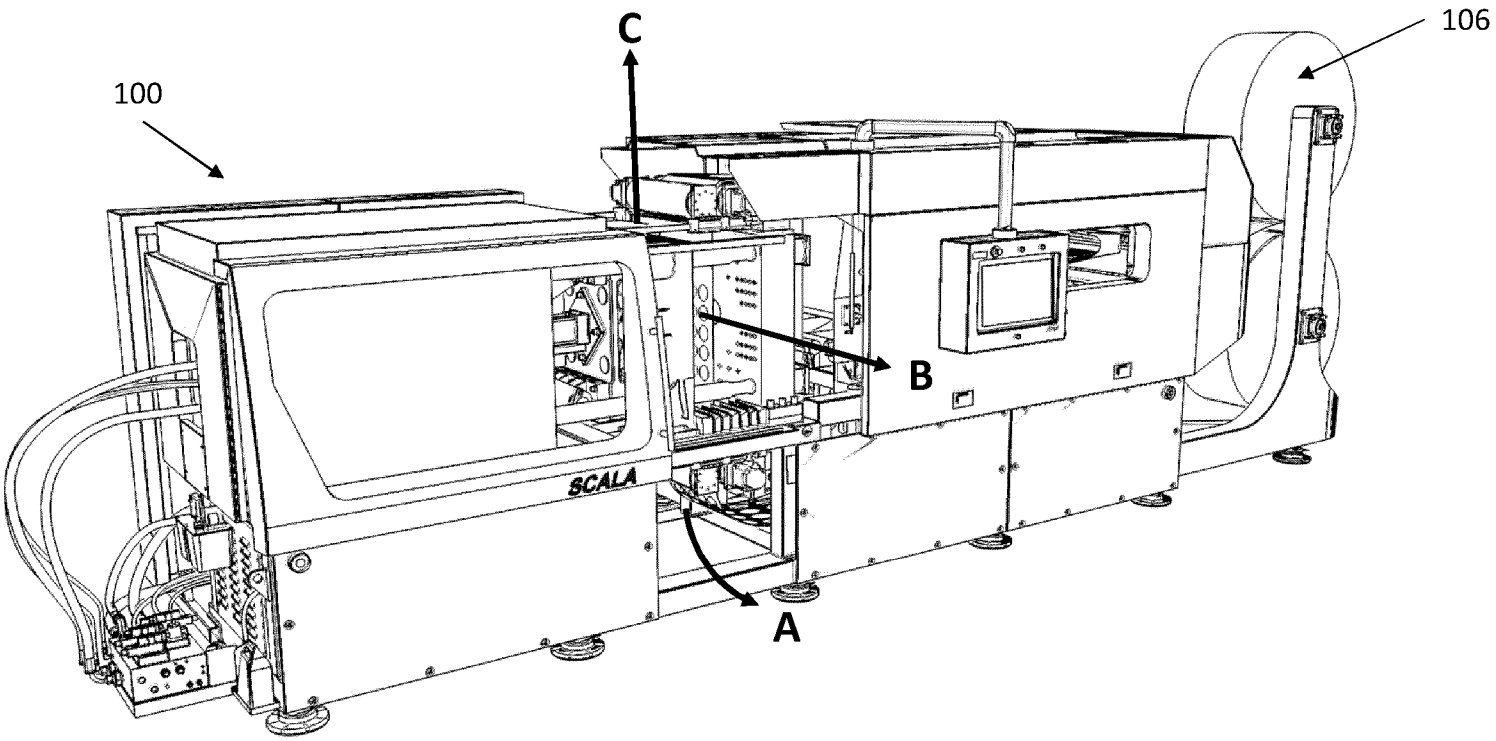

Plundering is performed in similar way as in an IMM, see FIG. 3

Random fall Out-Let A

Robot Pick-Out via door Out-Let B.

Robot Pick-Out Upwards C

FIG. 3 schematically shows Product Plundering Alternatives

Important functionality of the covers is to lower noise and protect operators from injuries. Access to the machinery for maintenance and service is also a functional requirement on the cover/housing design, see 1.4.

Scala should be approved and CE-marked for any sales within the European Economic Area (EEA).

1.1 Machine Main Data

Figure 4A:
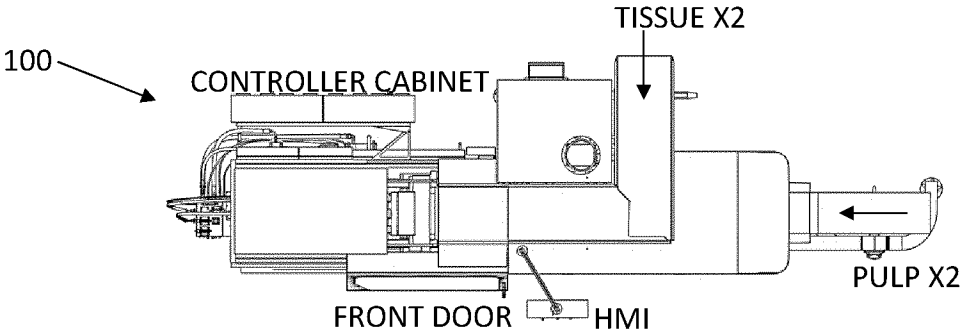
Figure 4C:
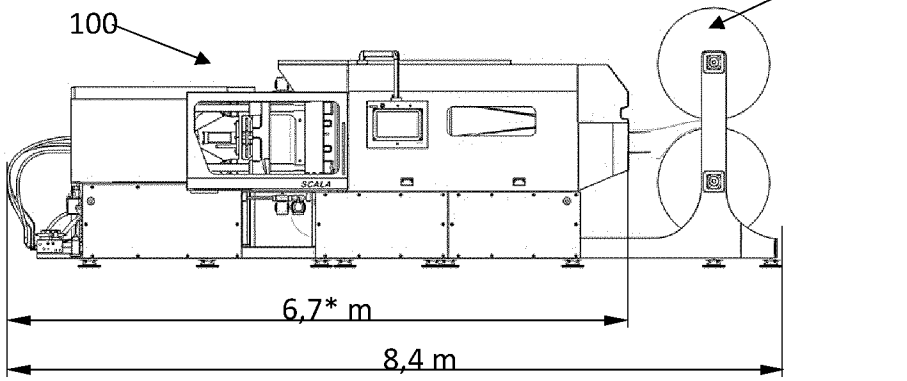
Figure 4B:
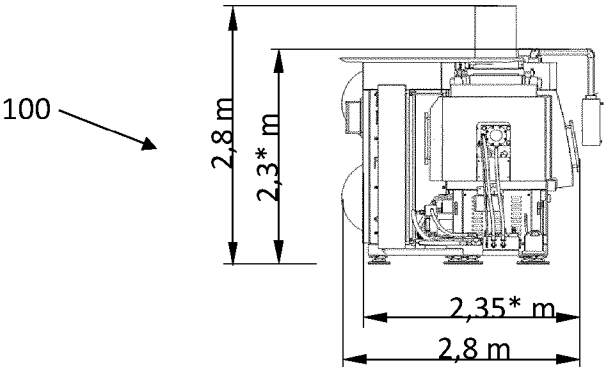

FIGS. 4*a*-4*c* schematically show Main measurement; Top view FIG. 4*a*, Front view FIG. 4*b* and side view FIG. 4*c*.

Machine weight, excluding Pulp and tissue equals ca 10 ton

Delivered partly de-mounted in a 40 ft Shipping Container (12.2×2.4×2.6 height m)

1.2 Machine Performance Data

| Max Pressure Force | kN | 2500 |
|---|---|---|
| Min Cycle time (at product eject A) | sec | 3 |
| Max Product Basis Weight (at 3 sec cycle time) | gsm | 1500 |
| Max Mill Capacity (Products + Recycling) | Kg/hrs. | 450 |
| Machine Internal Fibre recirculation | | YES |
| Max Fibre Waste (Vacuum Fan Out-Let to Filter) | % | 2 |
| Roll splicing; Pulp - every 3, 5-7 hours/roll. | Manual Load | Auto Roll Shift |
| Roll Splicing; Tissue - every 10-16 hours. | Manual | Req. Machine Stop |
| Max noise (with product covers) | Db | 80 |
| Tool Mounting Platen; see, FIG. 5 | mm | 815 × 815 |
| Distance between tie bars | mm | 555 |
| Mould Thickness | mm | 200-600 |
| Ejector | | Hydraulic or pneumatic |
| Product Capacity | | See table 1 |

Figure 5:
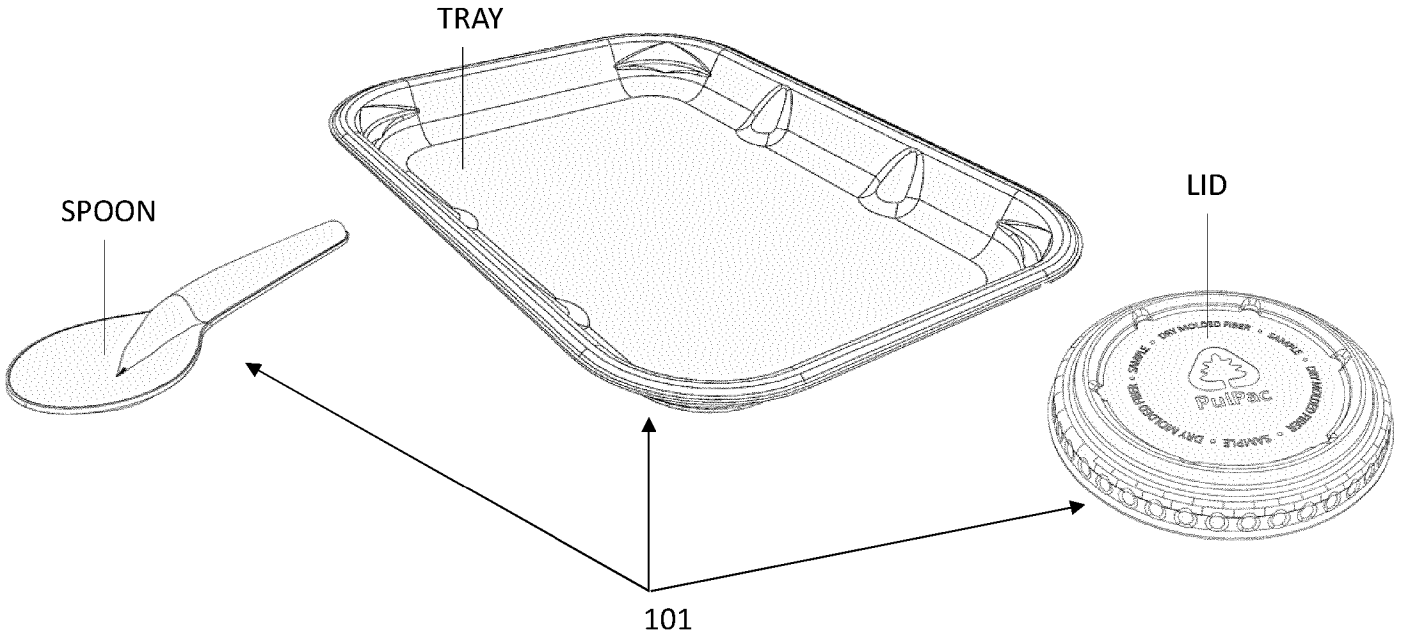

FIG. 5 schematically shows High-Way Product Examples, with a spoon to the left in the figure, a tray in the middle and a lid to the right.

TABLE 1

PRODUCT CAPACITY AT 12 MPA MOLD PRESSURE

| PRODUCT | SIZE ($cm^2$) | GSM | PRODUCT WEIGHT (g) | CYCLE TIME (sec) | No. CAVITIES | Pcs./Hrs. | Products kg/hrs. |
|---|---|---|---|---|---|---|---|
| Lid dia. 100 mm | 78.5 | 600 | 4.7 | 3 | 9 | 10800 | 51 |
| Spoons | 16 | 1400 | 3.8 | 3 | 18 | 21600 | 82 |
| Trays 200 × 150 mm | 300 | 700 | 21 | 3 | 4 | 4800 | 100 |

1.2 Machine Supply Interface

Figure 6:
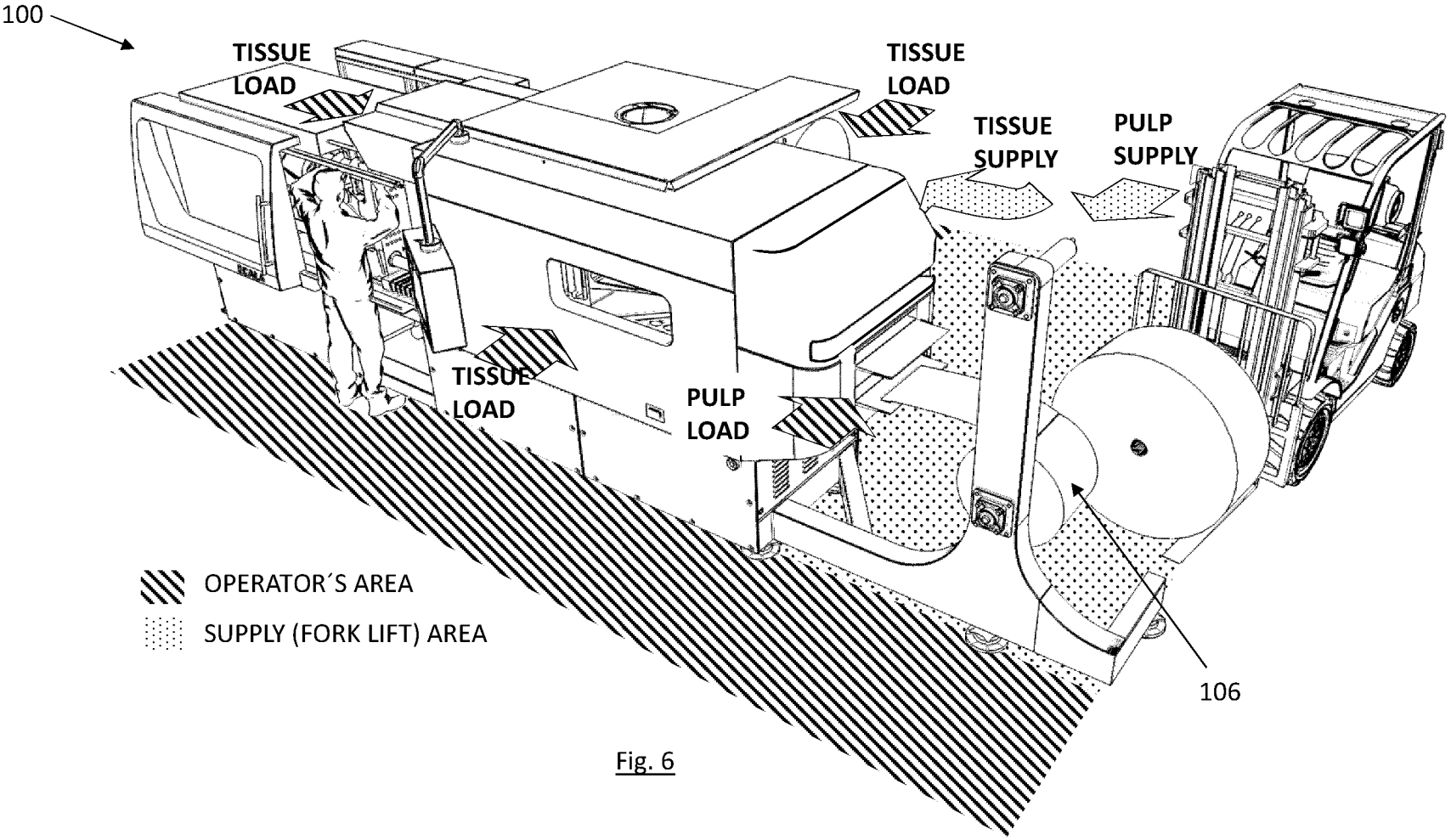

FIG. 6 schematically shows Machine Consumables Supply & Load

| | | |
|---|---|---|
| RATED POWER (3 × 400 V), excl. tool heating. Max | kW | 120 |
| Mill Motor x1; Max | kW | 30 |
| Fan Motor x1; Max | kW | 37 |
| Hydraulic Servo Motor x1; Max | kW | 34 |
| Servo Motors x12; Max | kW | 13 |
| Others; Max | | 8 |
| Compressed Air; 8 bar - oil free | l/hrs. | TBD |
| Water; Humidification; Max at dry air (RHD < 30%) | l/hrs. | 6 |
| Water; Hydraulic Oil cooler; Recycled cooling media recommended. Max 28 deg C. | l/min | 50 |
| RAW MATERIAL CONSUMABLES | | |
| Pulp e.g., Fluff Pulp 1.2 m dia. Rolls, 450 kg | hrs./roll | 4-8 |
| Tissue or Film e.g., 0.8 m dia. 29 gsm tissue | hrs./roll | 10 |

The machine ejects 5000 $m^3$/hrs. of air (containing max 2 kg fibres/hrs when using full capacity) from the Vacuum Fan outlet. A central dust filter is needed for one or several Scala.

1.3 Human Interface (HMI)

Figure 7:
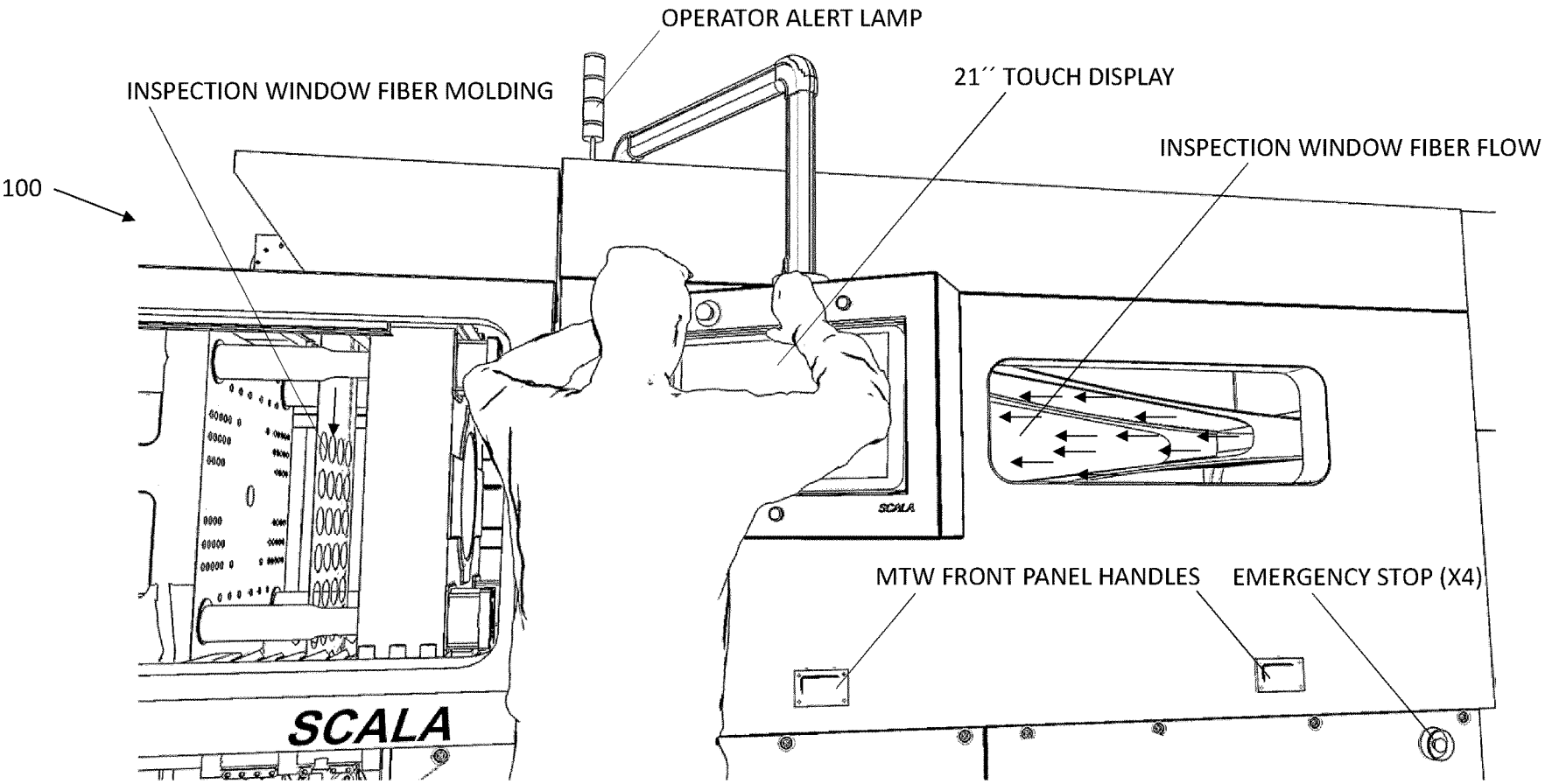

FIG. 7 schematically shows Operator's Interfaces in Running Mode

The Operators HMI comprises:

21" TFT-LCD Touch Screen Panel with iX runtime

4 Emergency Stop Buttons

Operator Alert Lamp Array on top of machine.

A Smart Phone App with Push Notices with call for attention and production overview.

IoT—with on-line support from Huarong and PulPac.

1.4 Maintenance & Service Access

Scala offers seven easy access openings for operators and service.

Figure 8:
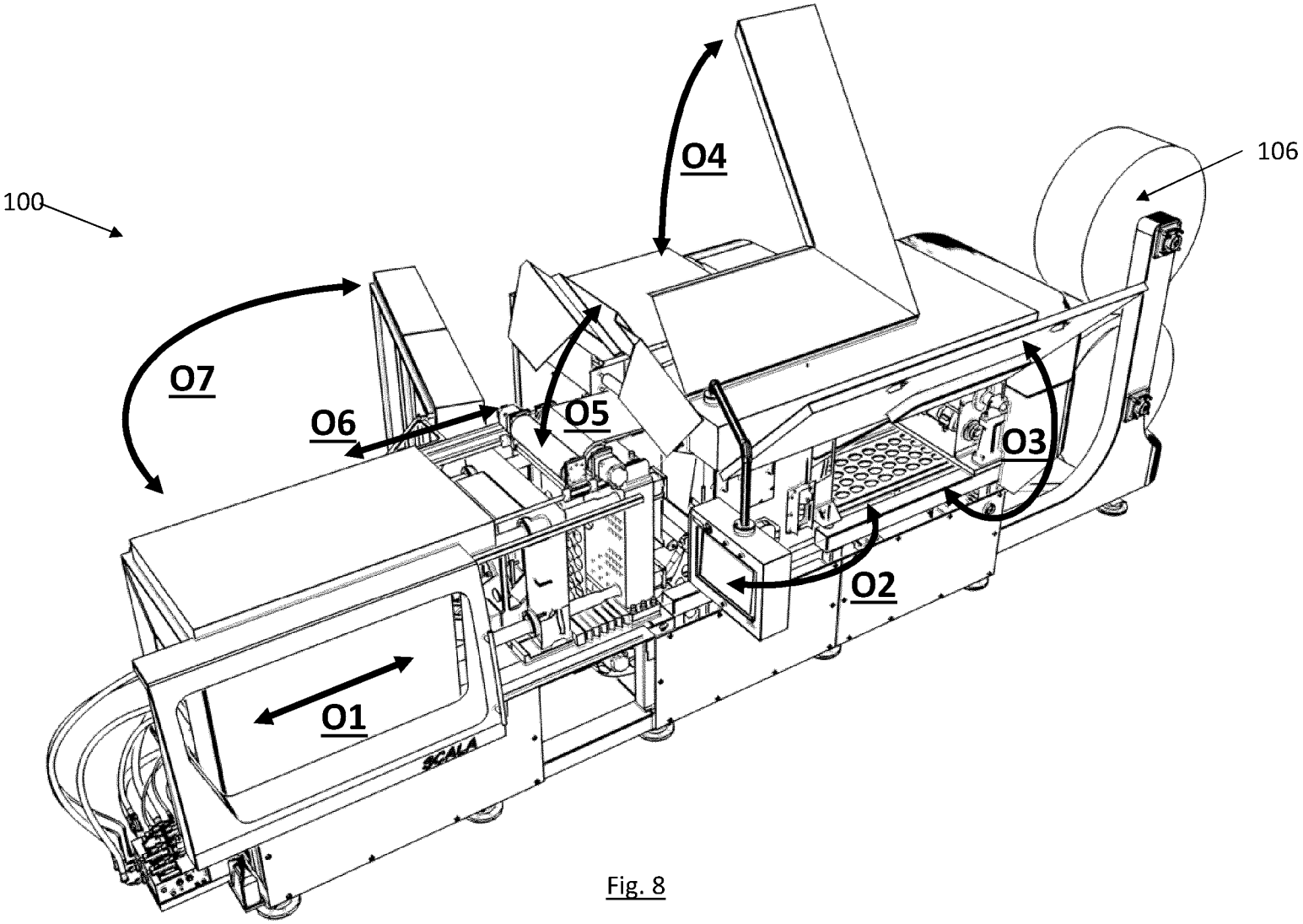

FIG. 8 schematically shows Lids, doors and tiltable items

| | | |
|---|---|---|
| O1 | Front Door Sliding | |
| O2 | HMI Folding | HMI Mounted on Swing Arm |
| O3 | MTW Front Panel Opening | Gas Springs Support |
| O4 | Upper Tissue Loading Roof Panel | Gas Springs Support |
| O5 | Top Feeder Lid | Gas Spring Support |
| O6 | Back Door Sliding | Original Huarong |
| O7 | Electric Cabinet Tilt/Swing Opening | Access to Clamping Unit Hydraulics |

Figure 9:
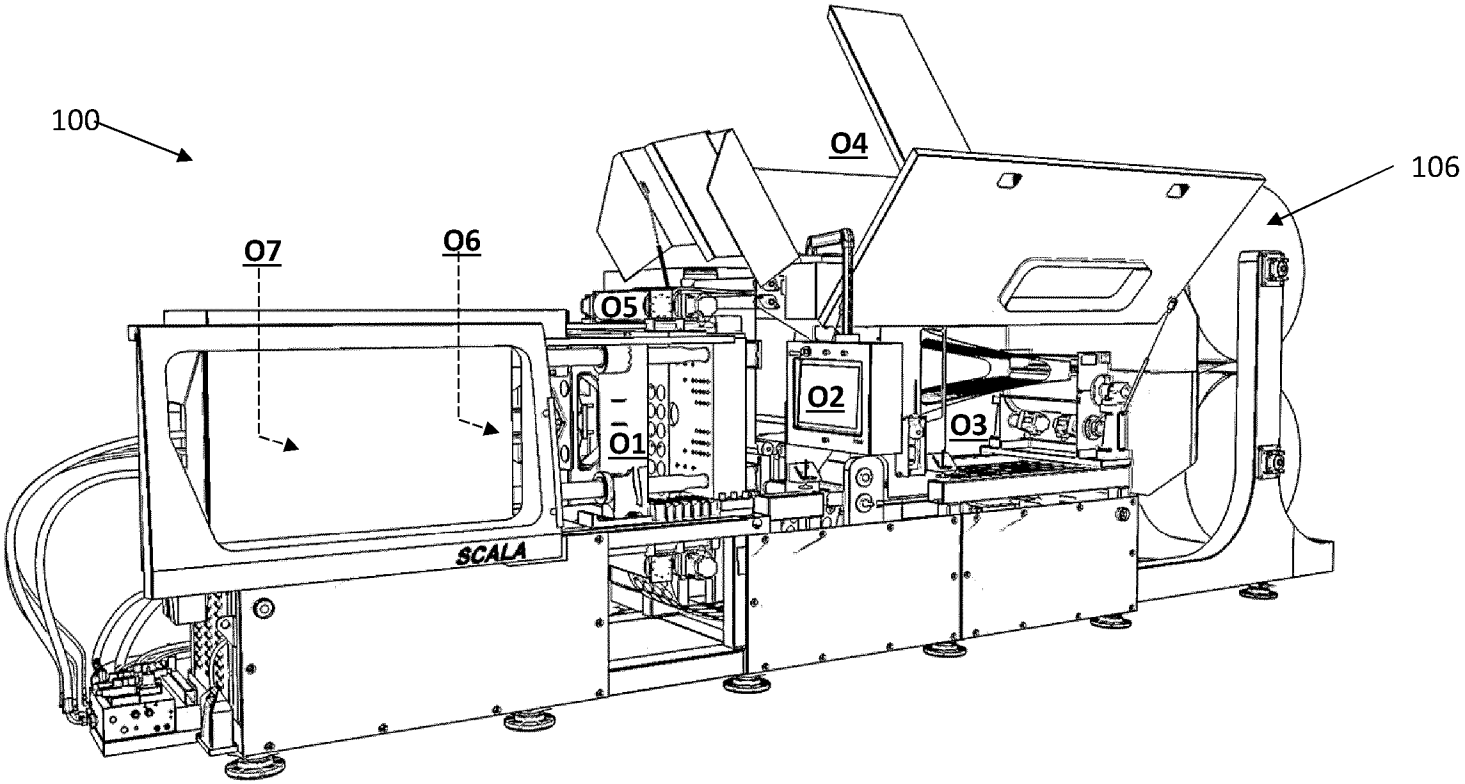

FIG. 9 schematically shows Access openings seen from front

Figure 10:
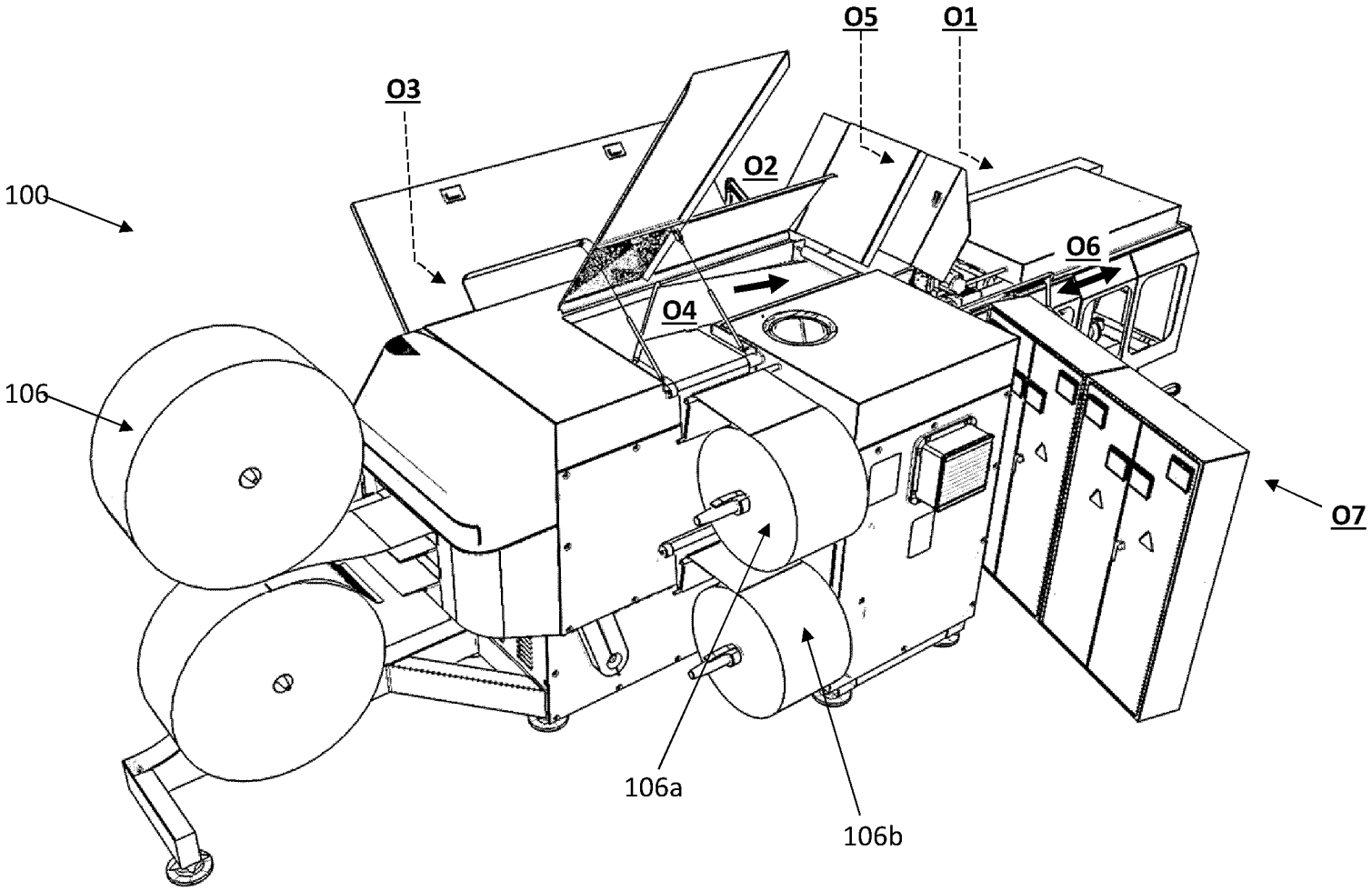

FIG. 10 schematically shows Access openings seen from back

For more access at service and maintenance cover panels can be detached, see chapter 2.5 Covers Sub-System.

Figure 11:
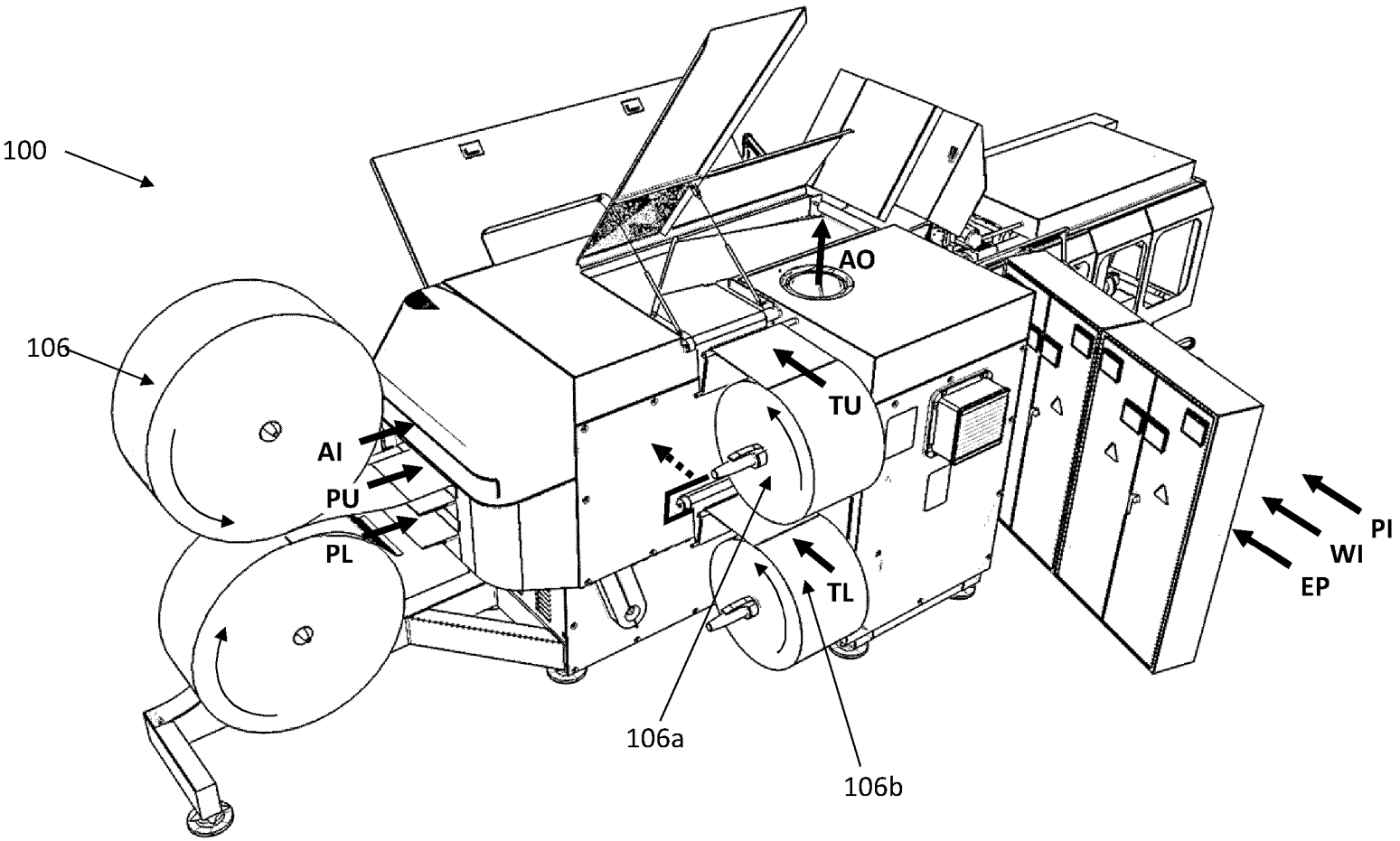

FIG. 11 schematically shows Machine Supply Inlets

| | | |
|---|---|---|
| AI | Air In | 5000 $m^3$/hrs. (RHD 30-90%) |
| AO | Air Out | To Filter; not supplied with machine; 5000 $m^3$/hrs. |
| PU | Pulp Upper (IN) | Manual Load/Automatic Splicing |
| PL | Pulp Lower (IN) | Manual Load/Automatic Splicing |
| TU | Tissue Upper (IN) | Manual Load & Splicing |
| TL | Tissue Lower (IN) | Manual Load & Splicing |
| EP | Electric Power (IN) | 120 kW (400 V 3-Phase) |
| WI | Water In | Min 4 bar |
| PI | Pneumatic Air In | Min 7 bar |

2.0 Machine Functional Description & Specification

Figure 12A:
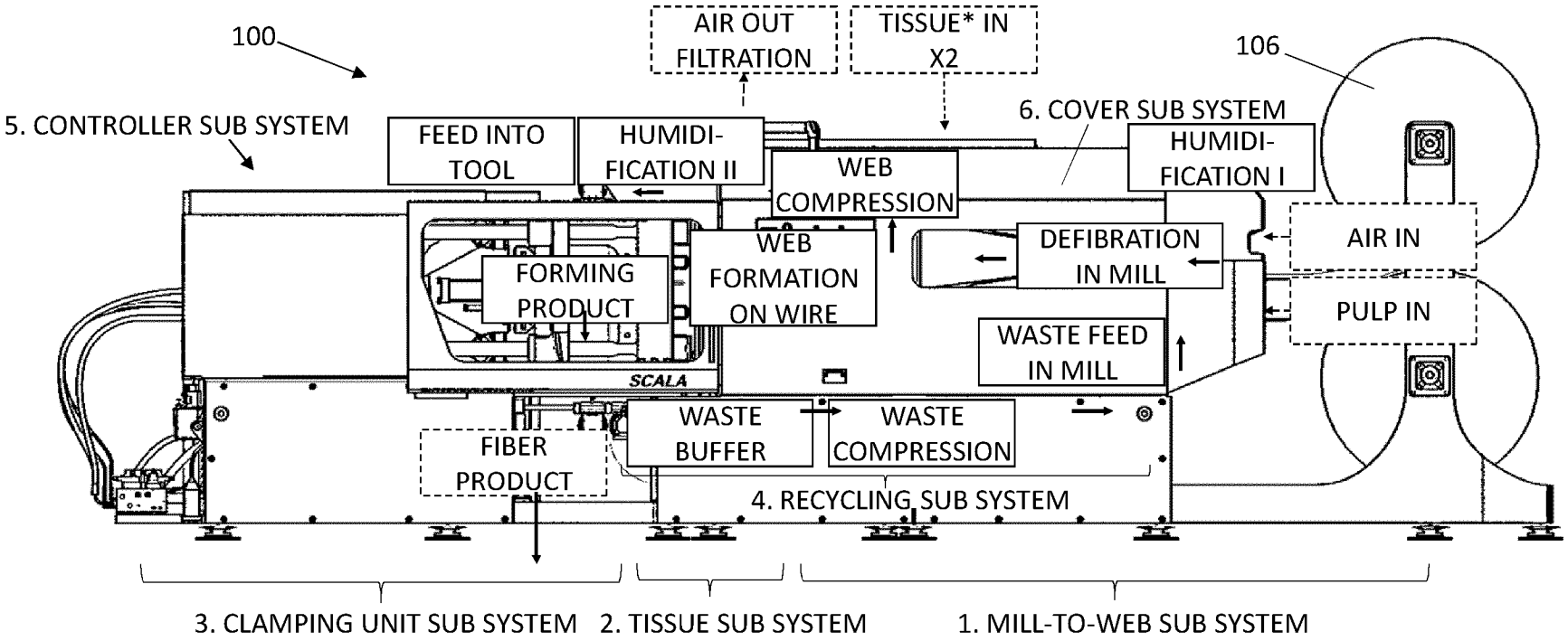
Figure 12B:
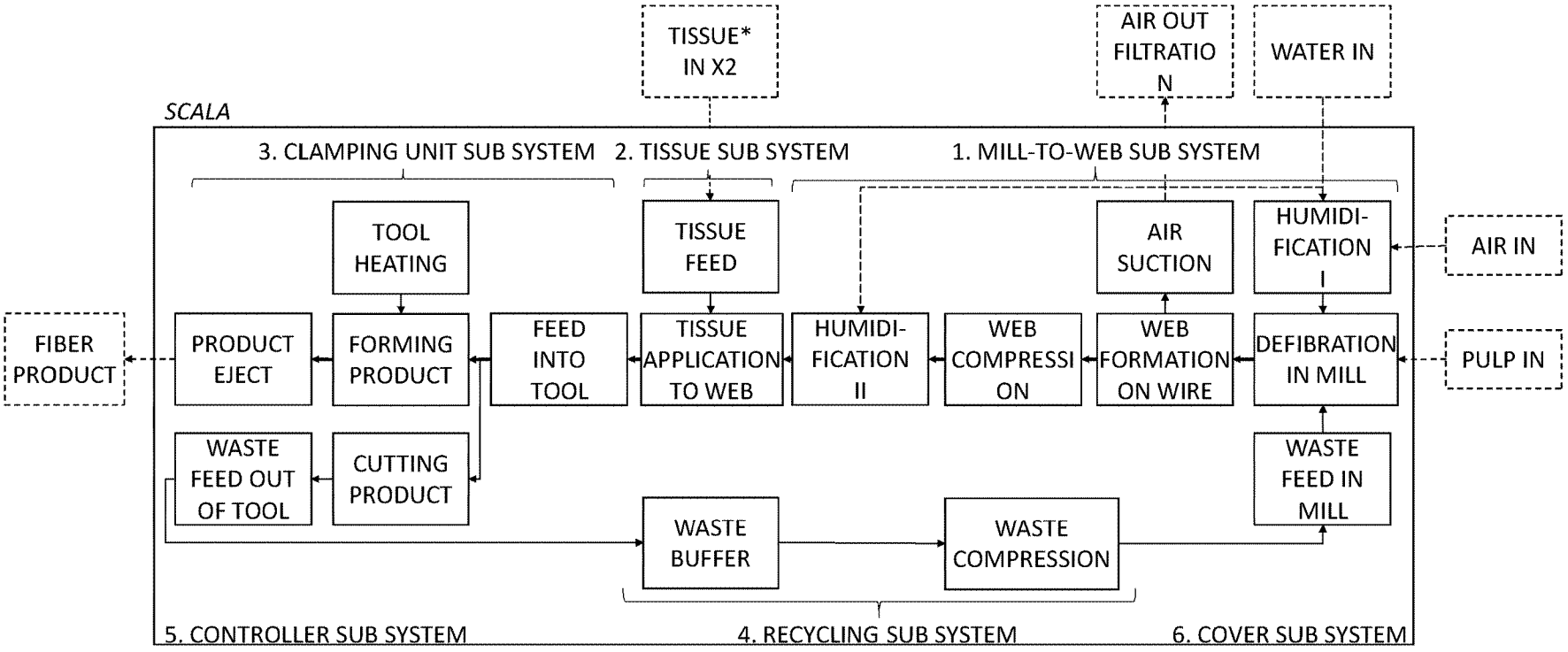
Figure 13:
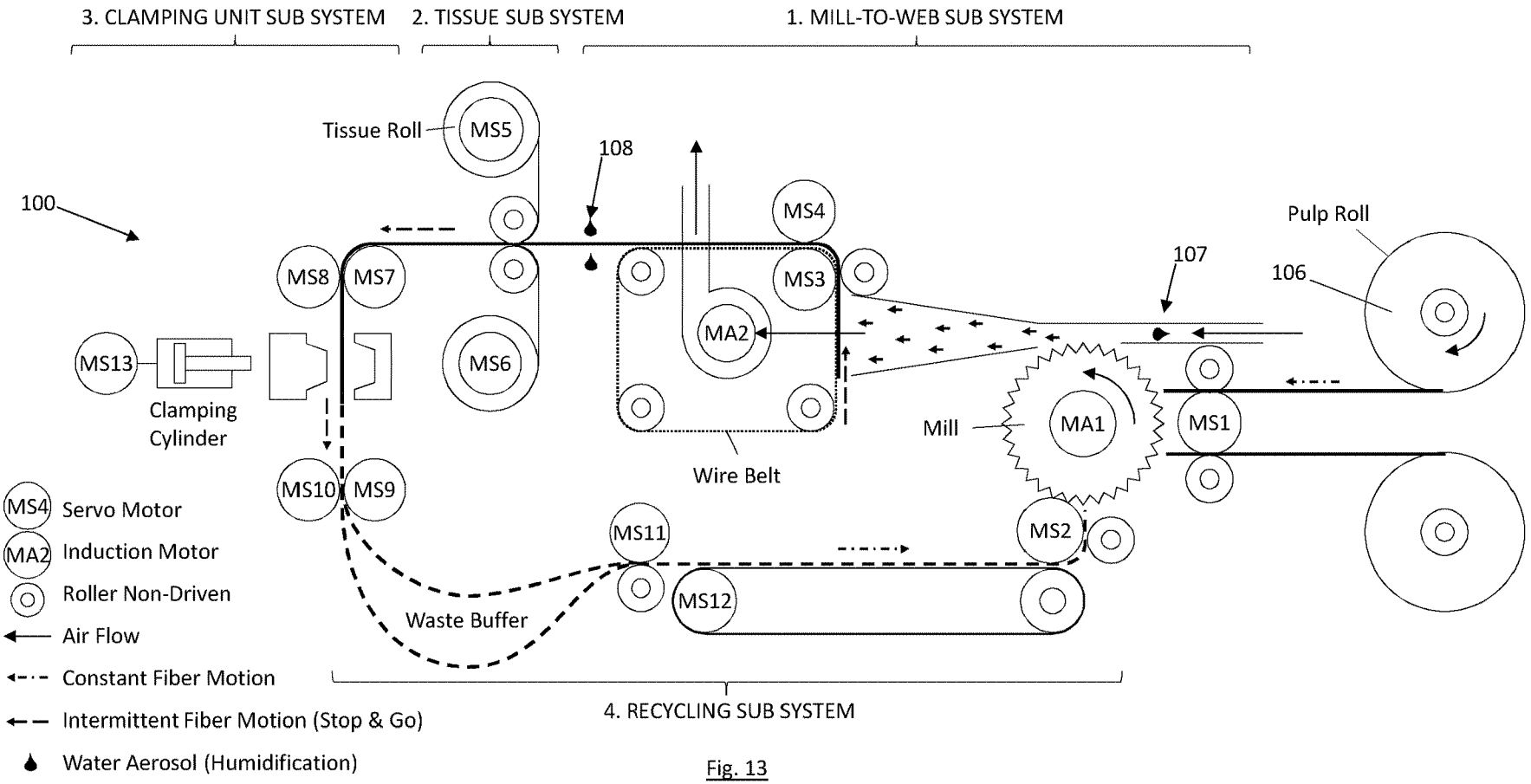

The operational functions, from Pulp In to finished Fibre Product, is described in the flowchart in FIGS. 12*a* and 12*b*. Six Sub Systems hosts these Functions as illustrated in FIG. 13. These Sub-Systems, Sub-Units and their Functions are described together with their functional requirement specification in this chapter.

FIGS. 12*a* and 12*b* schematically show Main Architecture with Sub-Systems, FIG. 12*a* and Functional Flow Chart FIG. 12*b*.

FIG. 13 schematically shows a Functional Overview with Motor Names

TABLE

LIST OF MOTORS; see enclosure A for more details.

| Motor | Function | Gear Ratio | kW |
|---|---|---|---|
| MS1 | Pulp sheet feeder | | 0.9 |
| MS2 | Waste web feeder (double belt in mill) | | 0.9 |
| MS3 | Wire Belt Drive | | 1.5 |

TABLE-continued

LIST OF MOTORS; see enclosure A for more details.

| Motor | Function | Gear Ratio | kW |
|---|---|---|---|
| MS4 | Web Compression | | 1.5 |
| MS5 | Upper Tissue Roll Drive | | 1.5 |
| MS6 | Lower Tissue Roll Drive | | 1.5 |
| MS7 | Feed Into Tool Roller 1 | | 0.9 |
| MS8 | Feed Into Tool Roller 2 | | 0.9 |
| MS9 | Waste Feed Out of Tool Roller 1 | | 0.9 |
| MS10 | Waste Feed Out of Tool Roller 2 | | 0.9 |
| MS11 | Waste Material Compression | | 1.5 |
| MS12 | Waste Transporter Belt | | 0.9 |
| MS13 | Hydraulic Pump Servo Motor | | 34 |
| MA1 | Mill Rotor (Frequency Converter Controlled) | | 30 |
| MA2 | Vacuum Fan (Frequency Converter Controlled) | | 37 |

Figure 14:
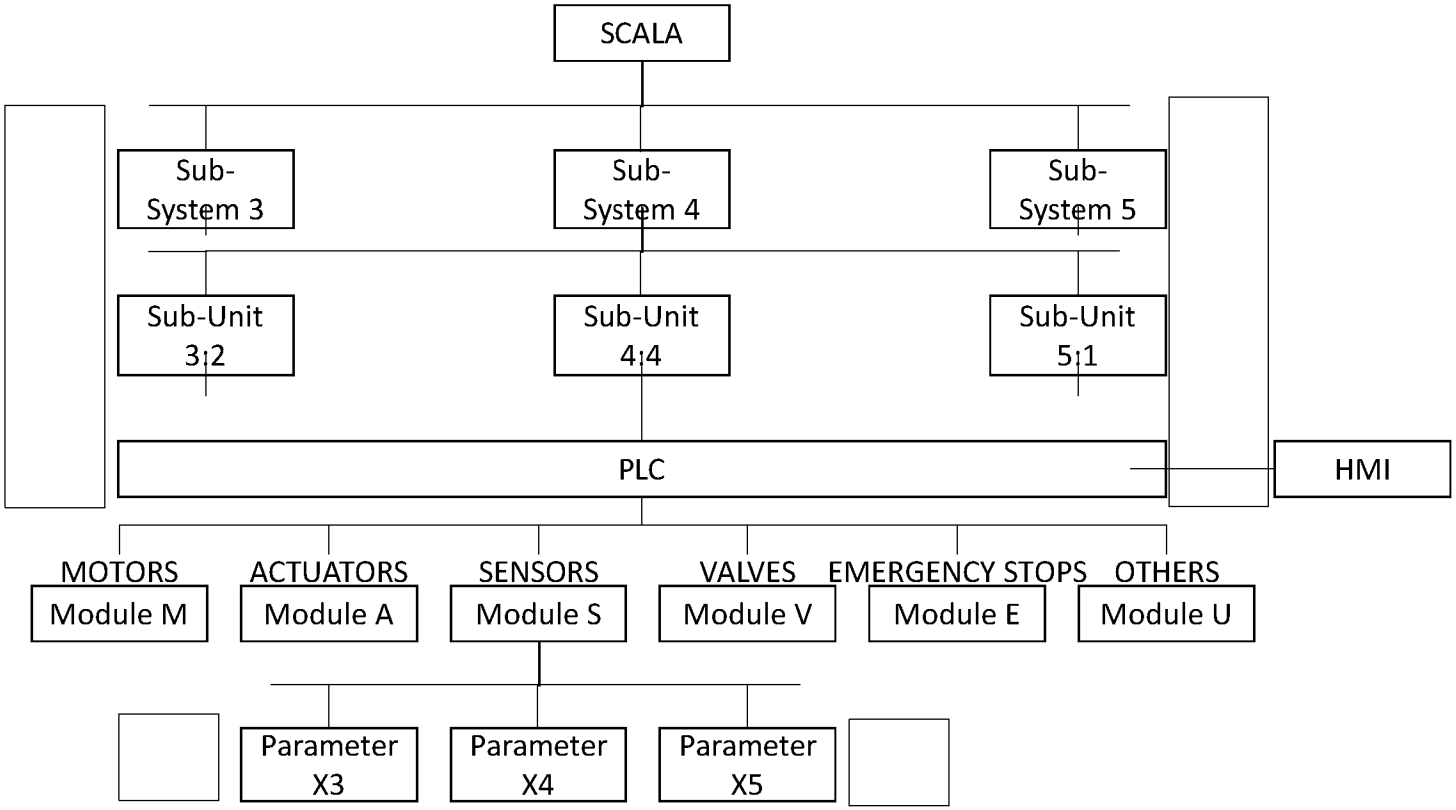

This document uses the following nomenclature shown in FIG. 14 when describing the Scala in a top-down structure:

FIG. 14 schematically shows a Diagram of Scala Nomenclature (Examples Only)

This Chapter of the Specification, introduces all Sub-Systems, their sub-ordinary Units, and all included Modules, controlled via the PLC.

However, Scala has five main physical sub-assemblies (except for the covers), that deviates from the Sub-Systems to some extent, i.e. the Vacuum Fan is mounted in the Tissue sub-assembly and the HMI is mounted on top of fibre supply sub-assembly in the MTW roof top cover. There is also a fibre sub assembly framework that hosts the Mill-to-Web Sub-System and the Recycling Sub-System, see FIG. 15.

In the following, this document will present and describe the Sub-Systems (i.e., without covers and without concern of sub assembly architecture).

Scala is design and manufactured as a versatile fibre moulding machine for any type of fibre product. However, the first Scalas will be sold with tooling for a specific fibre product and this document introduces the tool design as a part of the Clamping Unit Sub-System in chapter 2.3.

Figure 15:
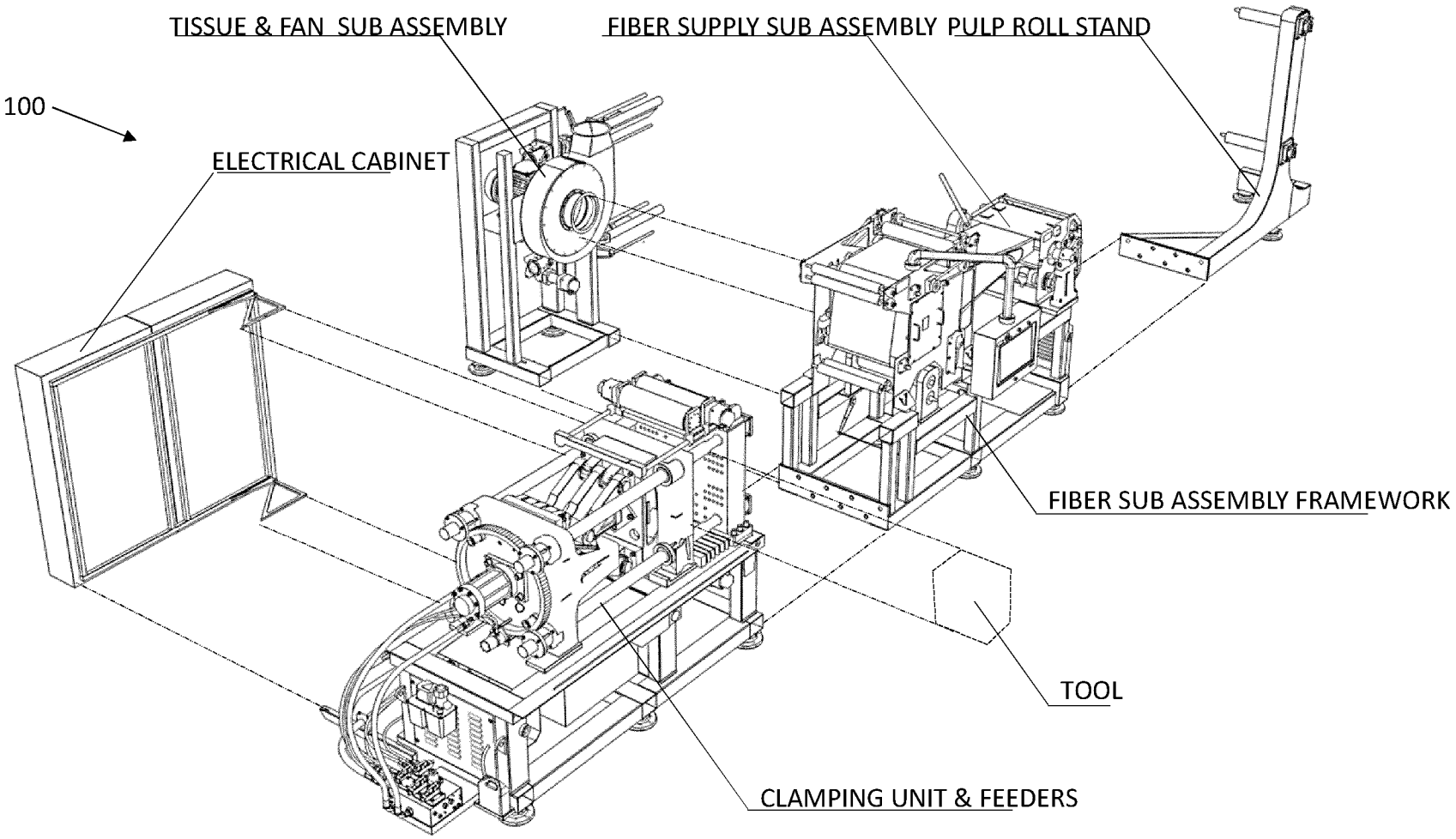

FIG. 15 schematically shows Physical sub-assemblies of Scala.

Figure 16:
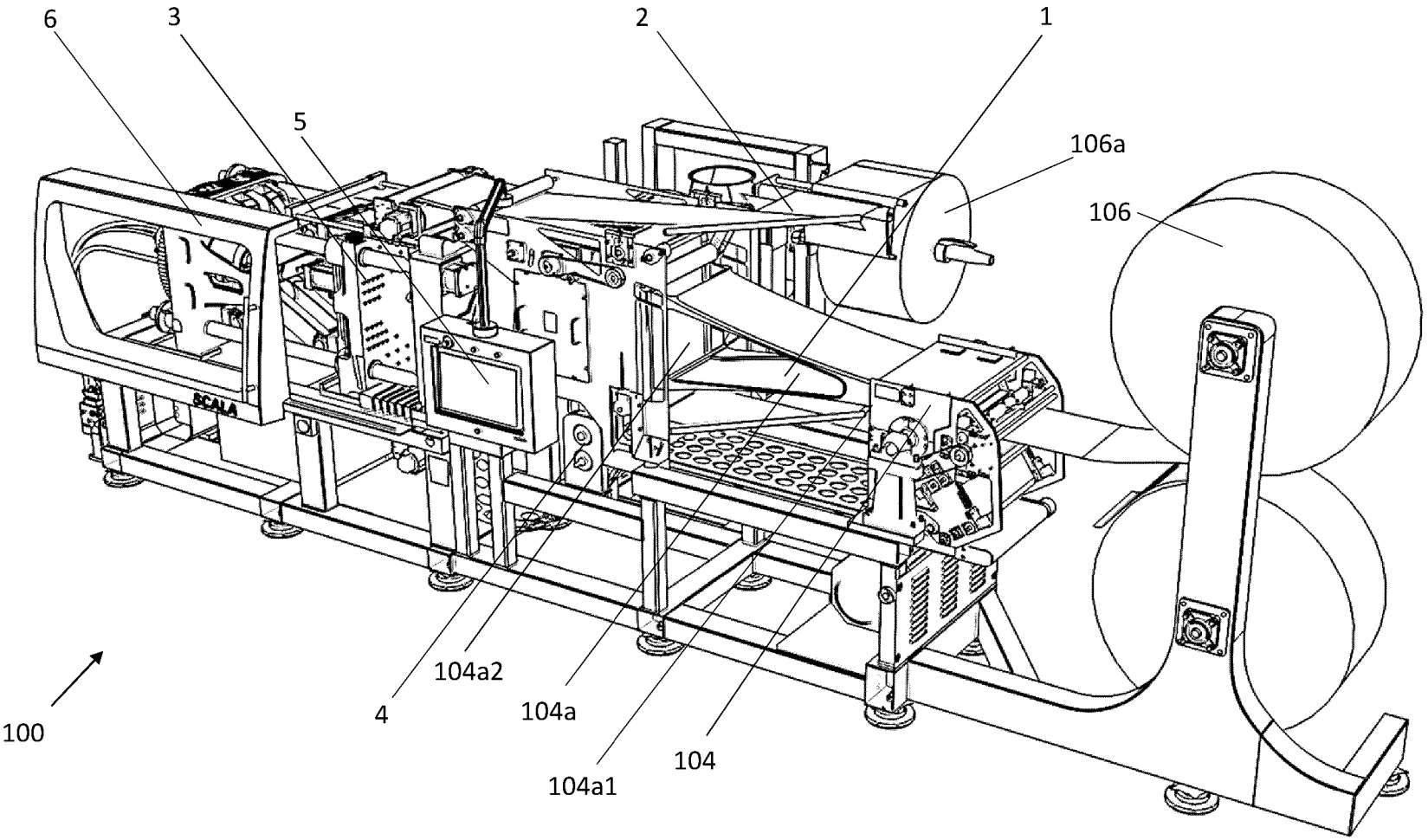
Figure 17:
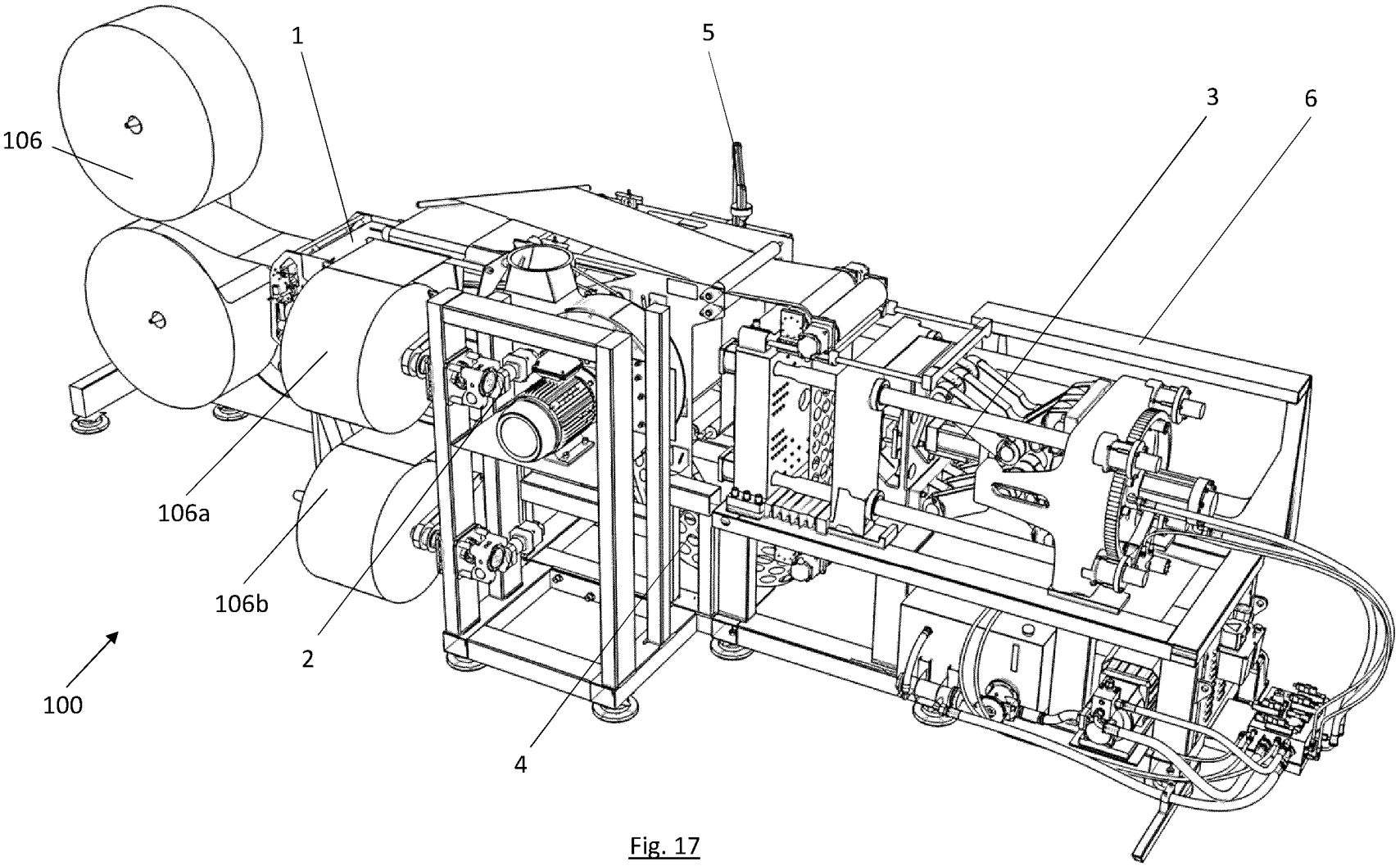

Scala comprises Six Sub-Systems:

1. Mill-to-Web Sub-System
2. Tissue Sub-System
3. Moulding Sub-System
4. Recycling Sub-System
5. Controller Sub-System
6. Covers Sub-System FIG. 16 schematically shows Scala Sub-Systems; seen from Front View FIG. 17 schematically shows Scala Sub-Systems; seen from Rear-Right View Each of these sub-systems, with its sub-units, will be described and specified in the following.

Each Module is named using the following nomenclature:

| CODE | MODULE TYPE | NOTE |
|---|---|---|
| MS | Servo Motor | |
| MA | Induction Motor | |
| AH | Actuator Hydraulic | e.g., cylinder |
| AP | Actuator Pneumatic | e.g., cylinder |
| SI | Sensor Digital | |
| SA | Sensor Analogue | |
| VH | Valve Hydraulic | |
| VP | Valve Pneumatic | |
| UO | Unit Other | |

2.1 Mill-to-Web Sub-System

Besides the Clamping Unit/Moulding Sub-System, the Mill-to-Web (MTW) constitutes the main sub-system of Scala. The MTW converts raw pulp (P: 1) into a fluffy loose fibre web and supply this material, as a pre-compacted web (P: 2) by and adding tissue on top and bottom in the kissing point (KP), before feed into the tool. The Saw tooth Mill (1:2) breaks up almost all hydrogen bonds in the pulp sheet (P: 1). A Vacuum Fan (1:5) draws/sucks all loose fibres through the Mill, via a Fibre Formation Hood 1:3 onto a moving wire using a vacuum suction box in the Web Forming Subunit (1:4).

Figure 18:
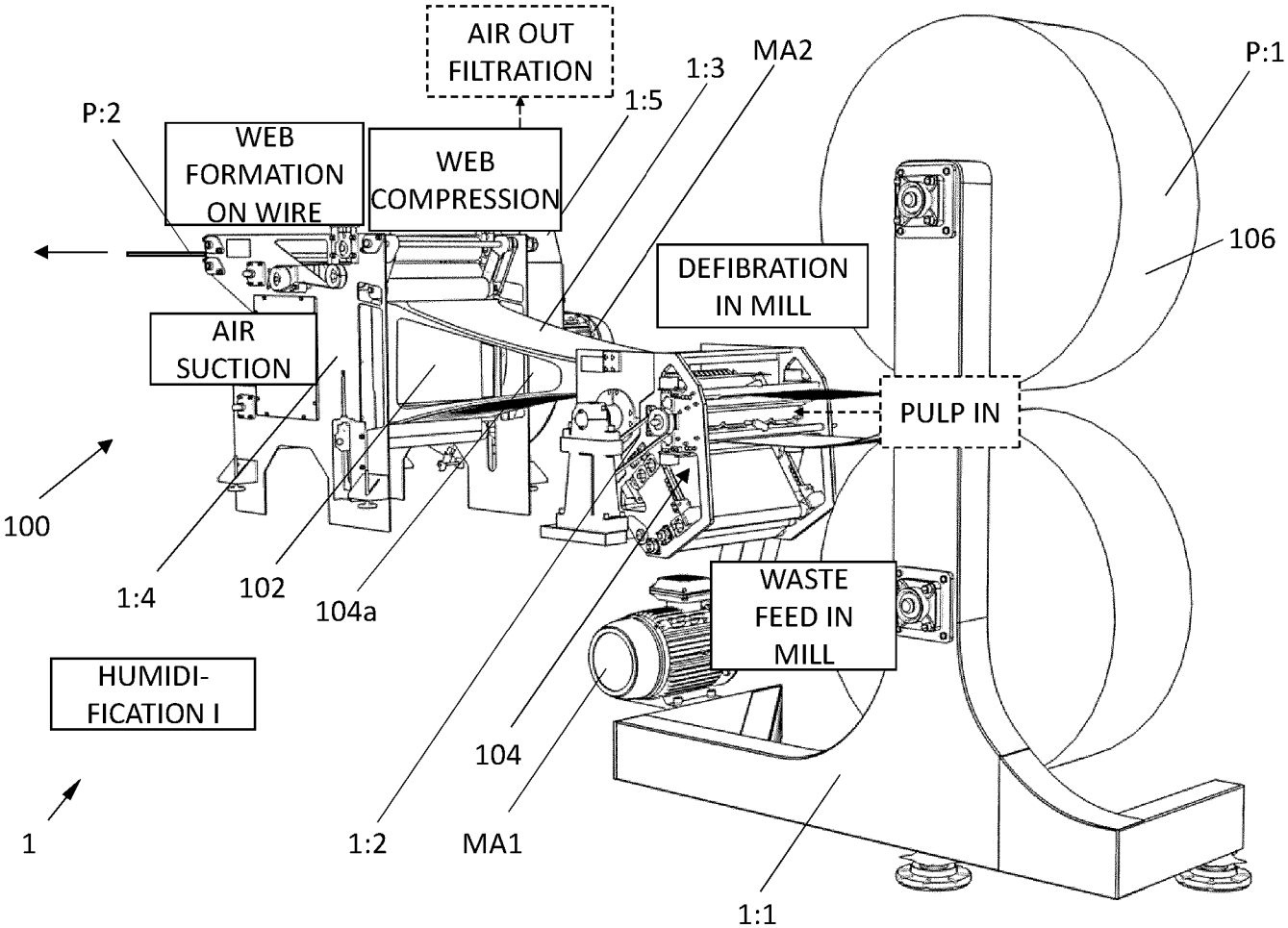

FIG. 18 schematically shows Mill-to-Web (1) Sub-Units; Front-Right View Humidification is optional by spray water aerosol either in the air inlet or the fibre web (P: 2) with nozzles (not shown in fig.).

Figure 19:
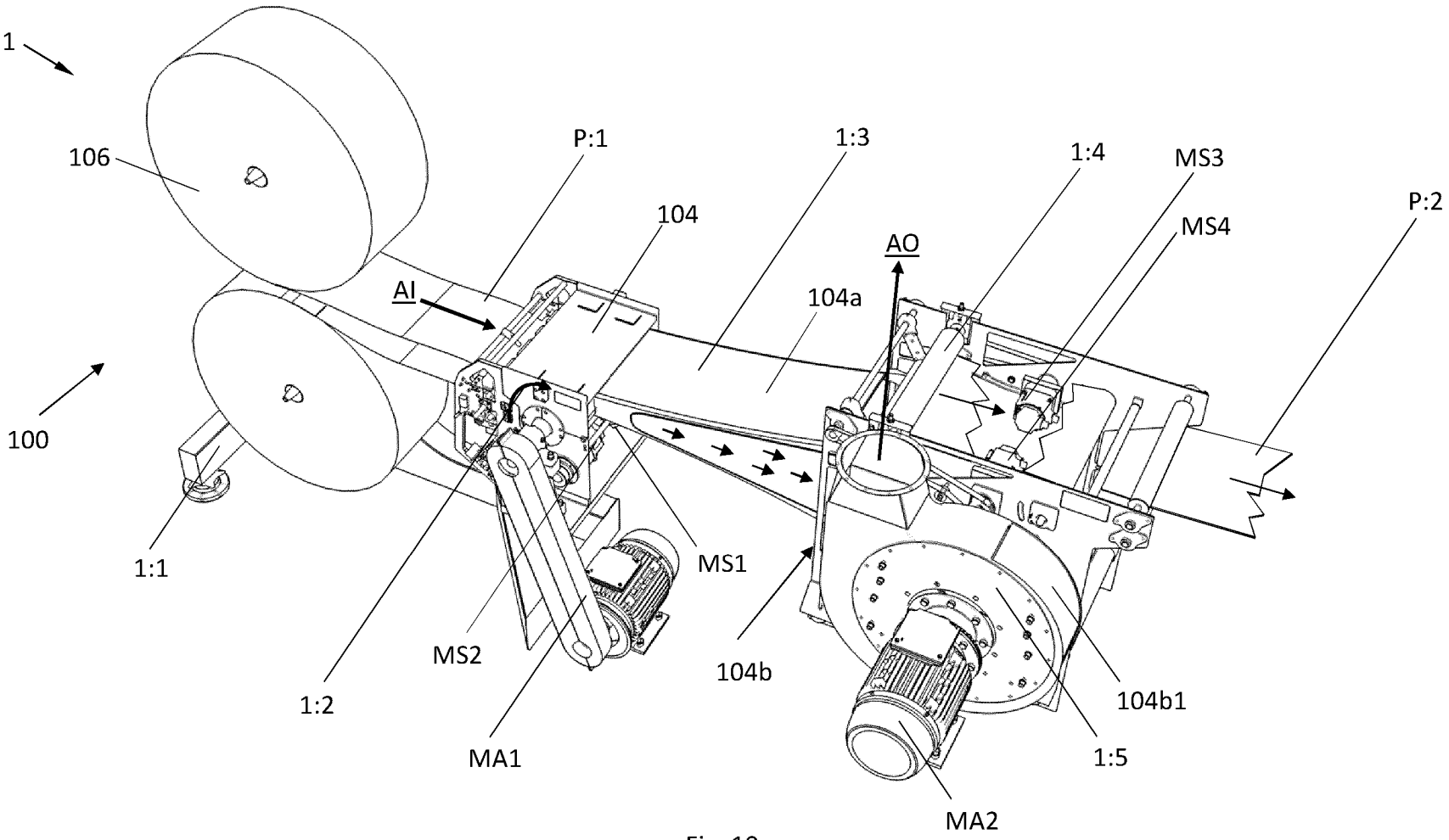

FIG. 19 schematically shows Mill-to-Web Sub-Units; Back-Right View

Figure 21:
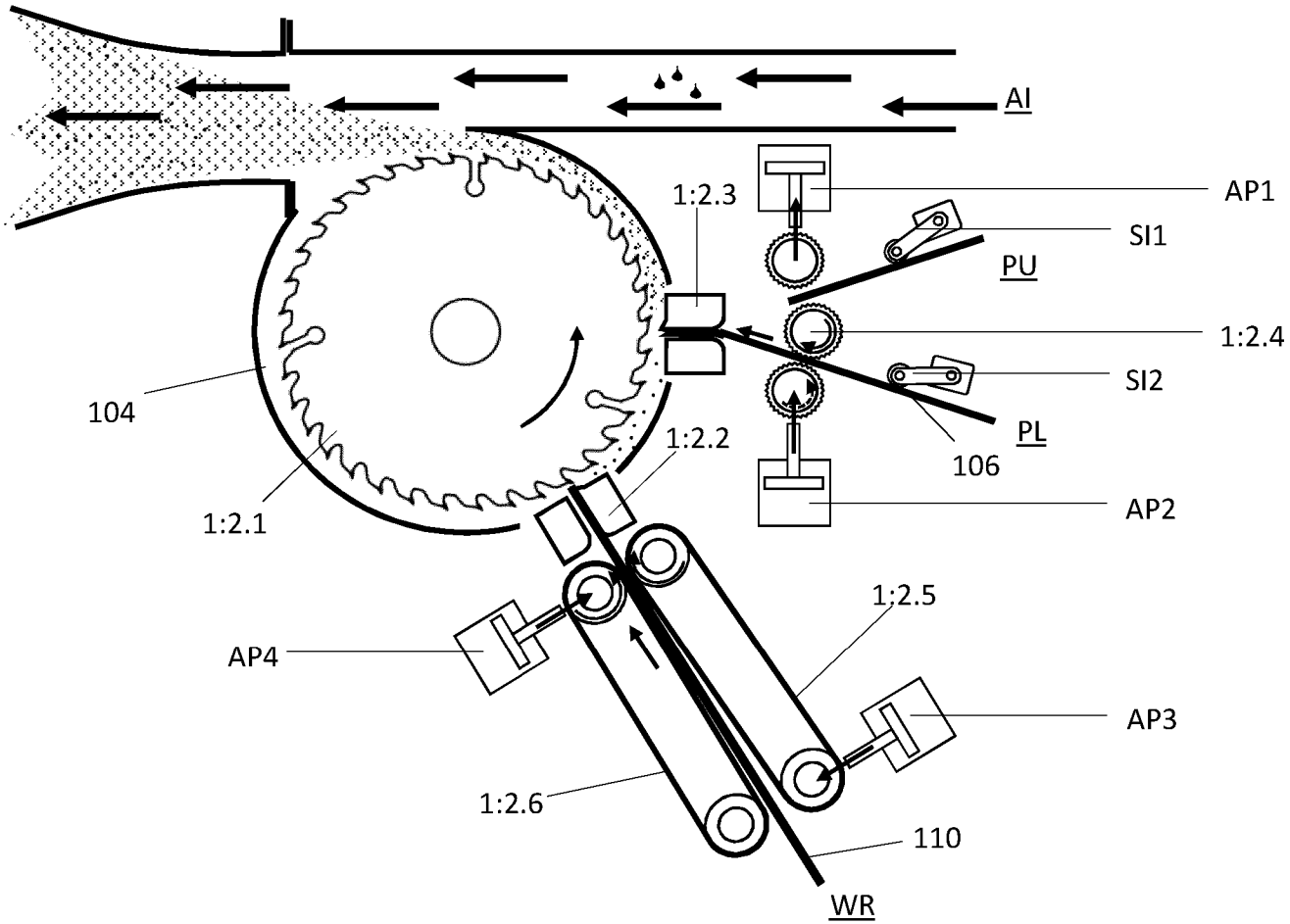

| ITEM | SUBUNIT | NOTE |
|---|---|---|
| 1:1 | Pulp Roll Stand | |
| 1:2 | Saw Tooth Mill | |
| 1:3 | Fibre Hood | |
| 1:4 | Web Forming Unit | |
| 1:5 | Vacuum Fan | Belongs physically to the Tissue Sub System (2) |
| MS1 | Pulp sheet feeder | |
| MS2 | Waste web feeder (double belt in mill) | Se FIG. 21 |
| MS3 | Wire Belt Drive | |
| MS4 | Web Compression Roller | |
| MA1 | Mill Motor | |
| MA2 | Vacuum Fan Motor | |

2.1.1 Saw Tooth Mill Subunit

Figure 20B:
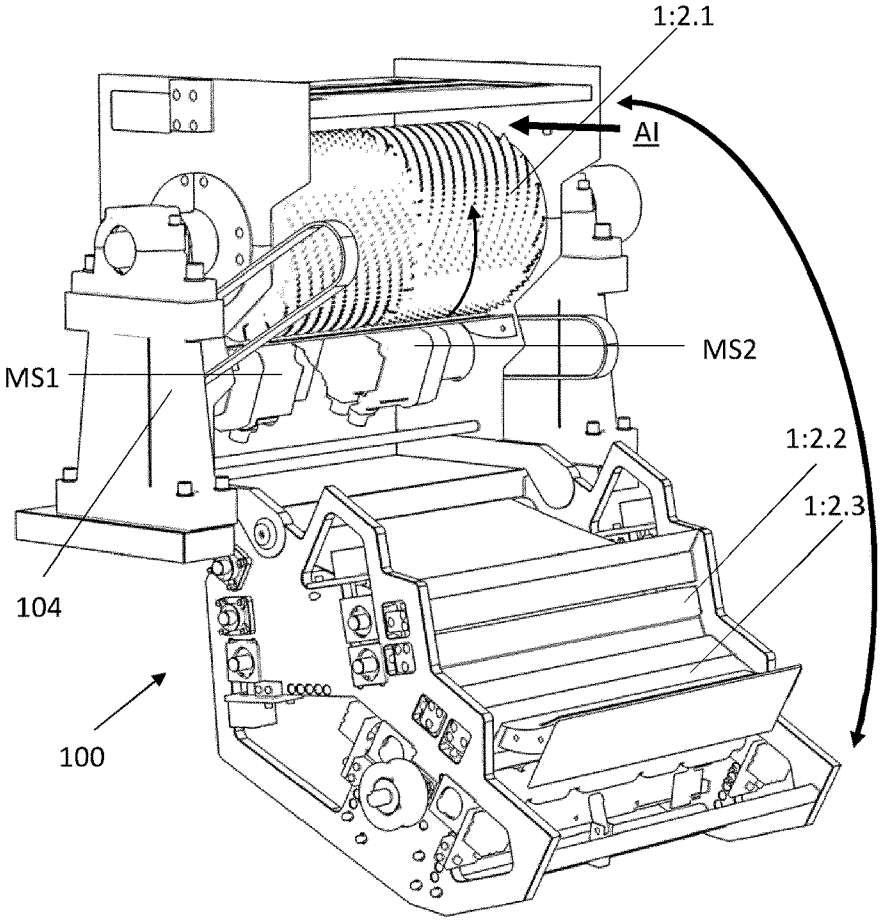
Figure 20A:
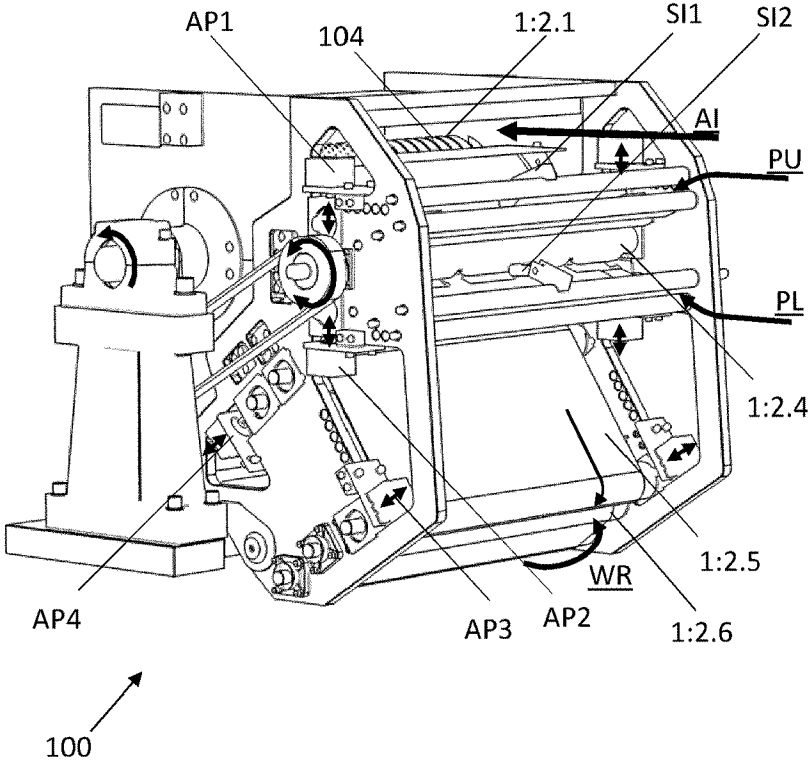

FIGS. 20*a* and 20*b*. Saw Tooth Mill Subunit (1:2)—Main Components; Closed at Left, FIG. 20*a*, and Opened at Right, FIG. 20*b*.

| ITEM | MAIN COMPONENT | NOTE |
|---|---|---|
| 1:2.1 | Saw Tooth Rotor | Dia. 320 mm |
| 1:2.2 | Braker Bar - Waste Recycling (WR) | |
| 1:2.3 | Braker Bar - Virgin Pulp (PU or PL) | |
| 1:2.4 | Feeder Roller - Virgin Pulp (PU or PL) | Alternated by AP1, AP2 and rotation direction of 1:2.4 |
| 1:2.5 | Upper Feeder Belt - Waste Material Recycling (WR) | |
| 1:2.6 | Lower Feeder Belt - Waste Material Recycling (WR) | |
| MS1 | Pulp Feeder | |
| MS2 | Waste web/material feeder (double belt 1:2.5 & 6) | |
| AP1 | Nip Actuator Pulp Upper (PU) X2 | Pneumatic Cylinder; Manually adjusted pressure regulator |
| AP2 | Nip Actuator Pulp Lower (PL) X2 | Pneumatic Cylinder; Manually adjusted pressure regulator |
| AP3 | Nip Actuator Waste web belt entrance X2 | Pneumatic Cylinder; Manually adjusted pressure regulator |
| AP4 | Nip Actuator Waste web belt exit X2 | Pneumatic Cylinder; Manually adjusted pressure regulator |
| SI1 | Pulp Upper (PU) present sensor | |
| SI2 | Pulp Lower (PL) present sensor | |

Figure 22:
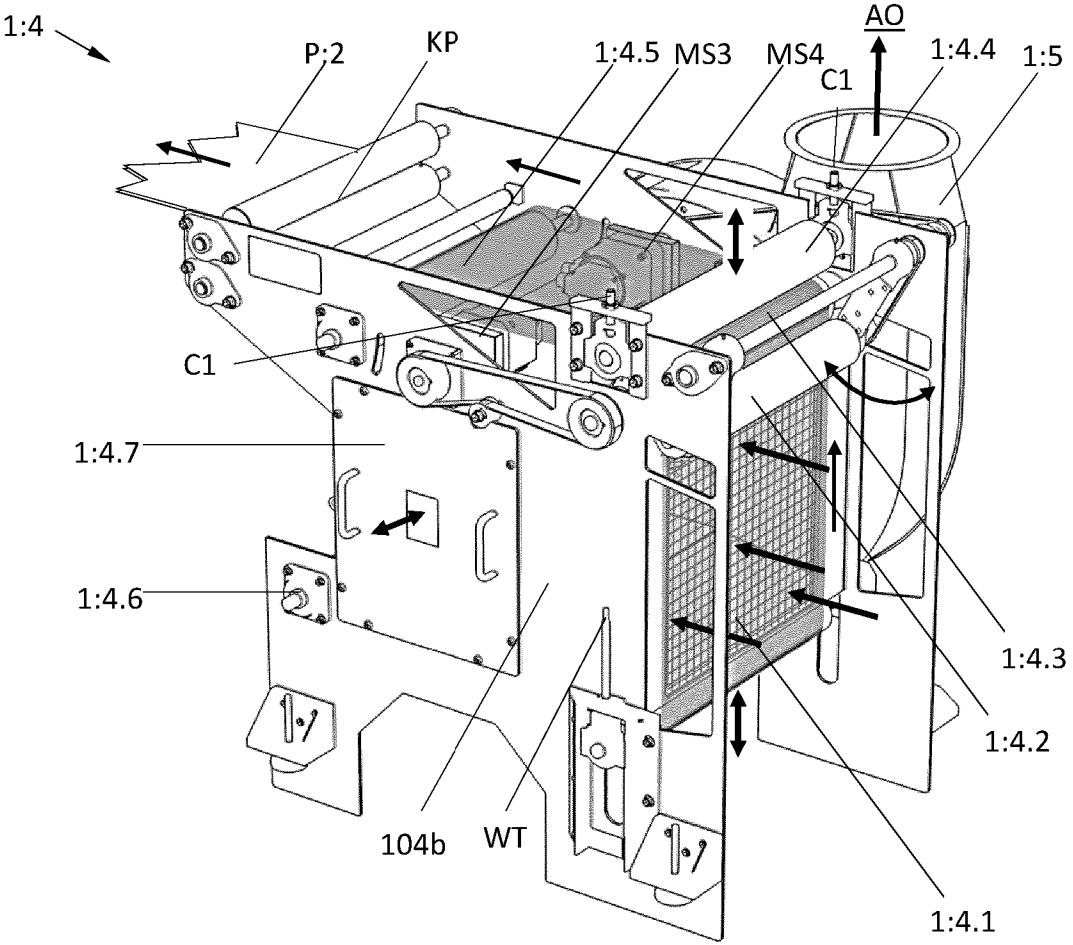

FIG. 21 schematically shows a Schematic Illustration of Saw Tooth Mill 2.1.2 Web Forming Subunit FIG. 22 schematically shows a Web Forming Subunit-Main Components The Wire (1:4.1) and a rubber coated roller (1:4:3) is driven by a Servo Motor (MS3). A pivot hinged- and spring loaded, Feeder Roller (1:4.2) ensure that the Web (P: 2) follows the Wire out from the Fibre Hood into the Web Compression roller nip between (1:4.3 and 1:4.4). The degree of Web Compression is manually adjusted by the two screws (C1).

The Compression Roller (1:4.4) and the Feeder Roller (1:4.2) are both driven by Servo Motor (MS4). Both Servo Motors (MS3 and MS4) are mounted inside at the top of the Web Forming Unit underneath the wire. The Wire (1:4.1) tension is manually adjusted by the two screws (WT).

Scala has no buffer between the Mill-to-Web and the Moulding Sub-System. I.e., all Servo Motors (MS3, MS4, MS7, MS8, MS9 and MS10) operates simultaneously in a Stop-and-Go sequence. However, the Pulp and Tissue rolls has too much torque inertia to be operated at Stop-and-Go why (MS1, MS2, MS5 and MS6) operates at continuous speed. The same goes for the Recycling Sub-System (4), see Chapter 2.4.

Figure 23:
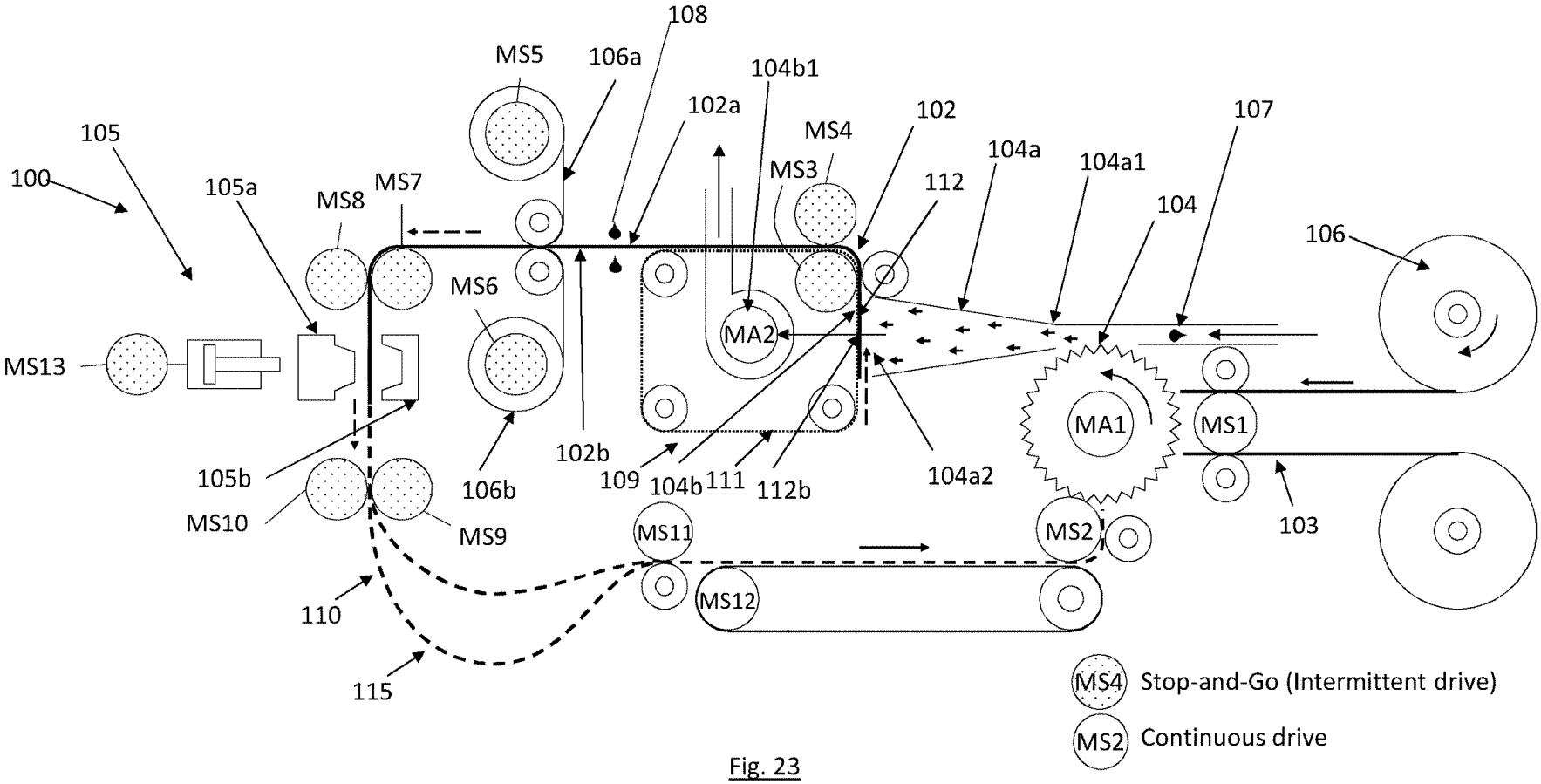
Figure 24:
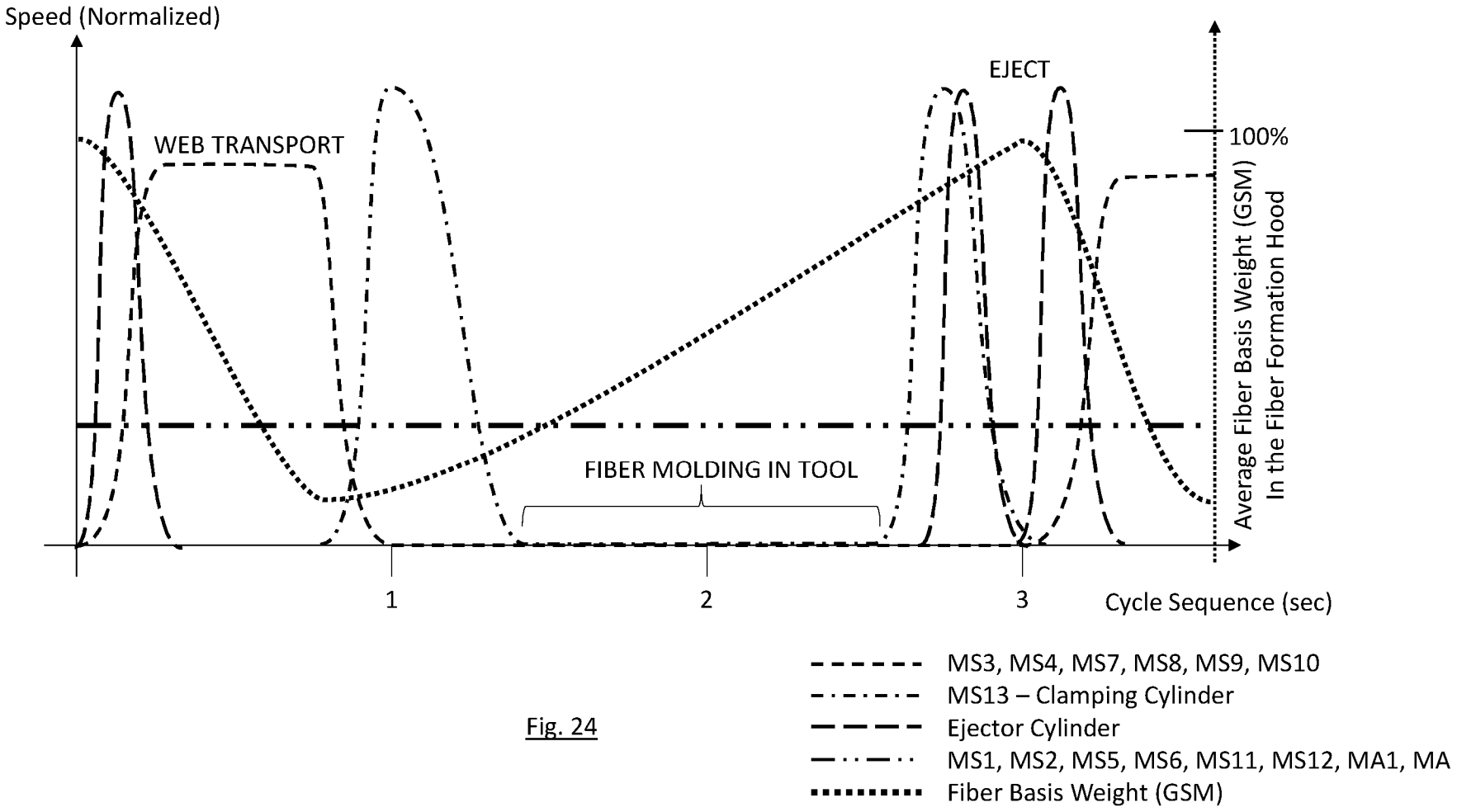

FIGS. 23 and 24 schematically show Stop-and-Go Operation of Web Forming and Moulding.

Since booth virgin Pulp and Waste Web are feed continuous into the Mill (MA1), the fibres will be drawn to a non-moving wire most of the cycle sequence, see diagram above. I.e., one sheet, approximately 500×500 mm of Web will be accumulated on the wire before feeding towards the moulding area starts.

A certain overlap between each Web Sheet will locally affect the Basis Weight GSM (gram per square meter).

The Web Forming Subunit (1:4) also holds rollers (TR) to guide the Lower Tissue path under the Suction Box and up to the Kissing Point (KP) where the Fibre Web meets the upper and lower tissue.

Figure 25:
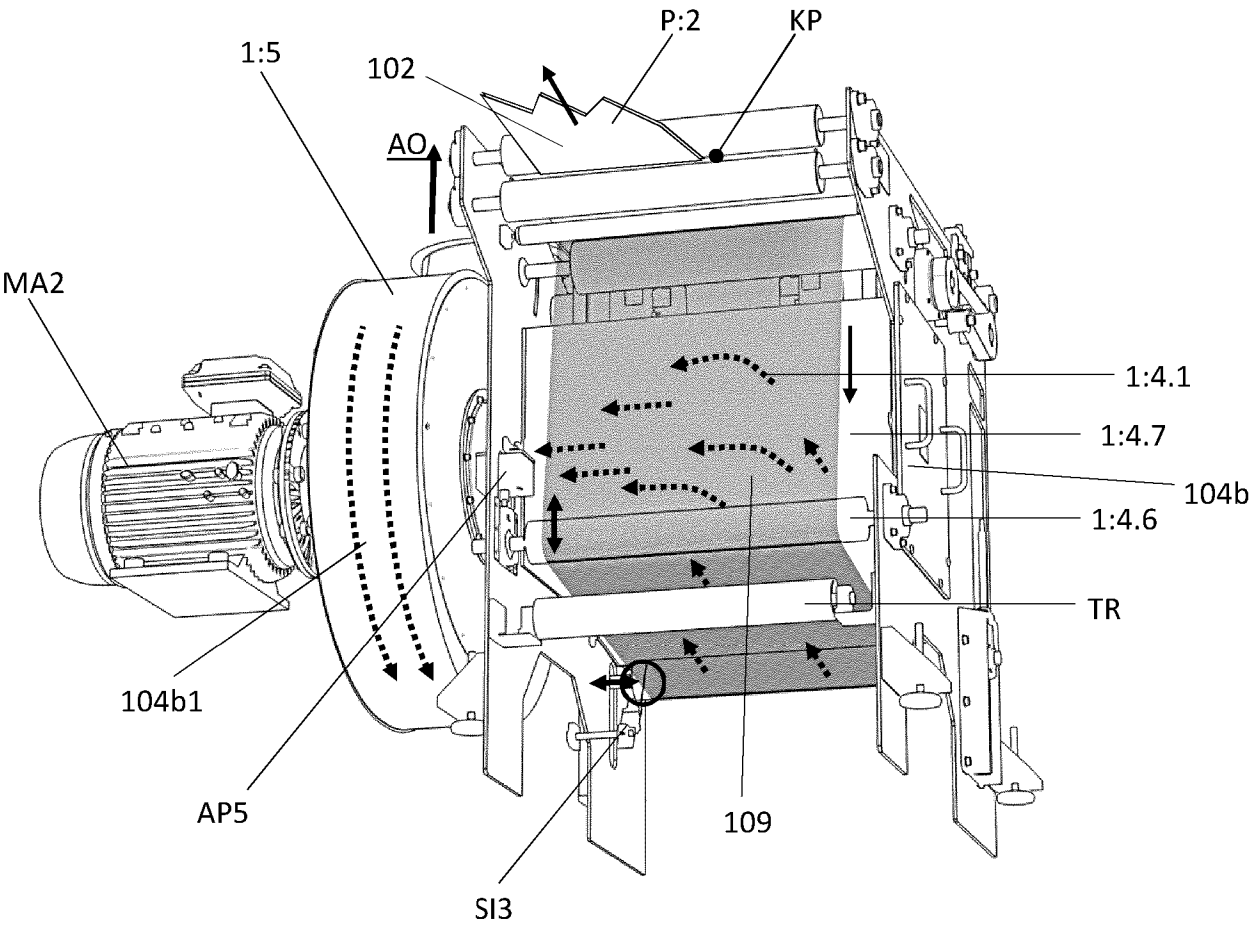

FIG. 25 schematically shows Web Forming Subunit seen from underneath-Main Components.

The Wire Belt (1:4.1) may drift sidewise (wandering) on the rollers, when running, why the Web Forming Unit is equipped with a simple and autonomous pneumatic feedback control system for Wire Tracking,—not part of the PLC-control. A pivot pin (SI3) trailing on the edge of the Wire (1:4.6), see red ring in FIG. 25, controls a pneumatic valve via a pneumatic cylinder (AP5) moving the Tracking Roller (1:4.6) in only one end (the other fixed front end of (1:4.6) uses a spherical roll bearing) so a closed feedback regulator loop ensures that the Wire stays within +/−5 mm in axial wandering.

The dotted arrows in FIG. 25. illustrates the air flow through Suction Box (1:4.7) via the Vacuum Fan 1:5 and to the outlet (AO). If several Scala Machines is installed in one facility it is recommended to install one central filter. Scala can also be equipped with an Air In-Let Manifold where air recycling can be locally arranged and installed. Scala is however sold and delivered without filter or air recycling system.

2.1.3 Mill-to-Web Sub-System Functional Requirement Specification

| Pulp Input | | |
|---|---|---|
| Max pulp reel diameter | mm | 1200 |
| Pulp Reel core diameter | inch | 3 |
| Max Pulp Reel width | mm | 508 |
| Max Pulp Reel weight | kg | 350 |
| Web Out-Put | | |
| Max Basis weight (at max speed) | GSM | 1500 |
| Min Basis weight | GSM | 400 |
| Max Web Output capacity (Virgin + Recycled Fibres) | Kg/hrs. | 450 |
| Max Web Output Capacity (at Stop-and-Go) | m/min | 10 |
| Max Web Feeding Speed | m/sec | 0.75 |
| Max time for max feed = 500 mm | Sec. | 1 |
| Web Compression: Max Web Thickness (800 GSM) | mm | 30 |
| Web Compression: Min Web Thickness (800 GSM) +/−0.5 | mm | 3 |
| Web Evenness; Weight deviation, see FIG. 19 | % | +/−2 |
| Sub-System Operational Conditions | | |
| Max Noise Level (with covers) | dB | 80 |
| Temperature | ° C. | 10-40 |
| Humidity | % RH | 30*-90 |

*Note:
if the In-Let Air holds a humidity of 55-70% RHD, no machine humidification is needed.

5 Complementary Specifications for Mill-to-Web Sub System

General Items

Unwind stand for pulp. Two reals ø1200×508 mm with manual locking of reals in place. Core diameter 3"

1 300 mm fibre hood with inspection window between Mill Sub-Unit and Web forming Sub-Units.

Mounted on Fibre Sub-Assembly Framework, bolted on to the Clamping-Unit Sub-System.

HMI Touch Panel and Operator Alert Lamp are mounted on top of the MTW and its roof panel.

Humidification Unit for Process Air, Max 5 000 m3/h

Optional humidification of incoming air AI inside Air In-Let Cover Humidification I; see FIG. 13, 107, and/or web before Kissing Point (KP) Humidification II; see FIG. 13, 108, is done be using hydraulic 2 pcs spray nozzles at Humidification I and 2+2 pcs. (top and bottom) at Humidification II:

Model: 8HPWMD driven by 6 bar water

Mill Sub-Unit

Model 450 kg Double feeders.

Saw-Tooth Mill dia. 310 mm

Mill Motor 30 KW; Frequency converter controlled. Up to 5000 rpm.

Feeders (PU/PL and WR) driven by 2 pcs. Servo Motors 0.9 KW;

Web-evenness in basis weight (GSM)

Web Forming Sub-Unit

PulPac Design; see drawings.

Rubber Coating on Drive Roller (1:4.3) Shore A=95.

Wire Belt: End-less or Seamed 3m width 580 mm. Recommended Belt Tension: 300 daN/m Air permeability: CFM (½" w.c.): 550; $m^3/m^2/h$ (100 PA): 8 900

Web Evenness; Basis weight deviation from average: Max+/−2%/per piece, see FIG. 26.

Figure 26:
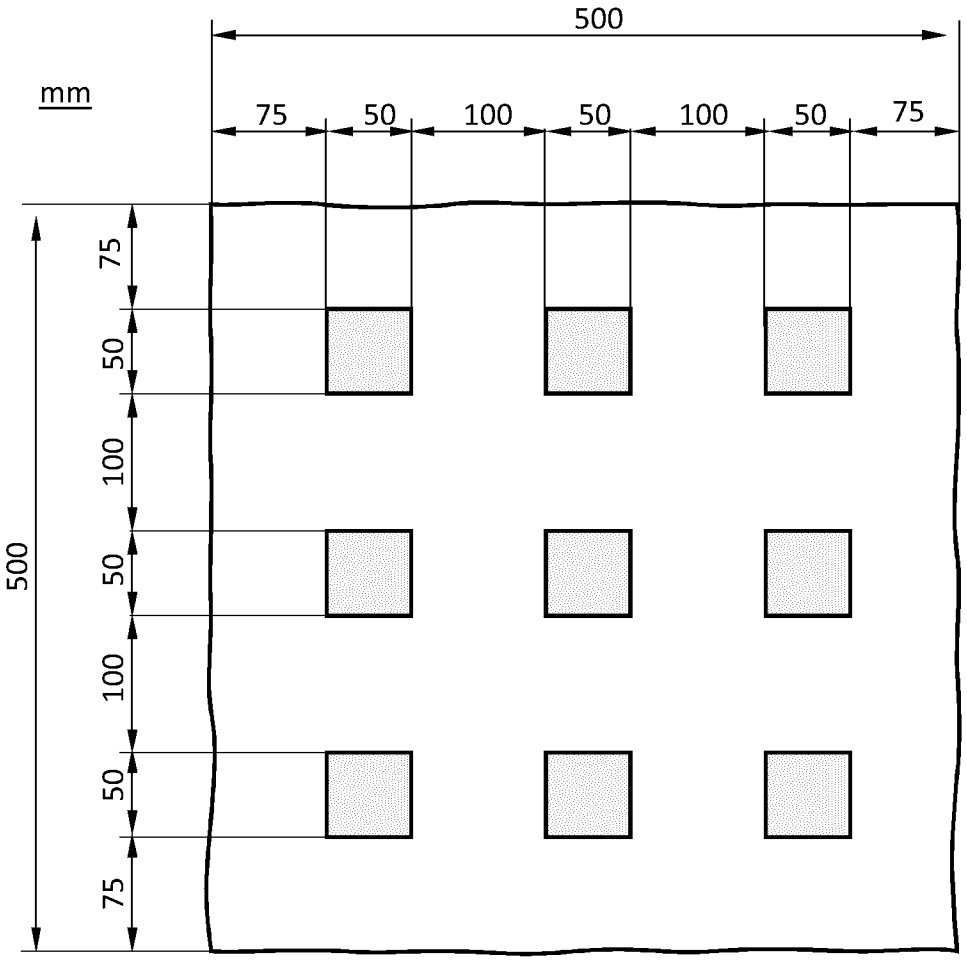

FIG. 26 schematically shows Web Forming Evenness between 9 samples in a 500×500 mm web.

Belt and compacting roller is driven by 2 pcs. Servo Motors 0.9 KW; Model: See Appendix A Vacuum Fan ATEX classified; Motor 37 KW; IP 55

5000 m3/hrs. at 10 000 Pa under pressure, see fan curve below.

Figure 27:
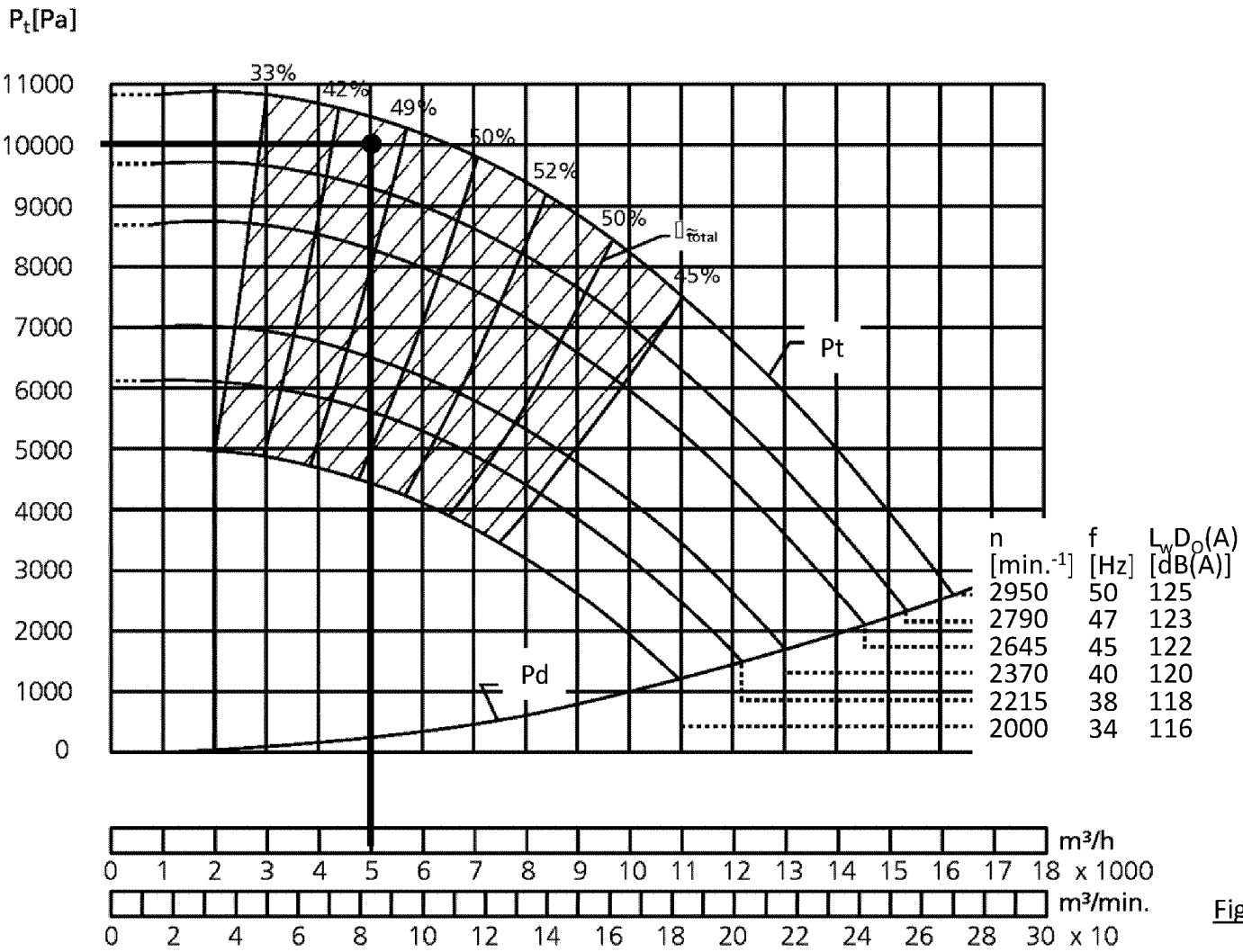

FIG. 27 schematically shows Web Quality Sampling 2.2 Tissue Sub-System

Figure 28:
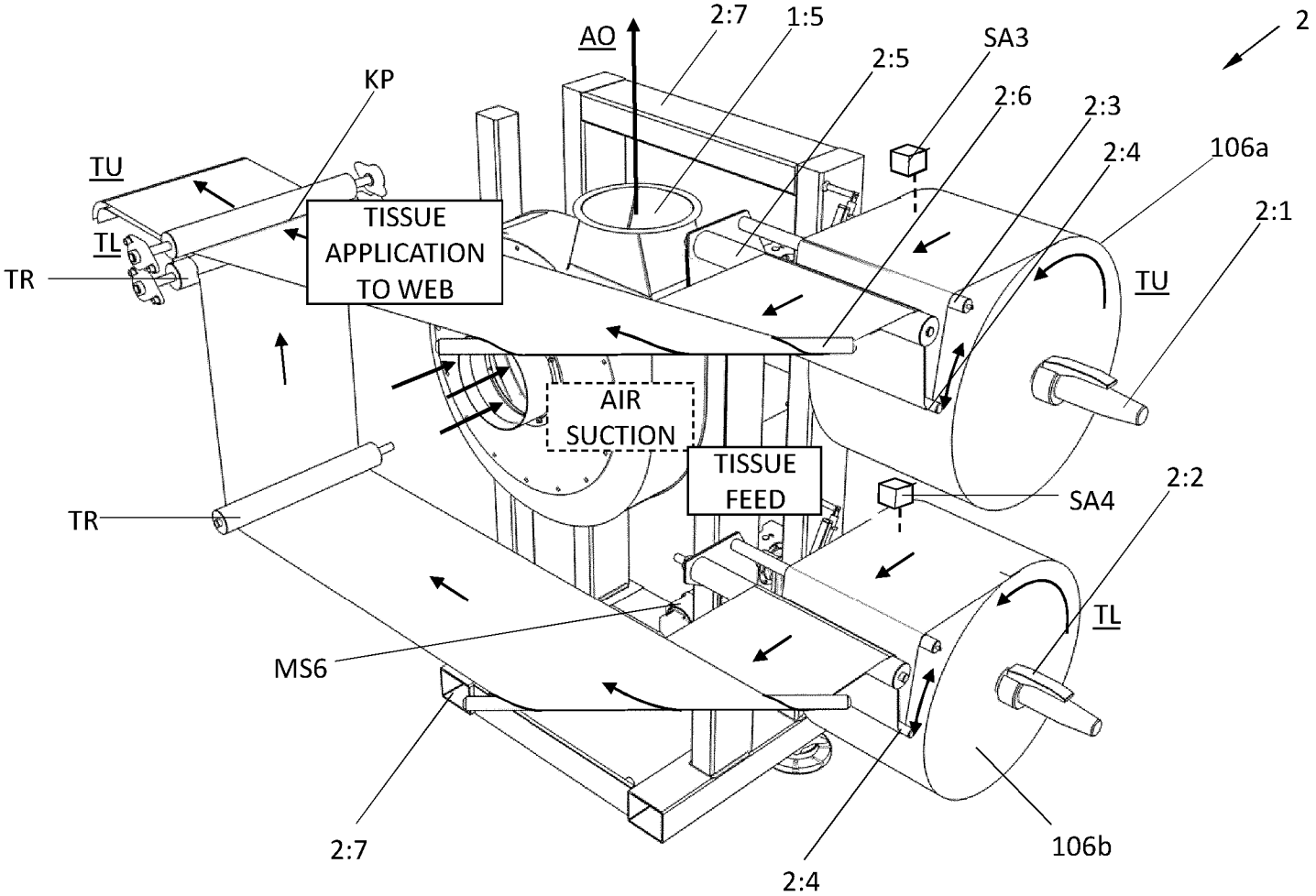

FIG. 28 schematically shows Tissue Sub-System (2)—Sub-Units, seen from Left-Front.

The Web (P: 2) leaving the Mill-to-Web Sub-System (1) should be layered with a Upper Tissue (TU) and a Lower Tissue (TL), at the Kissing Point (KP), before entering the Tool Feeder.

In most applications, where the fibre product requires barriers towards water and/or oil, the tissue is pre-coated with a small amount (<1% w.) of sustainable barrier chemistry, e.g., AKD wax. When formed in the tool, using high pressure and high temperature, the barrier chemistry will penetrate into the fibres (1:2) and seal the fibres to create the desired properties of the final fibre product. In some cases, after-curing might be needed to obtain full barrier properties.

In other cases the converter (customer) might preferred coloured or pre-printed tissue to enhance the aesthetic properties of the finished fibre product.

Figure 29:
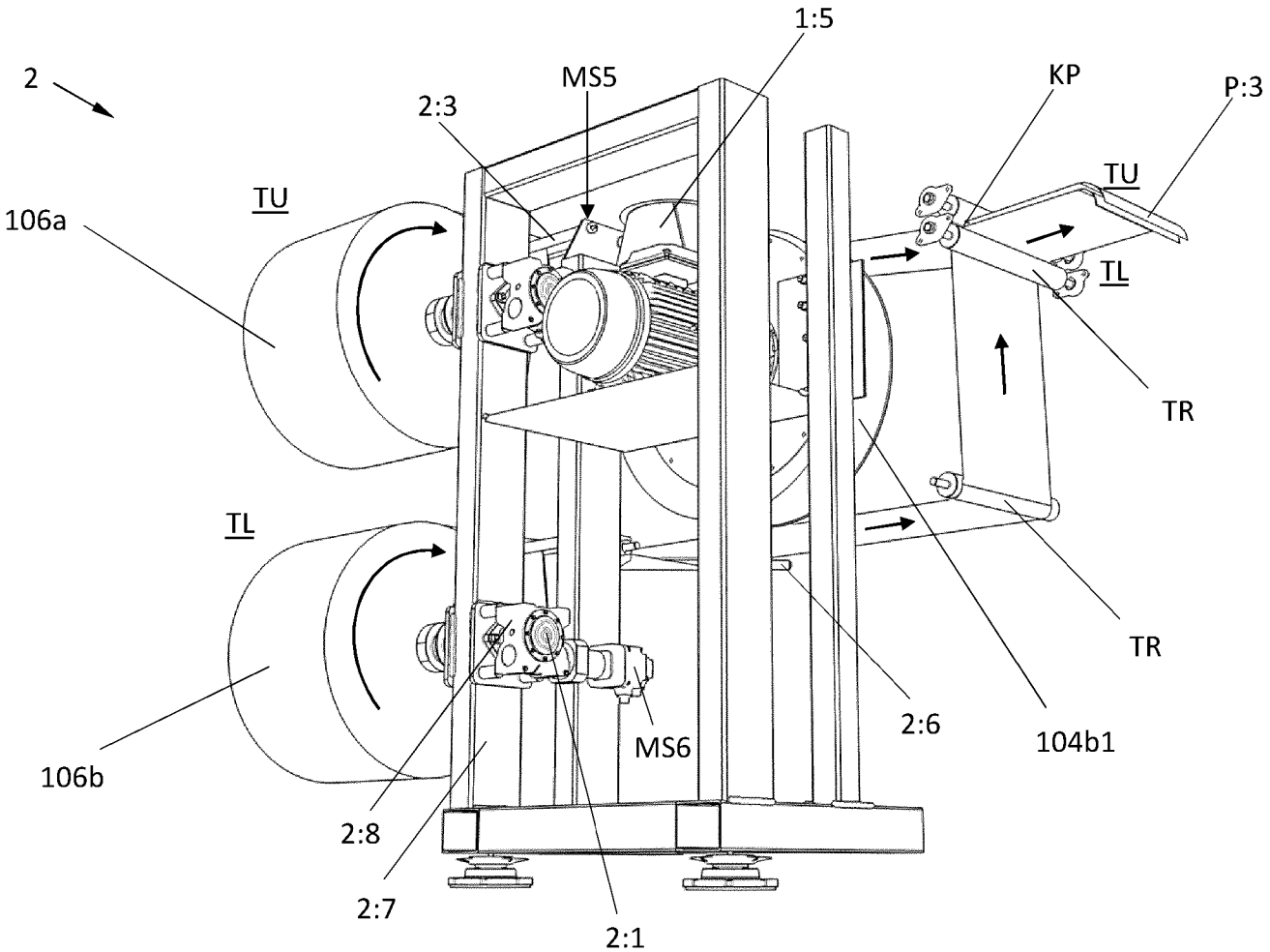

FIG. 29 schematically shows Tissue Sub-System (2)—Sub-Units, seen from Right-Back.

In contrast to the Pulp (P: 1) the Tissue (P: 3) is a thin a fragile paper sheet that easily breaks if path tension is too high. In order to ensure a tissue tension of 10-100N the Tissue Sub-System is equipped with driven Tissue Roll Axis (2:1) where the Tissue Roll is manually clamped with a Toggle Handle (2:2). Each roll is driven by a Servo Motor (MS5/MS6) via a worm gear (2:8) and controlled in a feedback loop in PLC using a Tissue Buffer & Tension Pivot Sensor (Dance arm) (2:4, 2:9 and SA 1), see FIG. 30 below.

The Fan (1:5) belongs functionally to the Web Forming Sub-Unit, see 2.1.3 but is mounted on Tissue Framework (2:7) and is shown in these figures as part of this Sub Assembly.

Figure 30:
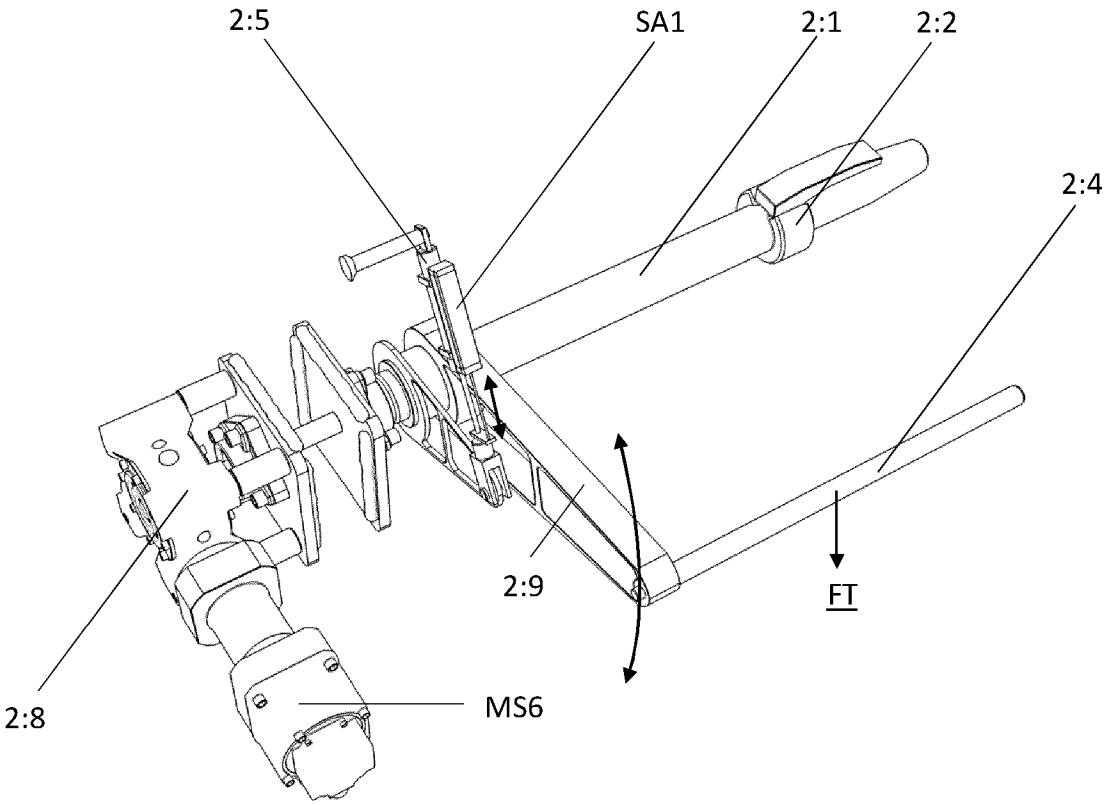

FIG. 30 schematically shows a Tissue Feeding Assembly.

The Pivot Roller (2:4) rests with a small contact force (FT) inside a tissue loop, se fig. XX above, and pivots around the Tissue Roll Axis (2:1) with a Pivot Arm (2:9). The Pivot Arm has one longer arm, outside the cover plate, see chapter 2.5, and one shorter arm on the inside of the cover plate.

The shorter arm is connected to a pneumatic cylinder (2:5), that balances the weight of the Pivot Arm (2:9 & 2:4) to the correct contact force (FT), and a linear potentiometer, the Tissue Buffer & Tension Sensor (SA1 & SA2) that measures the position of the Pivot Roller (2:4), i.e., the amount of tissue in the buffer. This value is then feedbacked looped to the regulator for the Servo Motor (MS6) to rotate the tissue roll in the right speed to maintain the buffer needed. The tension of the tissue (10 and 100N) is manually set by the pneumatic cylinder (2:5).

Figure 31:
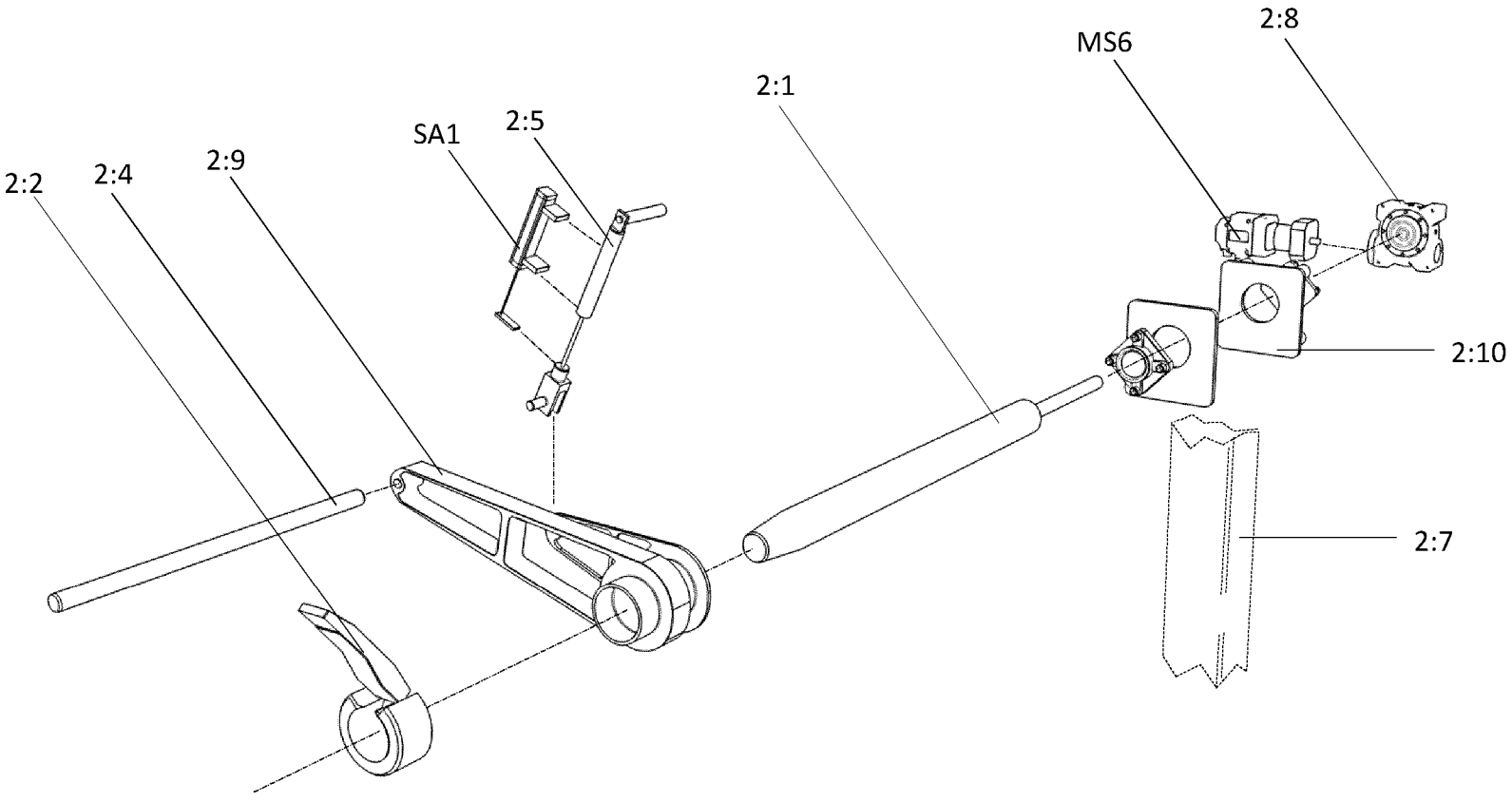

FIG. 31 schematically shows a Tissue Feeding Assembly—Exploded View.

Figure 32:
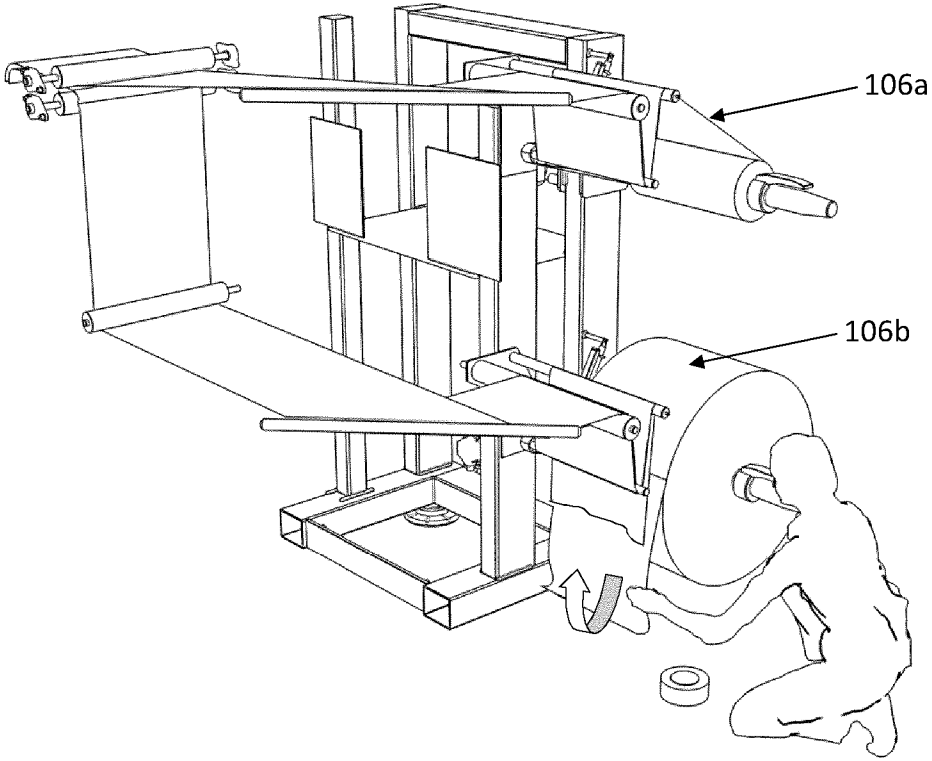

FIG. 32 schematically shows Manual Tissue Splicing.

Each Tissue roll is lasting around 10 hours in continuous production. Two sensors (laser—SA3 and SA4), see FIG. 28, measures the roll diameter for each tissue roll. The PLC tells the Operator when less than 30 min of operation is left respectively alarms when only five minutes are left before empty roll. The Splicing of Tissue Rolls is done manually upon alerts from the Operator's Alert Lamp on top of the machine and the HMI, by pausing the operation in Scala and joining the two sheet ends with a special compostable tape. Estimated stop time is less than 2 minutes per roll.

2.2.1 Tissue Sub-System Functional Requirement Specification

| Tissue Input | | |
|---|---|---|
| Max Tissue reel diameter | mm | 800 |
| Tissue Reel core diameter | Inch/mm | 3/76 |
| Max Tissue Reel width | mm | 508 |
| Max Tissue Reel weight | kg | 180 |
| Buffer capacity of the Pivot Arm | mm | 680 |

-continued

| Tissue & Web Out-Put | | |
|---|---|---|
| Max Web & Tissue Feeding Speed | m/sec | 0.75 |
| Max time for max feed = 500 mm | sec | 1 |
| Max Feeding Length per cycle; | mm | 500 |

Complementary Specifications for Tissue Sub System

Tissue Unwind

General

Max height to top reel centre: 1800 mm.

The working range of the pivot arm (2:4) arm is +−20 degrees, about 340 mm, i.e. the buffered tissue length of max 500 mm is within the range of the pivot arm; 2×340=680 mm.

Distance sensor for measuring the diameter of the reel (measuring range 400-1200 mm, Balluff).

Track tension range 10-100N measured from the Pivot Arm.

2.3 Molding Sub-System

Figure 33:
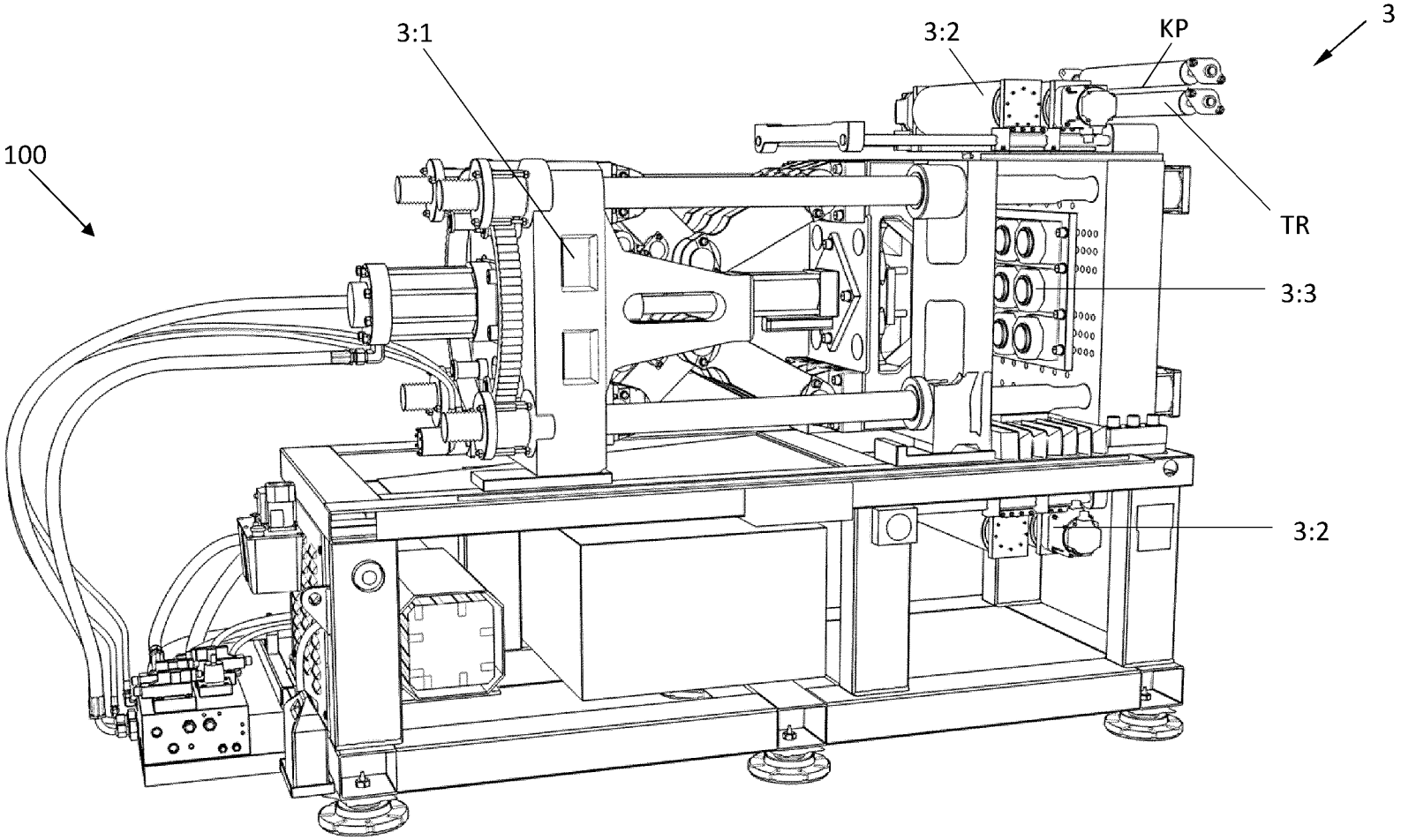

FIG. 33 schematically shows The Moulding Sub-System-seen Front/Left

The Moulding Sub-System comprises three Sun-Units:

| | |
|---|---|
| 3:1 | Clamping Unit |
| 3:2 | Feeder (2: One Upper and One Lower) |
| 3:3 | Tool |

On the following described and specified one by one. (The two Tissue Rollers (TR) shown in Fig. belongs to the Mill-to-Web Sub-System and is shown as a reference for the Kissing-Point (KP).)

2.3.1 Clamping Sub-Unit

Figure 34:
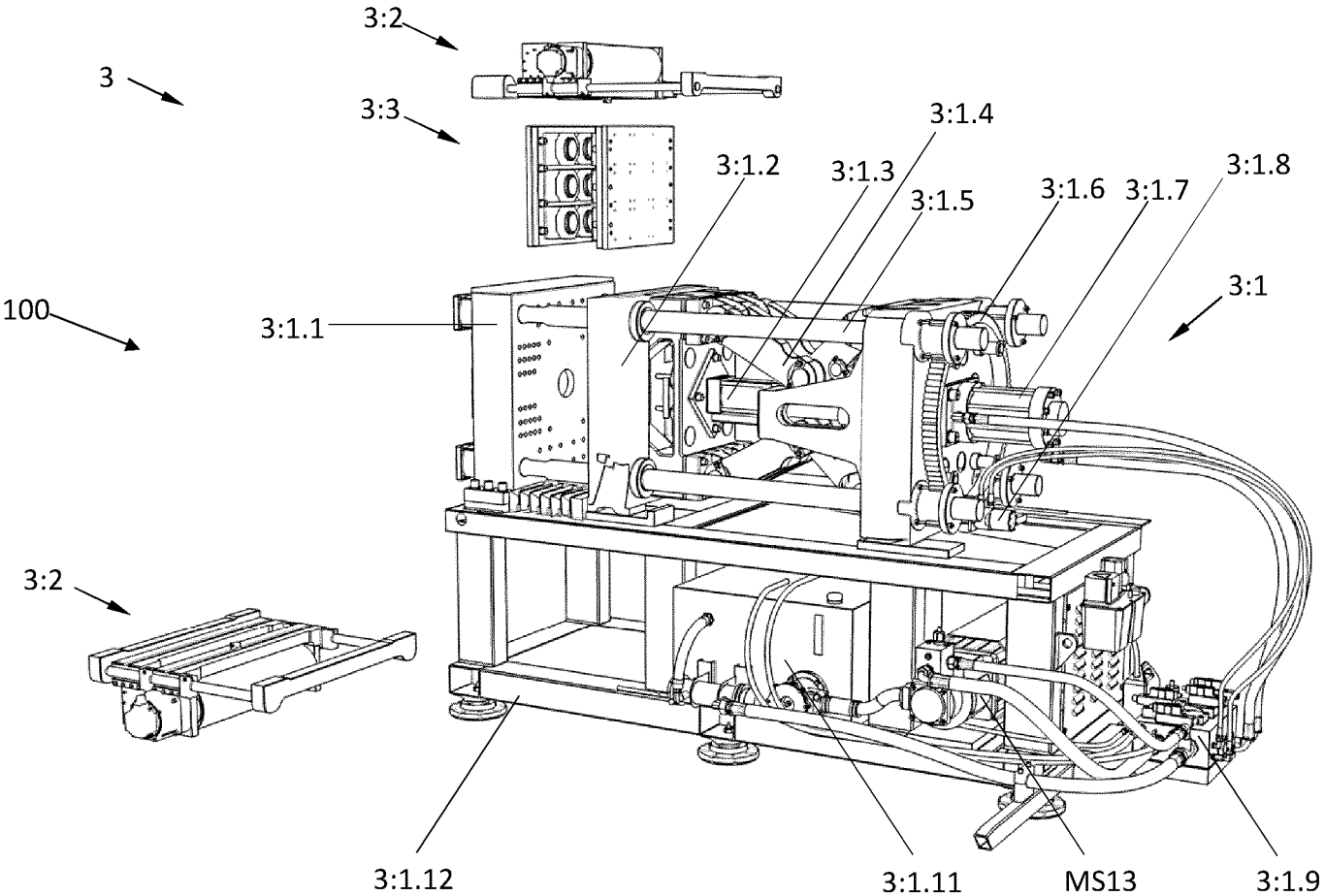

FIG. 34 schematically shows The Clamping Unit Main Components-seen Back Left The Clamping Unit (3:1) in Scala is a standard clamping unit from an injection moulding machine, i.e., a horizontal press, and will not be described in detail in this document. However, the main components of this sub-unit are:

| Pos. | Main Component | Note |
|---|---|---|
| 3:1.1 | Fixed Platen | |
| 3:1.2 | Moving Platen | |
| 3:1.3 | Ejector Cylinder | |
| 3:1.4 | Toggle Arms | |
| 3:1.5 | Tie Bar | X4 dia. 90 mm |
| 3:1.6 | Moving Platen Position Mechanism | Tie Bar rotation |
| 3:1.7 | Clamping Cylinder | |
| 3:1.8 | Motor Tie Bar rotation | |
| 3:1.9 | Hydraulic Valve Package | |
| MS13 | Servo Motor Hydraulic Pump | For Clamping Cylinder |
| 3:1.11 | Tank Hydraulic Oil | |
| 3:1.12 | Stand Framework | |

The force and movement from the hydraulic Clamping Cylinder ($F_h$) (3:1.7) is transferred by the toggle arms into an exponential movement with high speed and low force near the open set and low speed and high force near the closed see (β=180°).

Figure 35A:
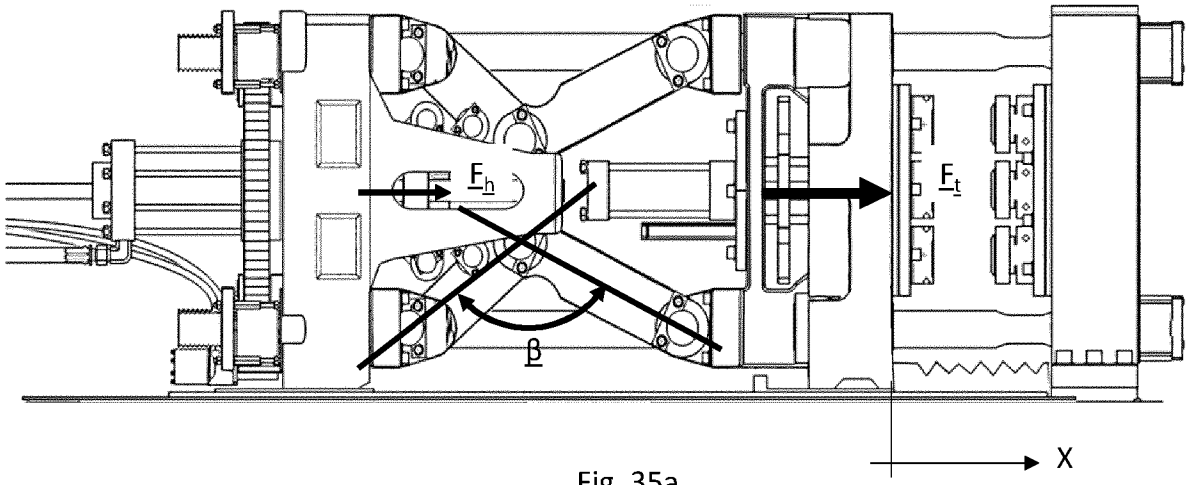
Figure 35B:
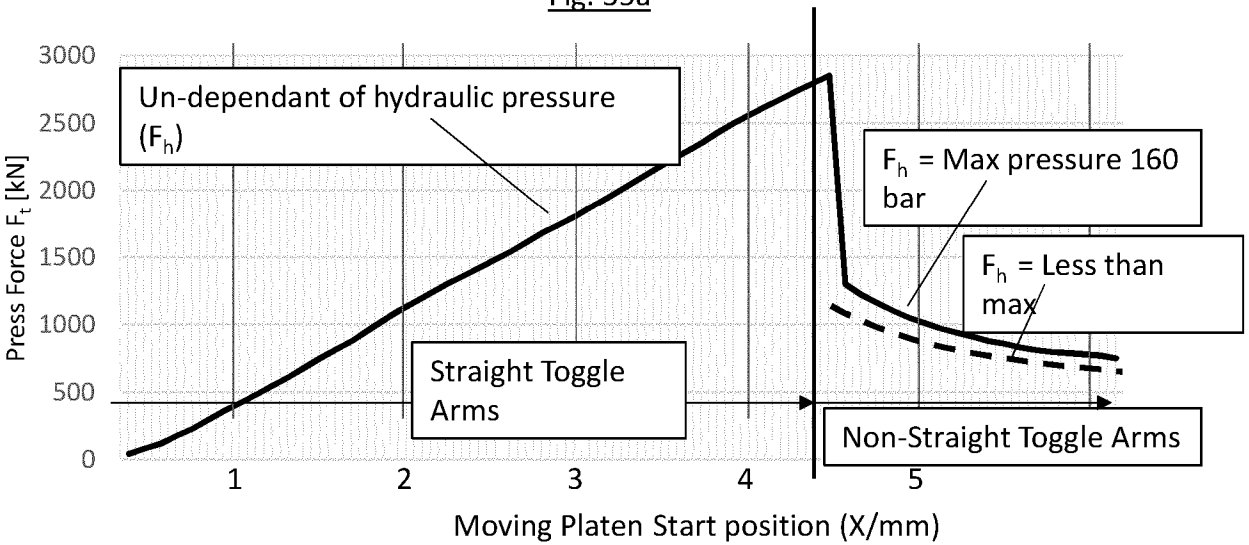

FIGS. 35*a* and 35*b* schematically show The Clamping Unit, FIG. 35*a* and Clamping unit Force Characteristics (empirical measured), FIG. 35*b*.

2.3.2 Feeder Sub-Unit

Figure 36:
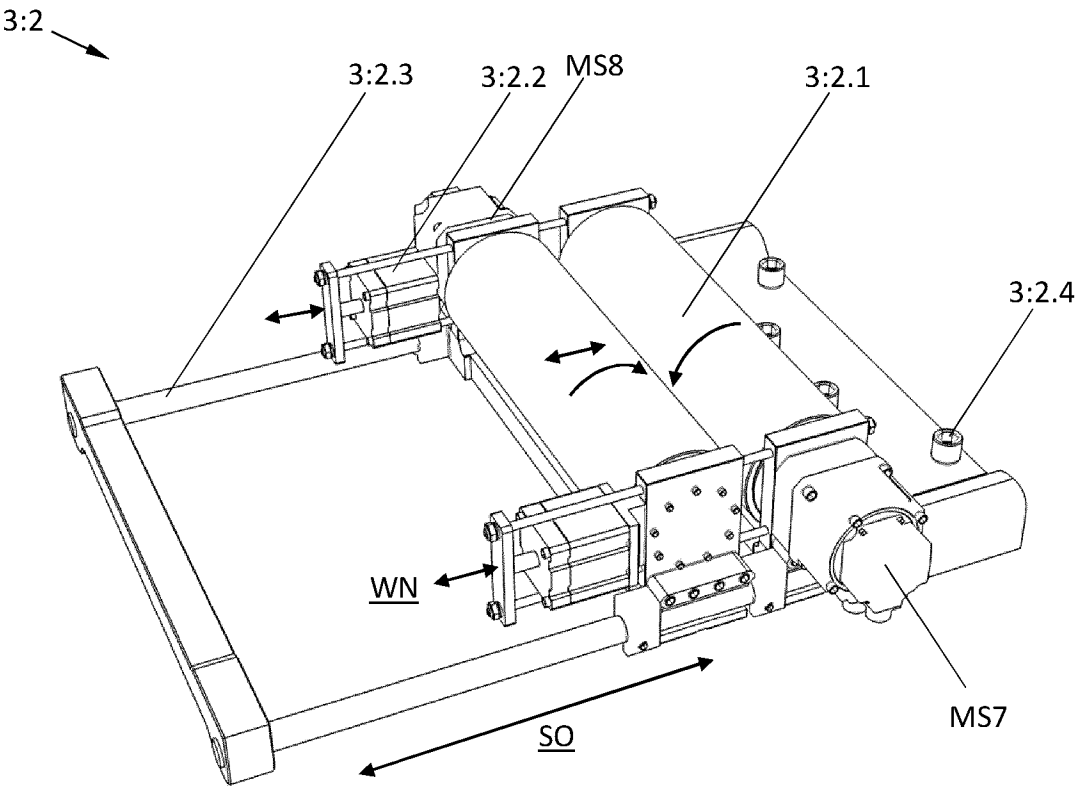
Figure 38:
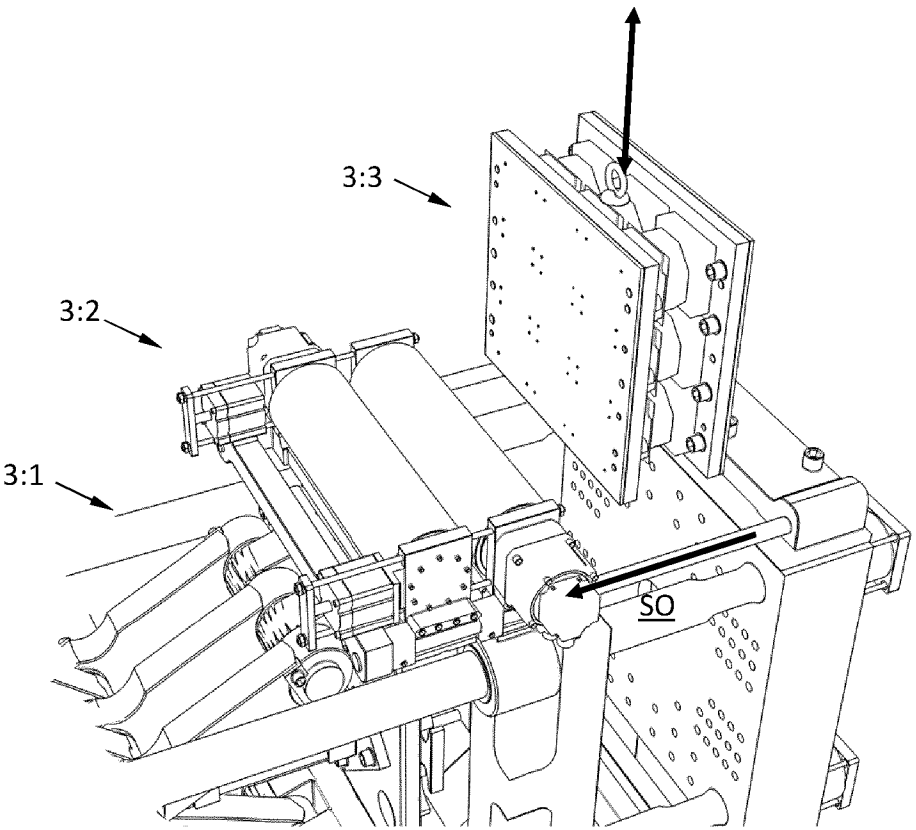

FIGS. 36 and 38 schematically show Feeder Sub-Unit-Web Feeder Shown closed.

Figure 37:
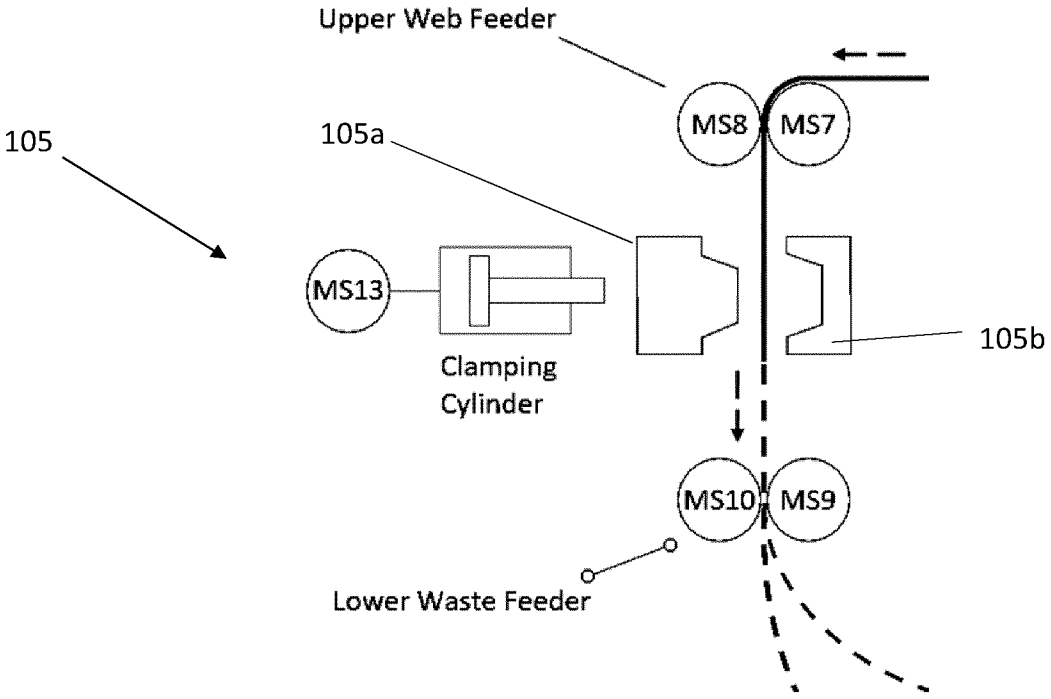

FIG. 37 schematically shows two Feeder Sub-Units.

In order to secure a reliable and controlled feeding of the Web (P: 2) with Tissue to the Tool (3:3) and Waste Web out of the tool area, two Feeder Sub-Units (3:2), with two servo Motors each, are used:

Upper Web Feeder

Lower Waste Feeder

Each Feeder (3:2) is equipped with two pneumatic cylinders (3:2.2) that creates a nip force (WN) between the two rubber coated rollers (3:2.1). The pressure of the cylinders is manually adjusted on a regulator and manually opened by a valve for service and threading of new web.

The Upper Web Feeder and the Lower Web Feeder are almost identical, why a general Feeder (3:2) is described here. The Upper Feeder should however be possible to move into a service position (SO) when loading and un-loading tools.

Scala is designed for intermittent feeding of the Web, in the following called Stop-and-Go. Since earlier Fibre Moulding Machines has been based on continuous forming of the web, a buffer system may accumulate enough web length to be able to allow the Web feeder to rapidly feed new web into the tool area.

Scala has no buffer between the Mill-to-Web and the Moulding Sub-System. I.e., all Servo Motors (MS3, MS4, MS7, MS8, MS9 and MS10) operates simultaneously in a Stop-and-Go sequence. However, the Pulp and Tissue rolls has too much torque inertia to be operated at Stop-and-Go why (MS1, MS2, MS5 and MS6) operates at continued speed. The same goes for the Recycling Sub-System (4), see next chapter.

Each Feeder (3:2) uses two Feeder Rollers (3:2.1) and two Servo Motors (MS7 and MS8; for the upper Web Feeder and MS9 and MS10; for the lower Waste Feeder). The reason for double Servo Motors in each feeder is the need for adjusting the rotation speed individual on the two roller. Layered Tissue tends to bulge out from the Web (P: 2) and also the entire Web is a fluffy and organic material that might require different peripheral roller surface speed to not be damage by shear stress. The different might be very small and is set in the HMI upon loading of new material and basis weight.

Figure 39:
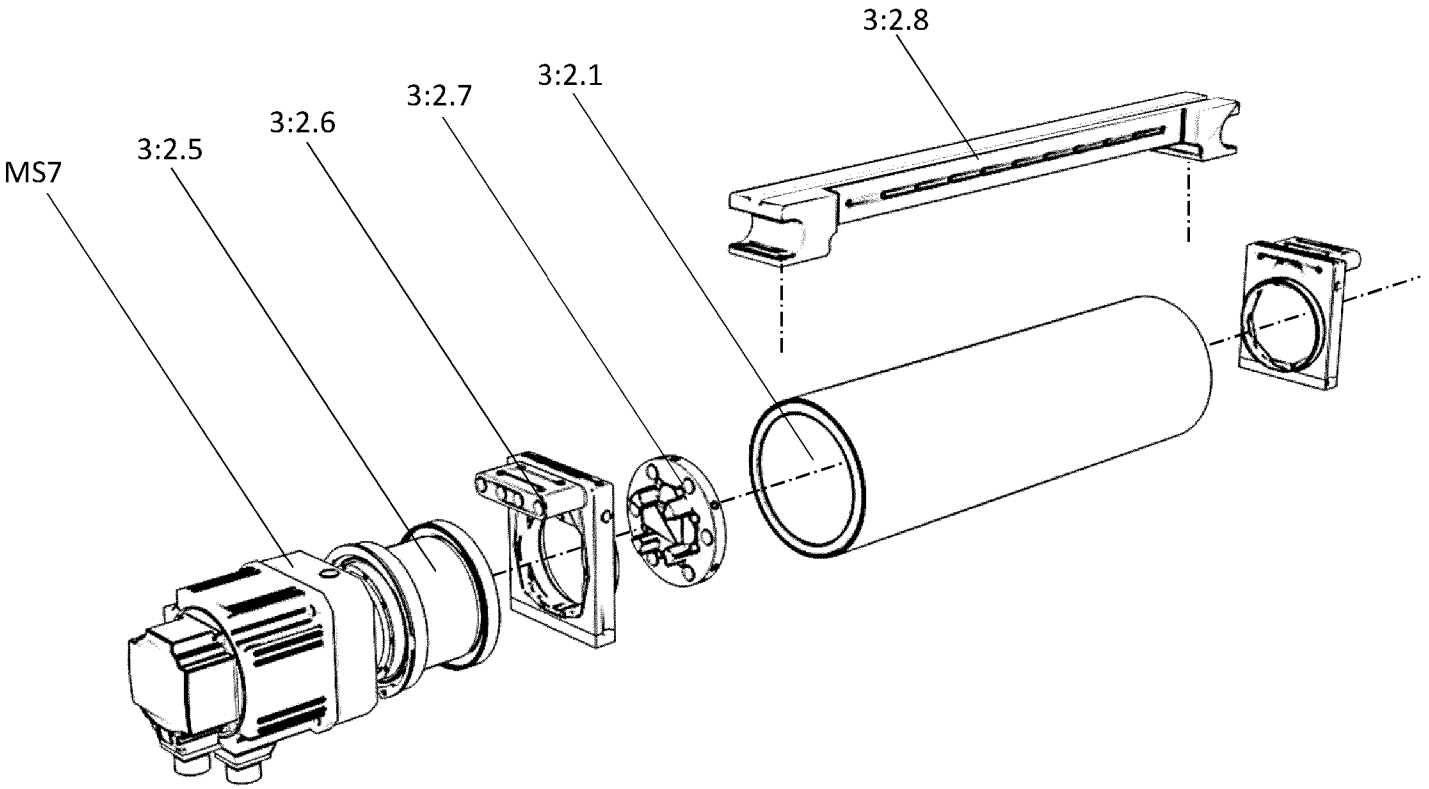

FIG. 39 schematically shows a Feeder Roller Assembly (Exploded view)

One Feeder Roller Assembly is built inside a dia. 170 mm rubber coated sleeve roller (3:2.1). A drive flange (3:2.7) is mounted inside the sleeve and the Servo Motor (MS7) with Planetary Gear (3:2.5) is inserted through Feeder Roller Gables (3:2.6). The Feeder Roller Assembly is guided on the Slide Bars (3:2.3) by Slide Guides (3:2.8).

Each Feeder Roller Assembly pair can be adjusted in the sliding direction to feed the Web on a proper distance from the Tools in open state. I.e., manual adjustment needed for each tool with new tool thickness.

2.3.3 Tool Sub-Unit

A Female-(3:3.2) and a Male-(3:3.1) Tool System is respectively mounted on the Clamping Unit Moving Platen (3:1.2) and the Fixed Platen (3:1.1). The Moving Platen (3:1.2) is moved by the Toggle System and closes and opens the Tools, (thus temporary creating a gap (G) of the Tool Systems).

Figure 40:
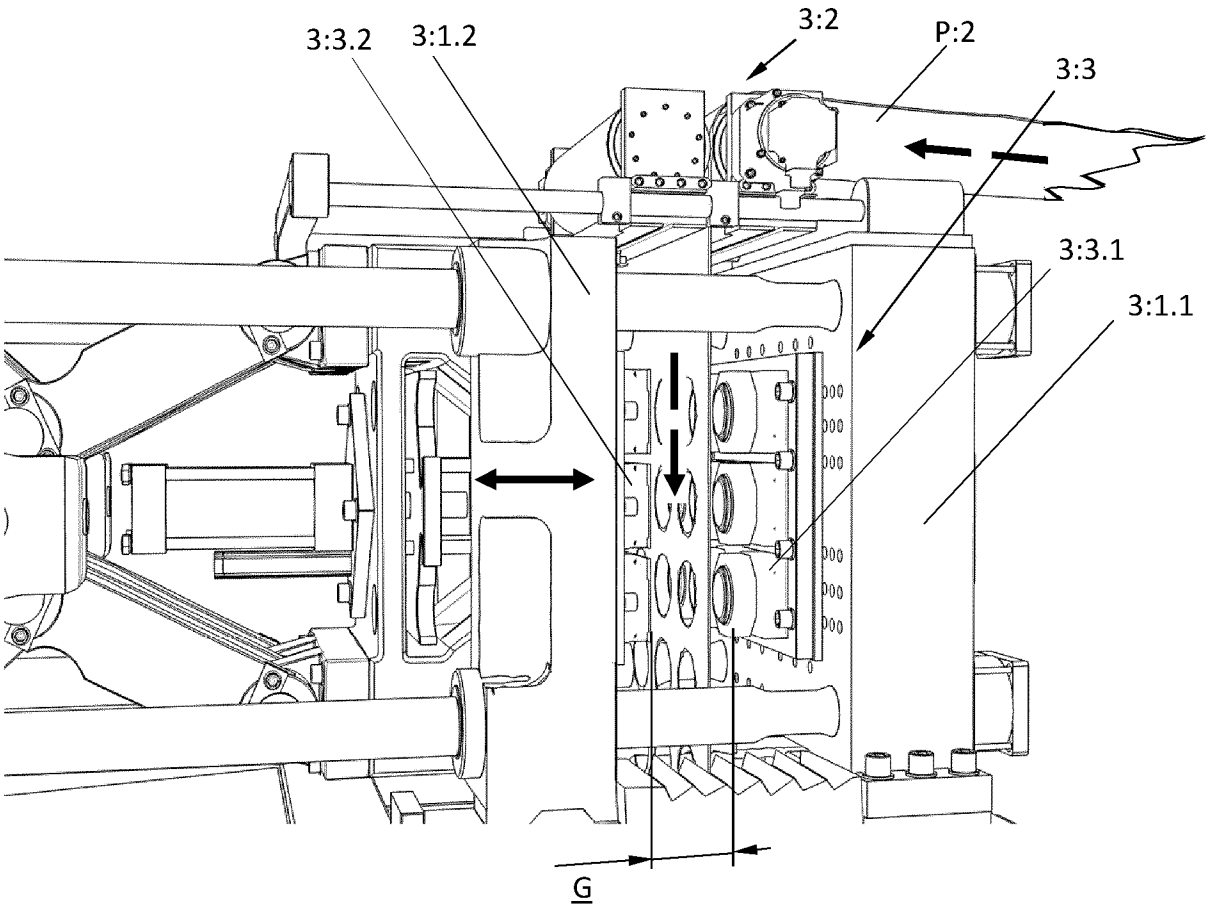

FIG. 40 schematically shows The Tool Sub-System in perspective with open Tools and Cut Web.

A tool for Dry Moulded Fibre requires additional know-how compared with the design of Injection Moulding Tools and/or Thermo Forming Tools for Thermo Plastics. This document is not covering design guidelines for tools for Scala. Please consult with a certified PulPac Tool Maker™ or directly to PulPac AB for guidance.

However, here follows an overview introduction, using a typical single use fibre lid, dia. 100 mm, as an example.

Figure 41:
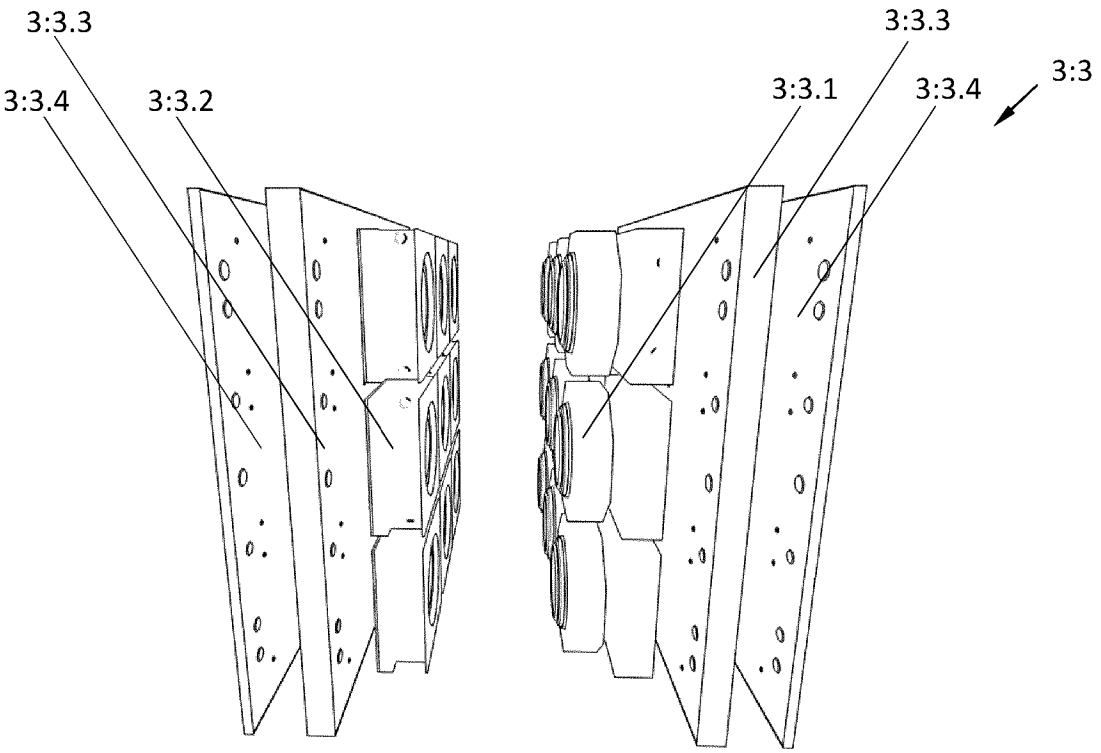

FIG. 41 schematically shows A Typical 9-cavity Tool Sub-System setup.

All tools are heated, normally using heat resistor inserts, to typically 150-180° C.

A multi cavity Tool (3:3) for Dry Moulded Fibre can preferably be made up of several single mould cavities (3:3.1 and 3:3.2). The single mould cavities are mounted on a Mother Plate (3:3.3) and an Insulator Plate (3:3.4) to decrease heat losses to the Clamping Unit.

The following description presents a single cavity mould, equipped with in-mould cutting, for producing a lid, e.g., for yogurt cups. Please note that the reference numbers in this description does not follow the general nomenclature in this document.

Figure 42:
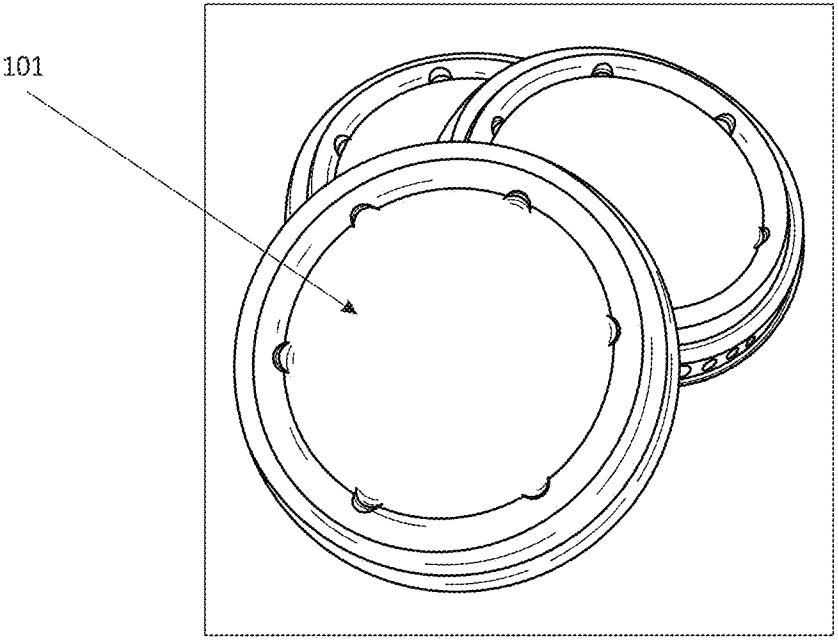
FIG. 42 shows a Typical Dry Moulded Fibre Single-Use Lid Product (5:8), FIG. 43 schematically shows, A Typical Male of a single cavity mould for Dry Moulded Fibre Lid, in cross section, FIGS. 44*a-d* schematically shows, a forming cycle A-D in a 2D cross section of the Lid tool, FIG. 44*e* schematically shows, a pressure diagram, FIG. 45*a* schematically shows, a Multi Cavity Tool comprising nine cavities, FIG. 45*b* schematically shows, an enhanced excerpt of the Multi Cavity Tool in FIG. 45*a* with four cavities, FIG. 46 schematically shows, a Recycling Sub-System, seen from Front/Left, FIG. 47*a* schematically shows, the Recycling Sub-System, seen from Back side, FIG. 47*b* schematically shows, the Recycling Sub-System, seen from Back side, FIG. 48 schematically shows, Scala with Covers, FIG. 49 schematically shows, The Cover Sub-System in FIG. 48 in an Exploded view, FIG. 50 schematically shows a Human Interface, HMI, Scala.

FIG. 42 shows a Typical Dry Moulded Fibre Single-Use Lid Product (5:8)

Figure 43:
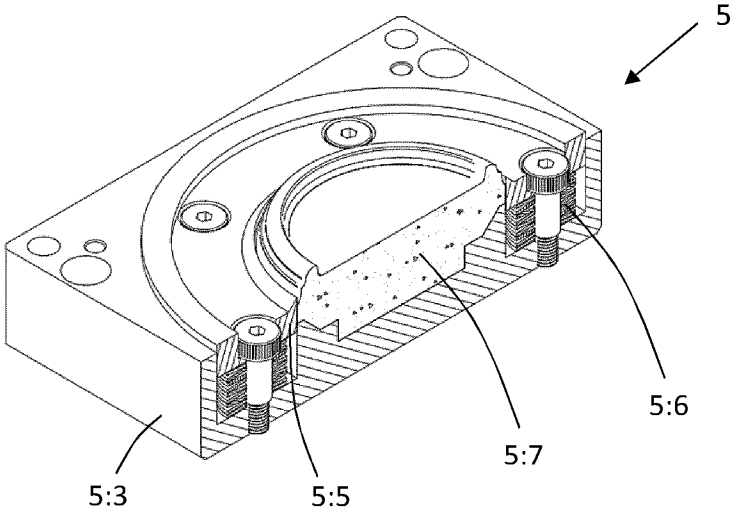

FIG. 43 schematically shows a Typical Male of a single cavity mould for Dry Moulded Fibre Lid, in cross section.

FIGS. 44*a*-44*d* schematically illustrates a forming cycle A-D in a 2D cross section of the Lid tool.

Figure 44A:
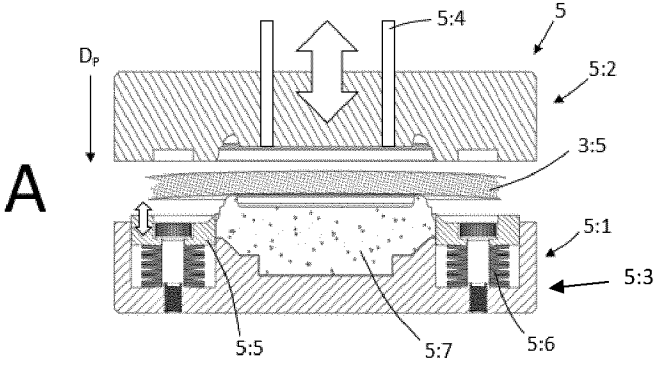
Figure 44B:
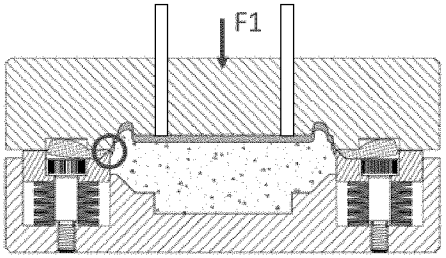
Figure 44C:
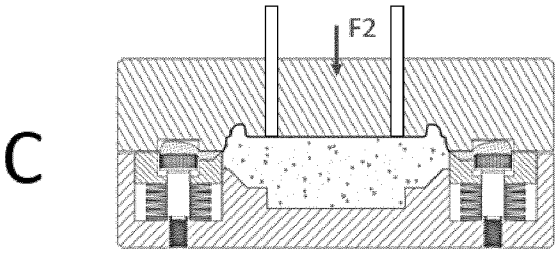
Figure 44D:
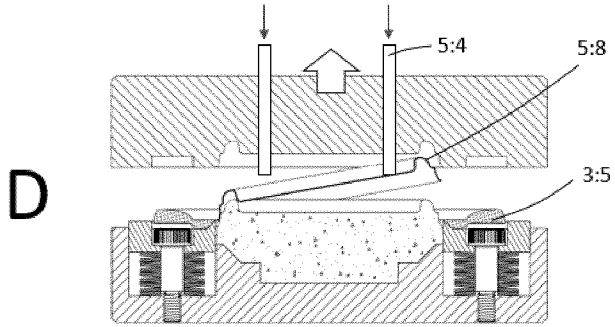
Figure 44E:
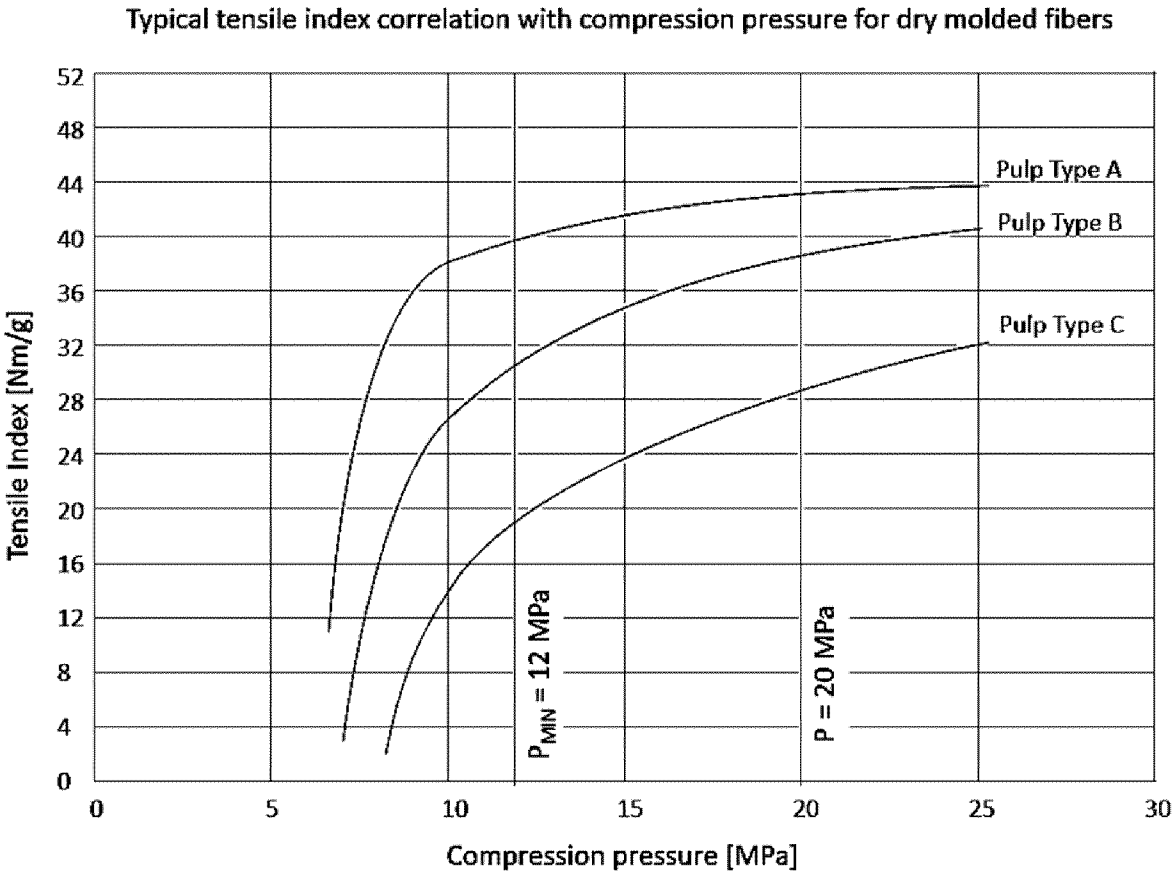

Many tools includes a spring loaded (5:6)) in-mould cutting device (5:5) and a soft pressure member, made by an Elastomer (5:7), assuring an isostatic pressure, i.e. essentially equal pressure in all directions, of at least 12 MPa, see diagram in FIG. 44*e*.

All tools are heated to a temperature (X15) measured by Tool Temperature Sensor (SAX) in every single tool. The Operator sets the desired Tool Temperature (SAX), in the "Product Recipe" in HMI and the PLC controls the measured temperature via a PID-regulator.

With reference to fig. previous page the forming process can be described in four steps A-D, normally taking 3 seconds per cycle.

A. The Blank/Web (P: 2) with Tissue is fed by the Tool Feeders (3:2) in the gap (G) between the open Tools (5:2 and 5:3).

B. The Clamping Unit closes the two tools (5:2 and 5:3) by moving the Female Tool System (5:2). The Web is folded into the cavity between the two tools and a Spring Loaded (5:6) Cutting Device (5:5) punches (see red ring) the blanks for each cavity, using a cutting force (F1).

C. The Clamping Unit further closes the tool with a force (F2) and the Soft Pressure Member (5:7) is compressed to an isostatic pressure normally set to 12 MPa by the Operator at the HMI. The fibres are then simultaneously exposed for the pressure and temperature and instant fibril aggregation, caused by hydrogen bonds, will make the fibre product (5:8) hard and stiff.

D. The Clamping Unit (6) opens the tools and the ejector cylinder press all Ejectors (5:4) for ejection of the products (5:8). The residual Web (3:5) will be transported out from the tools by the Waste Feeder, at the same time as new Web is fed in accordance with A above.

The Blank Web width of 500 mm and the outer size of the Clamping Unit Platens of 815×815 mm defines the available area for a multi cavity tool system.

Figure 45B:
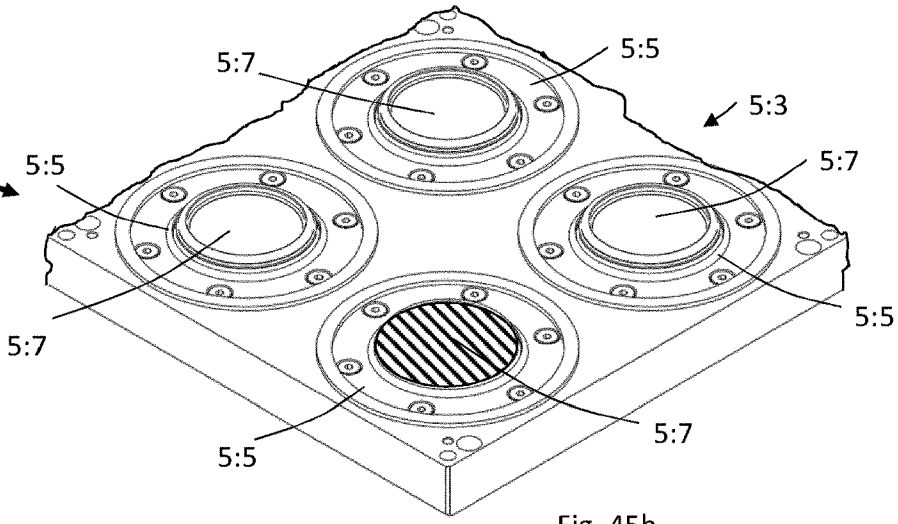
Figure 45A:
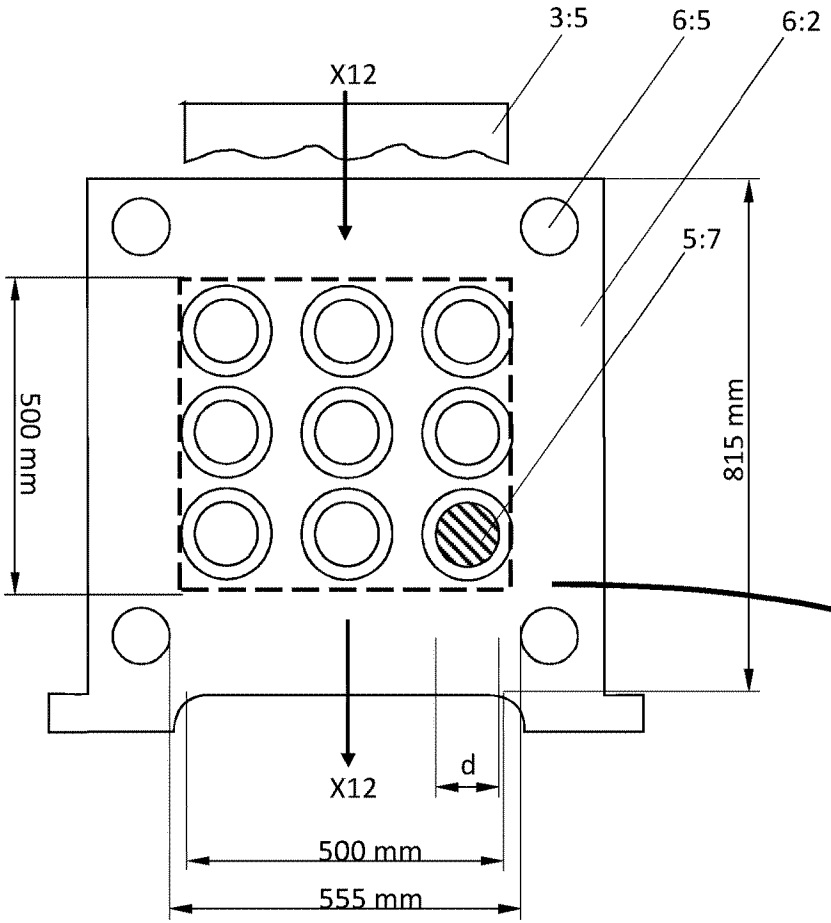

FIG. 45*a* schematically shows a Multi Cavity Tool with 9 cavities and FIG. 45*b* schematically shows an excerpt from FIG. 45*a* with 4 cavities.

In most cases the available tool mounting area, see dotted rectangle in FIG. 45, limits the number of cavities, rather than the available Pressing Force (X16) of 3 000 kN (300 ton). In this example, with round products (d=100 mm) and No. of cavities (n) is 15 and a preferred forming pressure (X14) of 12 MPa, the required Pressing Force (X16) is calculated as:

$$X16 = n[F1 + F2] = n\left[F1 + P\frac{\pi d^2}{4}\right]$$

X16=1 713 kN (173 ton); The Cut Force (F1) in this example is 20 kN/cavity

The preferred Forming Pressure (X14) or Pressure Force (X16) is defined in the product recipe section of the HMI.

2.3.4 Web Forming Sub-System Functional Requirement

The first Scala prototypes are using a Servo Hydraulic Clamping Unit HRU 300FC from Huarong Plastic Machinery Ltd.

| | Unit | Specification |
|---|---|---|
| Item Clamping Unit* | | |
| Clamping Force | kN | 2500 (up to 3000) |
| Tie Bar Distance | mm | 555 × 555 |
| Opening Stroke | mm | 200 |
| Tool (Mould) Thickness | mm | 200-300 |
| Mould Platen | mm | 815 × 815 |
| Ejector stroke | mm | 160 |
| Servo Motor (MS13) | kW | 34 |
| System Pressure | Bar | 140 |
| Weight | tons | 6 |
| Item Feeder | | |
| Roll Dia. | mm | 170 |
| Rubber Coating Hardness (3:2.1) | Shore A | 60 |
| Servo Motor (MS7, MS8, MS9 and MS10) | kW | 0.9 |
| Ratio Planetary Gear (3:2.5) | | 0.05 |
| Max Feed Length | mm | 500 |
| Max Nip Force (WN) | N | 1000 |
| Item Tool | | |
| See separate Drawings. | | |
| Mould Pressure | MPa | >12 |
| Mould temperature | ° C. | 150-180 |

*However, any type and size of clamping unit can be used.

2.4 Recycling Sub-System

Figure 46:
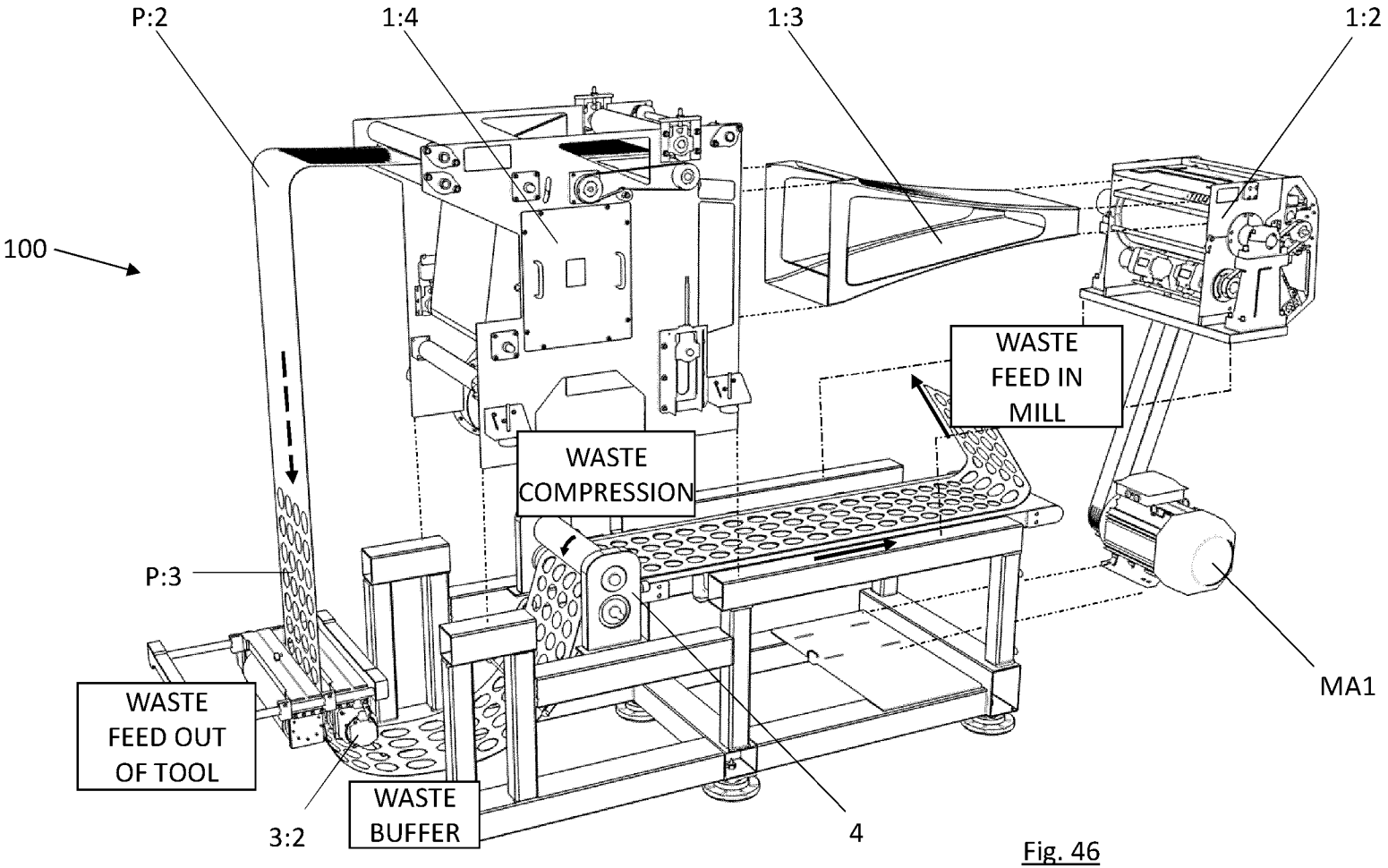

FIG. 46 schematically shows The Recycling Sub-System, seen from Front/Left.

The residual web (P: 3), after forming and punching out the products, including tissue coated with barrier chemicals, is possible to feed back to the Saw tooth Mill (1:2) for defibration again and re-use for new fibre products. The re-circulated fibres will reach a steady state level after a numbers of run and the milled tissue and additional levels of Barrier Chemicals will reach acceptable levels for forming and food grade approvals.

The waste web (P: 3) needs however to be hard compressed into a stiff sheet to be able to defibrate in the mill again, similar to the raw pulp. This compression is done in the Compression Unit followed by a transportation belt, constituting the Recycling Sub-System (4), see FIG. 47

Figures 47A, 47B:
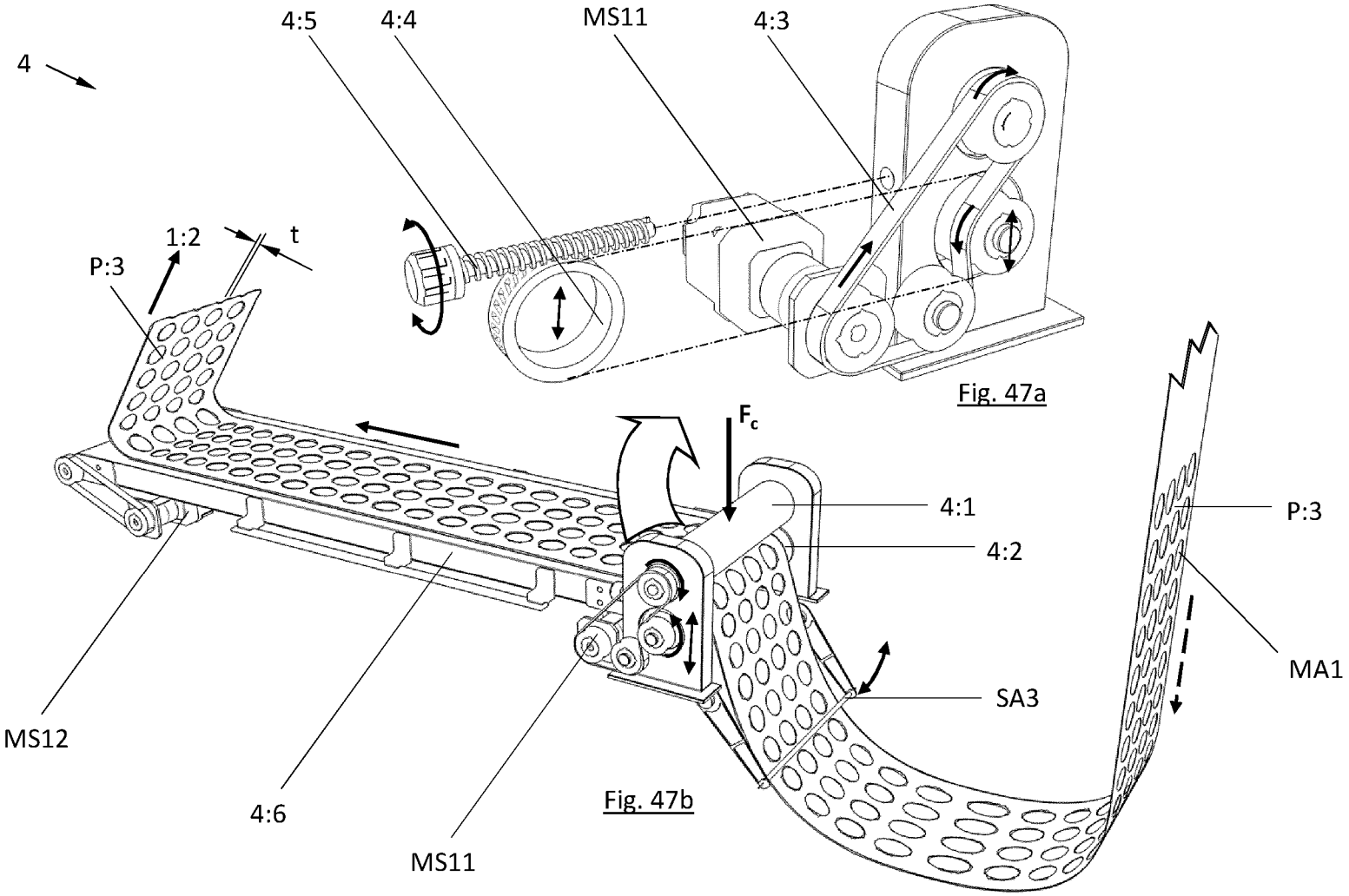

FIGS. 47*a* and 47*b* schematically show The Recycling Sub-System, seen from Back side.

Two Compression Rollers (4:1 and 4:2) are driven by Servo Motor (MS11) and a double-sided cog belt (4:3). The two rollers are supported by double roll bearings in each end, to withstand the Compression Force (Fc max=100 kN). The bearings of the Lower Roller (4:2) are supported by an Eccentric Ring (4:4) hosting a trapezoidal thread in its periphery. The Compression Force (Fc), or more correct, the geometrical distance between the two Compression Rollers are manually adjusted by turning a trapezoidal threaded Screw (4:5).

The roller distance can be adjusted between 0 and 4 mm. The thickness (t) of the Compressed Waste Web with Tissue (P: 3) will always be larger than the nip gap due to spring back in the fibre structure. A typical thickness of the Waste Web (t) is however 2-6 mm.

The Compression Rollers and the Mill Feeder are operated in a continuous motion and is not comprised by the Stop-and-Go motion in the Moulding Sub-System. I.e., a Waste Buffer, see previous fig., will store 0.5 m within each cycle. A Pivot Arm Sensor (SA3) measures the position of the Buffer Bulge to avoid Web path breakage.

A Belt Conveyor (4:6), driven by Servo Motor (MS12), transports the compacted Waste Web (P: 3) to the inlet of the Mill (1:2).

2.4.1 Recycling Sub-System Functional Requirement

| Item Clam | Unit | Specification |
|---|---|---|
| Compacting Roller Dia. | mm | 140 |
| Max Compacting Force | kN | 100 |
| Roller Nip Gap adjustment (Manually) | mm | 0-4 |
| Compression Motor (MS11) | W | 1500 |
| Planetary Gear ratio (MS11) | | 0.025 (1:40) |
| Drive Torque -Compression Nip | Nm | 4460** |
| Servo Motor (MS12) -Belt Conveyor | W | 900 |

**If the compression unit will be overloaded it is expected that the torque watch of the servo will force the entire system into an emergency stop.

2.5 Covers Sub-System

Figure 48:
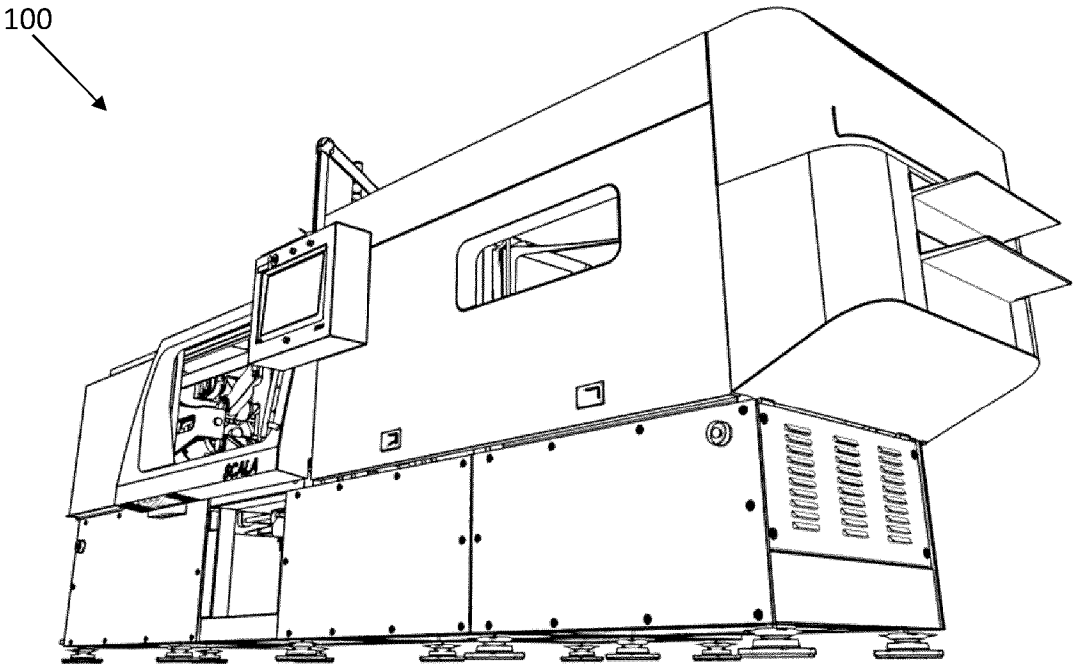

FIG. 48 schematically shows Scala with Covers

The functional purpose of the covers is to protect users from injuries and to lower noise less than 80 dB. Several sensors register the open/close status of openable covers and disable start-up or emergency stop the machine if opened in automatic mode.

Figure 49:
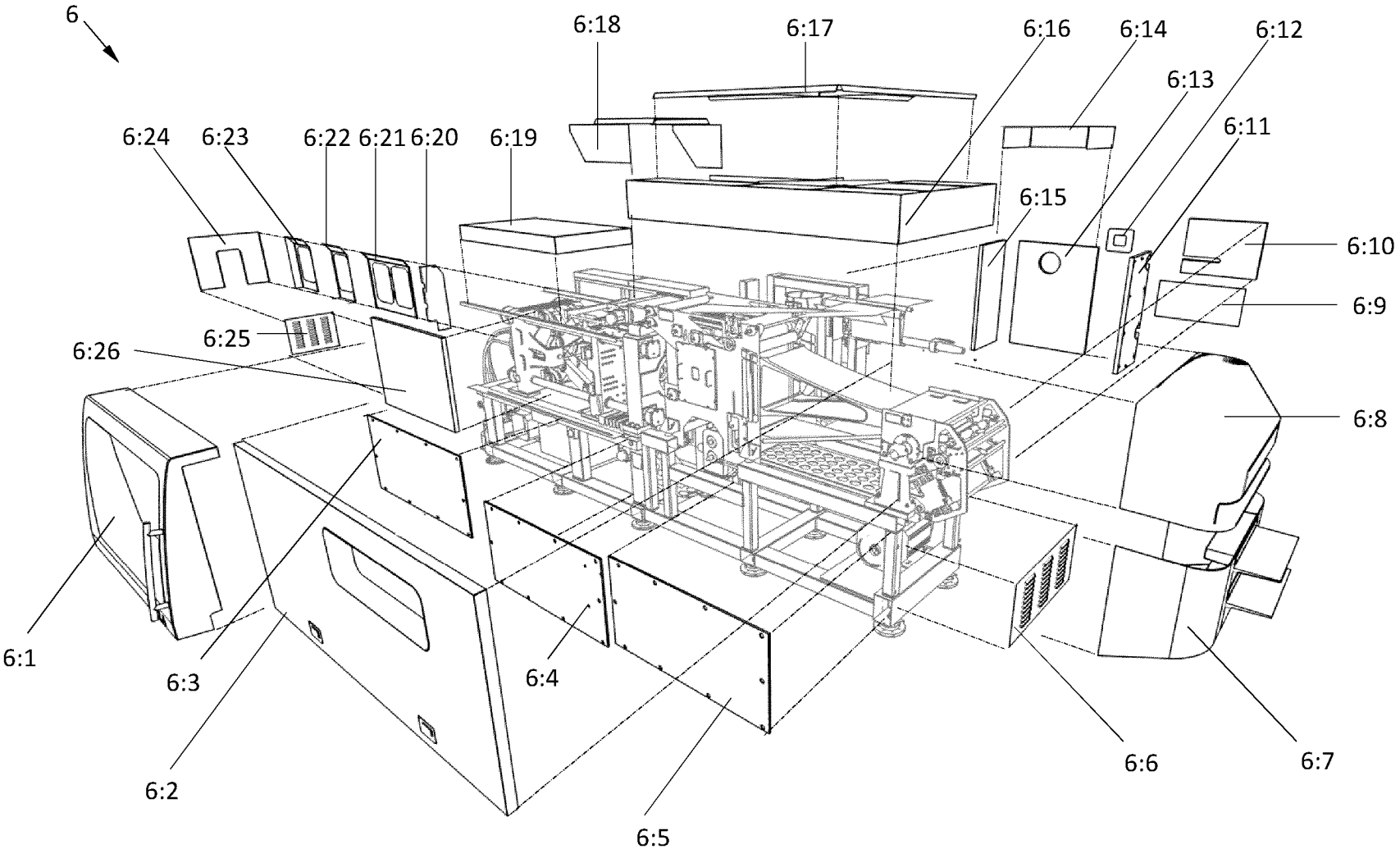

FIG. 49 schematically shows The Cover Sub-System-Exploded view

| Pos. | Cover | Spec. | Note |
|---|---|---|---|
| 6:1 | Front Door | O | |
| 6:2 | MTW Front Door | I + O + G | |
| 6:3 | Clamping Unit Lower Front | | |
| 6:4 | MTW Lower Front 1 | | |
| 6:5 | MTW Lower Front 2 | | |
| 6:6 | MTW Lower Gable | | Gills for ventilation |
| 6:7 | Pulp In-Let Gable | I | |
| 6:8 | Air In-Let Gable | I | With water nozzles |
| 6:9 | MTW Lower Back | | |
| 6:10 | MTW Upper Back | | With Tissue In-Let |
| 6:11 | Tissue Right Gable | I | |
| 6:12 | Fan Motor Air In-Let | I | |
| 6:13 | Tissue Sub-System Back | I | |
| 6:14 | Tissue Sub-System Top | I | |
| 6:15 | Tissue Left Gable | I | |
| 6:16 | MTW Top | I | |
| 6:17 | Upper Tissue Top Cover | O + G | |
| 6:18 | Kissing Point Cover | I + O | |
| 6:19 | Clamping Unit Top | O + G | |
| 6:20 | Clamping Unit Back Gable | H | |
| 6:21 | Clamping Unit Back Door | H | |
| 6:22 | Clamping Unit Back Window 1 | H | |
| 6:23 | Clamping Unit Back Window 2 | H | |
| 6:24 | Clamping Unit Gable | H | |
| 6:25 | Clamping Unit Lower Gable | H | Gills for ventilation |
| 6:26 | Clamping Unit Upper Front | | |

The Spec. code in table above:

| | |
|---|---|
| I | Noise Insulated; to be specified in later issue |
| O | Openable; see chapter 1.4 |
| G | With Gas springs |
| H | Huarong Original |

The glass in the Front Door (6:1) is made by Polycarbonate. The glass in MTW Front Door (6:2) is two layer insulation hardened and un-crushable in order to secure food safety.

3.0 Human Interface (HMI)

Figure 50:
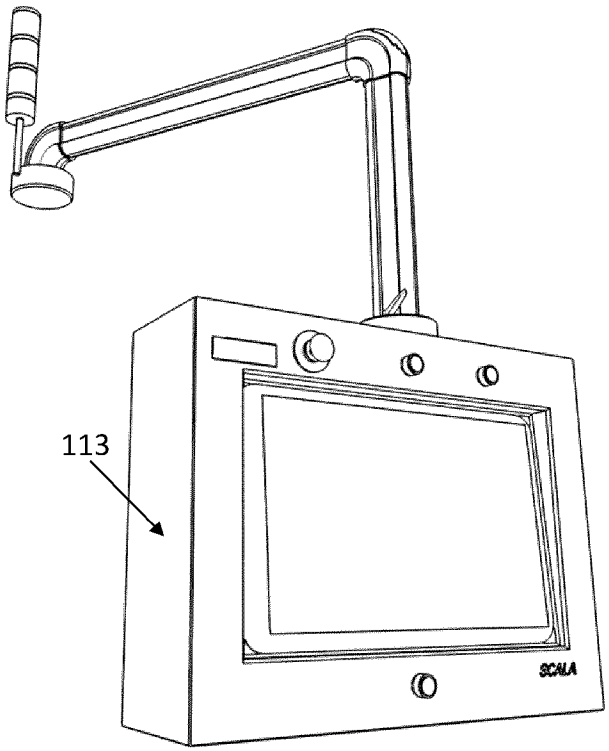

FIG. 50 schematically shows a Human Interface of Scala and thus a control unit 113.

The HMI Panel specification of Scala is:

Full 1920×1080 pixel HD resolution (16:9)

TFT-LCD touch screen 1.5 GB application memory

Ethernet 2×100 Mbit

0° C. to +50° C. operating temperature

CE, FCC, UL approvals

The touch screen panel is mounted on a swing arm enabling the operator to elevate and tilt the panel in the horizontal plane for optimal access by the sliding door.

Figure 51:
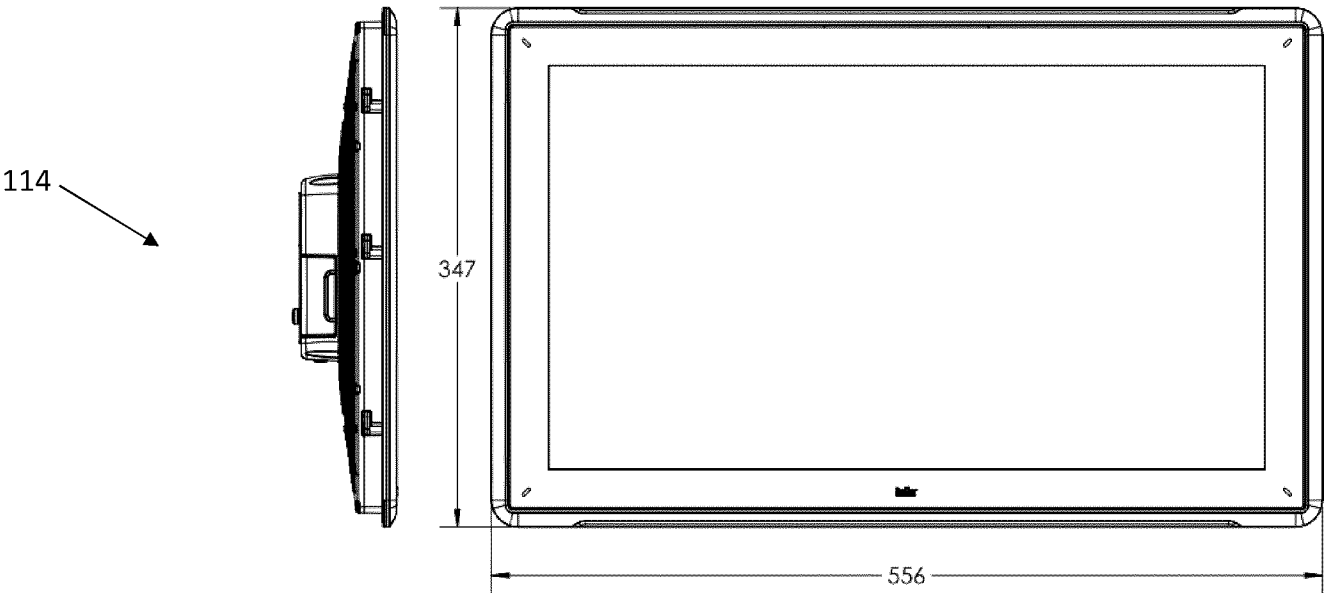
FIG. 51 schematically shows HMI Panel, measurements in mm.

FIG. 51 schematically shows an HMI Panel 114, measurements in mm

APPENDIX A

APPENDIX A; SERVO MOTORS SCALA

| | | MOTOR | | GEAR I: Mounted on Motor | | | | GEAR II: Transmission | | | |
|---|---|---|---|---|---|---|---|---|---|---|---|
| MS No. | Function | Max Speed rpm | Power Watt | Type | In | Out | Ratio | Type | In | Out | Ratio |
| MS01 | Pulp Sheet Feeder | 2500 | 900 | Planetary | 40 | 1 | 0.025 | Timing Belt | 36 | 36 | 1 |
| MS02 | Waste Web Feeder | 2500 | 900 | Planetary | 40 | 1 | 0.025 | Timing Belt | 36 | 36 | 1 |
| MS03 | Wire Belt Drive | 2500 | 1500 | Planetary | 40 | 1 | 0.025 | Timing Belt | 72 | 36 | 2 |
| MS04 | Web Compression | 2500 | 1500 | Planetary | 40 | 1 | 0.025 | Timing Belt | 72 | 36 | 2 |
| MS05 | Upper Tissue Roll Drive | 2500 | 1500 | Worm | 100 | 1 | 0.01 | Direct | 72 | 36 | 2 |
| MS06 | Lower Tissue Roll Drive | 2500 | 1500 | Worm | 100 | 1 | 0.01 | Direct | 72 | 36 | 2 |
| MS07 | Feed Into Tool Roller 1 | 2500 | 900 | Planetary | 20 | 1 | 0.05 | Timing Belt | 1 | 1 | 1 |
| MS08 | Feed Into Tool Roller 2 | 2500 | 900 | Planetary | 20 | 1 | 0.05 | Timing Belt | 1 | 1 | 1 |
| MS09 | Feed Out of Tool Roller 1 | 2500 | 900 | Planetary | 20 | 1 | 0.05 | Timing Belt | 1 | 1 | 1 |
| MS10 | Feed Out of Tool Roller 2 | 2500 | 900 | Planetary | 20 | 1 | 0.05 | Timing Belt | 1 | 1 | 1 |
| MS11 | Waste Compression | 2500 | 1500 | Planetary | 40 | 1 | 0.025 | Timing Belt | 22 | 36 | 0.61 |
| MS12 | Waste Transporter Belt | 2500 | 900 | Planetary | 40 | 1 | 0.025 | Timing Belt | 36 | 36 | 1 |
| MS13 | Hydraulic Servo Pump | | | | | | | | | | |

| | | GEAR III: Roller Periphery | | |
|---|---|---|---|---|
| MS No. | Function | Drive Surface | Dia. mm | Circumference mm |
| MS01 | Pulp Sheet Feeder | Straigth Knurled | 65 | 204.2 |
| MS02 | Waste Web Feeder | Belt Drive | 65 | 204.2 |
| MS03 | Wire Belt Drive | Rubber Coated | 111.9 | 351.5 |
| MS04 | Web Compression | Steel | 110 | 345.6 |
| MS05 | Upper Tissue Roll Drive | Full Tissue Roll | 800 | 2513.3 |
| | | Empty Tissue Roll | 101 | 317.3 |
| MS06 | Lower Tissue Roll Drive | Full Tissue Roll | 800 | 2513.3 |
| | | Empty Tissue Roll | 101 | 317.3 |
| MS07 | Feed Into Tool Roller 1 | Rubber Coated | 120 | 377 |
| MS08 | Feed Into Tool Roller 2 | Rubber Coated | 120 | 377 |
| MS09 | Feed Out of Tool Roller 1 | Rubber Coated | 120 | 377 |
| MS10 | Feed Out of Tool Roller 2 | Rubber Coated | 120 | 377 |

APPENDIX A-continued

APPENDIX A; SERVO MOTORS SCALA

| | | | | |
|---|---|---|---|---|
| MS11 | Waste Compression | Steel | 140 | 439.8 |
| MS12 | Waste Transporter Belt | Belt Drive | 140 | 439.8 |
| MS13 | Hydraulic Servo Pump | | | |

| | | CALCULATIONS | | | | | | |
|---|---|---|---|---|---|---|---|---|
| MS No. | Function | Feed mm/Motor Turn | Total Ratio | Max Feed mm/min | Max Feed mm/sec | Estim. Min Cycle Sec. | Max Roller rpm | Max. Tangential Nip Force N |
| MS01 | Pulp Sheet Feeder | 5.105 | 0.025 | 12 763 | 213 | 2.74 | 62.5 | 3520 |
| MS02 | Waste Web Feeder | 5.105 | 0.025 | 12 763 | 213 | 2.74 | 62.5 | 3520 |
| MS03 | Wire Belt Drive | 17.577 | 0.05 | 43 943 | 732 | 1.14 | 125 | 1704 |
| MS04 | Web Compression | 17.279 | 0.05 | 43 197 | 720 | 1.16 | 125 | 1733 |
| MS05 | Upper Tissue Roll Drive | 50.265 | 0.02 | 125 664 | 2 094 | 0.4 | 50 | 596 |
| | | 6.346 | 0.02 | 15 865 | 264 | 3.15 | 50 | 4719 |
| MS06 | Lower Tissue Roll Drive | 50.265 | 0.02 | 125 664 | 2 094 | 0.4 | 50 | 596 |
| | | 6.346 | 0.02 | 15 865 | 264 | 3.15 | 50 | 4719 |
| MS07 | Feed Into Tool Roller 1 | 18.85 | 0.05 | 47 124 | 785 | 1.06 | 125 | 953 |
| MS08 | Feed Into Tool Roller 2 | 18.85 | 0.05 | 47 124 | 785 | 1.06 | 125 | 953 |
| MS09 | Feed Out of Tool Roller 1 | 18.85 | 0.05 | 47 124 | 785 | 1.06 | 125 | 953 |
| MS10 | Feed Out of Tool Roller 2 | 18.85 | 0.05 | 47 124 | 785 | 1.06 | 125 | 953 |
| MS11 | Waste Compression | 6.72 | 0.015 | 16 799 | 280 | 2.98 | 38.19 | 4457 |
| MS12 | Waste Transporter Belt | 10.996 | 0.025 | 27 489 | 458 | 1.82 | 62.5 | 1634 |
| MS13 | Hydraulic Servo Pump | | | | | | | |

| | | BEUER: Article No. | |
|---|---|---|---|
| MS No. | Function | Servo Motor | Servo Driver |
| MS01 | Pulp Sheet Feeder | BSD-FEP09AMK-4 (71201) | BSD-L7NHB010U-4 |
| MS02 | Waste Web Feeder | BSD-FEP09AMK-4 (71201) | BSD-L7NHB010U-4 |
| MS03 | Wire Belt Drive | BSD-FEP15AMK-4 (71202) | BSD-L7NHB020U-4 |
| MS04 | Web Compression | BSD-FEP15AMK-4 (71202) | BSD-L7NHB020U-4 |
| MS05 | Upper Tissue Roll Drive | BSD-FEP15AMK-4 (71202) | BSD-L7NHB020U-4 |
| MS06 | Lower Tissue Roll Drive | BSD-FEP15AMK-4 (71202) | BSD-L7NHB020U-4 |
| MS07 | Feed Into Tool Roller 1 | BSD-FEP09AMK-4 (71201) | BSD-L7NHB010U-4 |
| MS08 | Feed Into Tool Roller 2 | BSD-FEP09AMK-4 (71201) | BSD-L7NHB010U-4 |
| MS09 | Feed Out of Tool Roller 1 | BSD-FEP09AMK-4 (71201) | BSD-L7NHB010U-4 |
| MS10 | Feed Out of Tool Roller 2 | BSD-FEP09AMK-4 (71201) | BSD-L7NHB010U-4 |
| MS11 | Waste Compression | BSD-FEP15AMK-4 (71202) | BSD-L7NHB020U-4 |
| MS12 | Waste Transporter Belt | BSD-FEP09AMK-4 (71201) | BSD-L7NHB010U-4 |
| MS13 | Hydraulic Servo Pump | NOT SPECIFIED HERE | NOT SPECIFIED HERE |

REFERENCE SIGNS-NOT ALL REFERENCE SIGNS ARE LISTED

100: Cellulose product machine, also called Scala in the description
101: Cellulose product
102: Cellulose blank structure
**102*a***: First surface, Cellulose blank structure
**102*b***: Second surface, Cellulose blank structure
103: First transport unit
104: Mill
**104*a***: Forming hood (1:3)
**104*a*1**: first opening
**104*a*2**: second opening
**104*b***: Suction box
**104*b*1**: Fan
105: Forming mould
**105*a***: First mould part
**105*b***: Second mould part
106: Cellulose-based material
**106*a***: First tissue layer
**106*b***: Second tissue layer
107: Water added before or in the mill
108: Water added before or in the mill
109: Second transport unit
110: Residual cellulose fibre structure
111: Conveyer belt wire belt
112: First side of conveyer belt
**112*b***: Second side of conveyer belt
113: Control unit
114: Display unit of the Control unit
115: Return buffer unit

The invention claimed is:

1. A method for forming an air-formed cellulose blank structure for producing a cellulose product, wherein the method comprises:

providing a flow of cellulose-based material to a mill, defibrating the cellulose-based material in the mill into cellulose fibres, providing an air-formed cellulose blank structure, wherein the cellulose blank structure is air-formed from the cellulose fibres, wherein the step of air-forming comprises the step of feeding the cellulose fibres to a first opening in a forming hood, wherein the cellulose fibres are directed onto a first side of a conveyer belt by the forming hood via a second opening in the forming hood, wherein a suction box is arranged in connection to a second side of the conveyer belt opposite the second opening of the forming hood, wherein the suction box comprises a fan that is connected to the suction box that creates an under-pressure generating a negative pressure gradient between the first side and the second side of the conveyer belt via through openings in the conveyer belt for forming the cellulose blank structure from the cellulose fibres directed onto the first side of the conveyer belt, providing the cellulose blank structure to a forming mould for forming the cellulose blank structure into a three dimensional cellulose product, intermittently operating the forming mould to apply a forming pressure onto the cellulose blank structure, and synchronizing the conveyer belt to intermittently form the cellulose blank structure simultaneously to the intermittent operation of the forming mould or between two intermittent operations of the forming mould, wherein the step of air-forming comprises the step of feeding the conveyer belt vertically such that the fibres are fed to the conveyer belt horizontally.

2. The method according to claim 1, wherein the step of providing the cellulose blank structure to a forming mould comprises the step of feeding the cellulose blank structure essentially vertically.

3. The method according to claim 2, wherein the step of intermittently operating the forming mould to apply a forming pressure onto the cellulose blank structure, comprises the step of operating the forming mould in a horizontal pressing stroke.

4. The method according to claim 1, wherein the method comprises a step of cutting out the cellulose product from the cellulose blank structure in and/or after the forming mould, thereby forming a residual cellulose fibre structure of the remaining cellulose blank structure, and feeding the material of the residual cellulose fibre structure to the mill as a complement to the flow of cellulose-based material.

5. The method according to claim 1, wherein the method comprises the step of providing a first tissue layer onto one side of the cellulose blank structure, wherein the first tissue layer comprises a barrier chemistry composition.

6. The method according to claim 5, wherein the method comprises the step of providing a second tissue layer to one side of the cellulose blank structure, wherein the second tissue layer comprises a barrier chemistry composition.

7. The method according to claim 6, wherein the barrier chemistry composition is provided to the first and/or second tissue layer during production and/or the step of providing the barrier chemistry composition to the first and/or second tissue layer by providing the barrier chemistry composition before production.

8. The method according to claim 1, wherein the method comprises the step of step of providing a barrier chemistry composition to the cellulose-based material before production and/or in production.

9. A cellulose product machine configured to form an air-formed cellulose blank structure for producing a cellulose product, wherein the machine comprises a first transport unit, a mill, a forming hood, a conveyer belt, a suction box, a second transport unit and a forming mould, wherein the first transport unit is configured to:

provide a flow of cellulose-based material to the mill, wherein the mill is configured to defibrate the cellulose-based material into cellulose fibres, wherein the forming hood comprises a first opening in fluid communication with the mill and a second opening in fluid communication with a first side of the conveyer belt, wherein the suction box is arranged in connection to a second side of the conveyer belt opposite the second opening of the forming hood, wherein the suction box comprises a fan that is connected to the suction box that creates an under-pressure generating a negative pressure gradient between the first side and the second side of the conveyer belt via through openings in the conveyer belt, wherein the forming hood is configured to provide an air-formed cellulose blank structure onto the conveyer belt, wherein the cellulose blank structure is air-formed from the cellulose fibres by the mill being configured to feed the cellulose fibres to the first opening in the forming hood, wherein the forming hood is configured to direct the cellulose fibres onto the first side of the conveyer belt via the second opening in the forming hood, wherein the second transport unit is configured to provide the cellulose blank structure to the forming mould for forming the cellulose blank structure into a three dimensional cellulose product, wherein the forming mould is configured to intermittently operating the forming mould to apply a forming pressure onto the cellulose blank structure, wherein the conveyer belt is synchronized with the forming mould to intermittently form the cellulose blank structure simultaneously to the intermittent forming pressure of the forming mould or between two intermittent operations of the forming mould, and wherein the conveyer belt is configured to run vertically such that the fibres are fed to the conveyer belt horizontally.

10. The cellulose product machine according to claim 9, wherein the second transport unit is configured to provide the cellulose blank structure to the forming mould vertically.

11. The cellulose product machine according to claim 9, wherein the forming mould is configured to operate in a horizontal pressing stroke.

* * * * *